US010377022B2

(12) United States Patent
Saitou et al.

(10) Patent No.: US 10,377,022 B2
(45) Date of Patent: Aug. 13, 2019

(54) POWER TOOL ANVIL LOCK MECHANISM

(71) Applicant: HITACHI KOKI CO., LTD., Tokyo (JP)

(72) Inventors: Keita Saitou, Hitachinaka (JP); Shinichirou Satou, Hitachinaka (JP); Tomomasa Nishikawa, Hitachinaka (JP); Masanori Watanabe, Hitachinaka (JP); Takuya Teranishi, Hitachinaka (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 974 days.

(21) Appl. No.: 14/397,836

(22) PCT Filed: Apr. 23, 2013

(86) PCT No.: PCT/JP2013/002754
§ 371 (c)(1),
(2) Date: Oct. 29, 2014

(87) PCT Pub. No.: WO2013/164905
PCT Pub. Date: Nov. 7, 2013

(65) Prior Publication Data

US 2015/0151415 A1 Jun. 4, 2015

(30) Foreign Application Priority Data

| | | |
|---|---|---|
| Apr. 30, 2012 | (JP) | 2012-104275 |
| Feb. 25, 2013 | (JP) | 2013-034741 |
| Mar. 14, 2013 | (JP) | 2013-051894 |

(51) Int. Cl.

| | |
|---|---|
| ***B25B 21/02*** | (2006.01) |
| ***B25B 21/00*** | (2006.01) |
| ***B25F 5/02*** | (2006.01) |

(52) U.S. Cl.
CPC ..... *B25B 21/02* (2013.01); *B25B 21/00* (2013.01); *B25F 5/02* (2013.01)

(58) Field of Classification Search
CPC ..... B25B 21/02
(Continued)

(56) References Cited

U.S. PATENT DOCUMENTS 4,700,956 A * 10/1987 Rohm ..... B23B 31/123 173/48
4,706,791 A * 11/1987 Magliano ..... F16D 43/02 192/223.2
(Continued)

FOREIGN PATENT DOCUMENTS

CN 201220392 Y 4/2009
EP 1410879 A1 4/2004
(Continued)

OTHER PUBLICATIONS

Notification of Reasons for Refusal Japanese Patent Application No. 2012-104275 dated Jul. 29, 2015 with English translation.
(Continued)

*Primary Examiner* — Gloria R Weeks
*Assistant Examiner* — Dariush Seif
(74) *Attorney, Agent, or Firm* — McDermott Will & Emery LLP

(57) ABSTRACT

A power tool which has an anvil 20 that is rotated by a hammer 22 and is housed in a housing, and rotates an output shaft 18 is provided. The anvil 20 and the output shaft 18 are integrally formed into one unit, and a carrier 33 that is rotatable relative to the anvil 20 by a predetermined angle on the same axis is provided. On one portion of an outer circumferential surface of the anvil 20, a relief surface 20*a* is formed. Cut-out portions 33*b* are formed at positions opposed to each other of a carrier 33, and by allowing an
(Continued)

engaging pin 37 to be interposed therein, a locking mechanism that limits the relative rotation between the anvil 20 and a lock ring 38 is prepared. When the tool main body is manually rotated while the hammer 22 is being stopped, the engaging pin 37 limits the relative rotation between the anvil 20 and the lock ring 38. The locked state between the anvil 20 and the lock ring 38 is released immediately when the rotation of the motor 4 is started.

1 Claim, 31 Drawing Sheets

(58) Field of Classification Search
USPC ..... 173/90, 93, 109, 104; 188/67
See application file for complete search history.

(56) References Cited

U.S. PATENT DOCUMENTS 5,016,501 A * 5/1991 Holzer, Jr. ..... B25B 21/00 173/181
5,593,210 A * 1/1997 Schwarzbich ..... B60N 2/2227 192/223.2
5,624,013 A * 4/1997 Tsai ..... B25F 5/001 188/82.2
5,788,021 A * 8/1998 Tsai ..... B25B 21/00 188/67
5,984,022 A * 11/1999 Harman, Jr. ..... B25F 5/001 173/176
6,814,158 B2 * 11/2004 Bieber ..... B23B 31/1238 173/109
7,048,107 B1 * 5/2006 Geis ..... B25F 5/001 192/223.2
7,073,606 B2 * 7/2006 Mamber ..... B23B 31/123 173/216
7,287,602 B2 * 10/2007 Zeiter ..... B25B 21/00 173/164
8,191,649 B2 * 6/2012 Zhu ..... B25B 21/02 173/104
8,651,198 B2 * 2/2014 Ito ..... B25B 21/02 173/109
9,687,947 B2 * 6/2017 Roehm ..... B23Q 5/043
2007/0267207 A1 * 11/2007 Ito ..... B25B 21/02 173/217
2010/0043603 A1 * 2/2010 McRoberts ..... B25B 13/465 81/57.11
2010/0126745 A1 * 5/2010 Zhu ..... B25B 21/02 173/48

FOREIGN PATENT DOCUMENTS

EP 1847355 A2 10/2007
JP 11-37187 A 2/1999
JP 2011-073087 A 4/2011
JP 4754395 B2 8/2011

OTHER PUBLICATIONS

Notification of First Office Action Chinese Patent Application No. 2013800227502 dated Aug. 26, 2015 with English translation.
Notification of Reasons for Refusal Japanese Patent Application No. 2013-034741 dated Jul. 14, 2016 with full English translation.
International Search Report PCT/JP2013/002754 dated Jul. 11, 2013.
Written Opinion of the International Searching Authority PCT/JP2013/002754 dated Jul. 11, 2013.

* cited by examiner

A - A

B - B

POWER TOOL ANVIL LOCK MECHANISM

CROSS-REFERENCE TO RELATED APPLICATIONS

This application is the U.S. National Phase of PCT/JP2013/002754 filed Apr. 23, 2013, which claims priority to Japanese Patent Application No. 2012-104275 filed Apr. 30, 2012, Japanese Patent Application No. 2013-034741 filed Feb. 25, 2013, and Japanese Patent Application No. 2013-051894 filed Mar. 14, 2013. The subject matter of each is incorporated herein by reference in entirety.

TECHNICAL FIELD

This invention relates to a power tool that is driven as its output shaft is driven by a driving source such as an electric motor and tightens a fastening member, such as a screw, a bolt or the like, and particularly relates to such a power tool in which, after the stoppage of the driving source, the fastening member can be manually tightened by using a tightening tool.

BACKGROUND ART

As a power tool for use in fastening a screw, a bolt or the like, an impact tool has been known in which a rotation force by a motor is transmitted to a rotating hammer so that, by making the hammer to strike an anvil, the force is converted into an impact force. As such an impact tool, Patent Literature 1 proposes a tool in which cams that convert the rotation movements of the hammer to retreating movements in the axial direction through steel balls are respectively formed on a spindle and the hammer so that, when a predetermined fastening toque has been reached, the hammer retreats to release the meshed state between an anvil and a claw portion of the hammer, and by stored energy of the spring accumulated at the moment when the hammer retreats, the rotation energy of the hammer is energized to allow the hammer to strike the anvil, thereby fastening or loosening the bolt.

CITATION LIST

Patent Literature

PTL 1: Japanese Patent Application Laid-Open Publication No. 2011-73087

SUMMARY OF INVENTION

Technical Problem

The fastening force of the impact tool in accordance with Patent Literature 1 is derived from energy accumulated in the spring and the energy makes the hammer to strike the anvil. However, in the case of a small-sized impact tool, its fastening torque is insufficient, and in some cases, the worker wants to carry out an additional tightening operation. In this case, when another manual tightening tool, such as a screw driver, is used, the tools to be grabbed have to be exchanged, thereby causing a very troublesome job. Therefore, a power tool which enables the additional tightening process by using the tool itself operated by power has been known; however, in this case, after the fastening job by the use of the power tool, an output shaft locking button has to be operated, and after the manual fastening job, the output shaft lock also needs to be released, thereby causing a troublesome switching job.

In view of the above-mentioned circumstances, the present invention has been devised, and its main object is to provide a power tool whose main body can be utilized as a tightening tool when a driving source such as a motor is stopped.

Solution to Problem

A power tool in accordance with one aspect includes: a housing that houses a driving source; a hammer that is driven in a rotation direction by the driving source; an anvil that is driven in the rotation direction when engaged with the hammer; and a locking mechanism that switches modes as to whether or not to lock the rotation of the anvil relative to the housing, and a feature of this structure is that a lock releasing member is pivotally attached to the anvil, and when the hammer is rotated, prior to the engagement of the hammer with the anvil, the hammer is engaged with the lock releasing member so as to release the locked state of the locking mechanism, and with the hammer being engaged with the anvil, the lock releasing member is pivotable between the hammer and the anvil.

A power tool in accordance with another aspect includes: a housing that houses a driving source; a hammer that is driven in a rotation direction by the driving source and has a first protruding portion that extends in an axis; a shaft portion that is rotatable relative to the housing; an anvil that has a second protruding portion that extends from the shaft portion outward in a radial direction so as to be engaged with the first protruding portion; and a locking mechanism that switches modes as to whether or not to lock the rotation of the anvil relative to the housing, and a feature of this structure is that a lock releasing member is pivotally attached to the anvil, and when the hammer is rotated, prior to the engagement of the first protruding portion with the second protruding portion, the first protruding portion is engaged with the lock releasing member so as to release the locked state of the locking mechanism, and a concave portion that receives one portion of the lock releasing member is formed on the first protruding portion.

A power tool in accordance with still another aspect includes: a driving source; a hammer that is rotated by the driving source; an anvil that is continuously or intermittently rotated by the hammer; and a housing that houses the driving source, the hammer and the anvil, the power tool rotating an output shaft that is connected to the anvil, a feature of the power tool is that the anvil and the output shaft are integrally formed, and a cylinder-shaped carrier member that is formed to be rotatable relative to the anvil within a predetermined angle in a circumferential direction centered on an axis of the output shaft with the output shaft being inserted to the carrier member, a lock ring that limits the carrier member from moving in a direction along the axis, a plane-shaped relief surface that is formed on one portion of an outer circumferential surface of the anvil, a first cut-out portion that is the carrier member and formed at a position opposed to the relief surface, and an engaging member that is formed on the first cut-out portion and limits a relative rotation between the anvil and the lock ring are further installed in the power tool.

A power tool in accordance with still another aspect includes: a driving member that is rotated by a driving source; an output shaft that is rotated by the driving member; and a first engaging member and a second engaging member that are movable between a lock position at which an engagement is made with the output shaft so as to make the output shaft unrotatable and a lock release position at which the output shaft is made rotatable, and in this structure, a first carrier member and a second carrier member that respectively engage with the first engaging member and the second engaging member are installed separately so that, when the driving member is rotated relative to the output shaft by the driving source, the driving member is engaged with the first carrier member and the second carrier member so as to make the first engaging member and the second engaging member to move from the lock position to the lock release position.

A power tool in accordance with still another aspect includes: a driving source; a hammer that is rotated by the driving source; an anvil that is continuously or intermittently rotated by the hammer; and a housing that houses the driving source, the hammer and the anvil and rotates an output shaft that is connected to the anvil, and a feature of the power tool is that the anvil and the output shaft are integrally formed, and a cylinder-shaped carrier member that is attached to be rotatable relative to the anvil by a fine angle on the same axis, with the output shaft being inserted to the carrier member, a lock ring that holds an outer circumferential surface of the carrier member, a plane-shaped relief surface that is formed on an outer circumferential surface of the anvil, a first cut-out portion that is formed on the carrier member at a position opposed to the relief surface, and an engaging member that is formed on the first cut-out portion, and limits a relative rotation between the anvil and the lock ring are further installed in the power tool, and the carrier member is composed of two members that are divided in a circumferential direction centered on the axis of the output shaft.

A power tool in accordance with the other aspect includes: a driving member to which a driving force of a driving source is transmitted; an output shaft that is rotated by the driving member; a first engaging member and a second engaging member that are movable between a lock position at which an engagement is made with the output shaft so as to make the output shaft unrotatable and a lock release position at which the output shaft is made rotatable; and a housing that houses the driving member as well as the first engaging member and the second engaging member, and a feature of the power tool is that a locking member capable of being made in contact with the first engaging member and the second engaging member is formed in a periphery of the output shaft so as to be movable in a circumferential direction of the output shaft, and when the housing is rotated with the output shaft being fixed, the locking member is made in contact with the first engaging member and the second engaging member so that the first engaging member and the second engaging member are moved to the lock position.

Advantageous Effects of Invention

According to the present invention, an arrangement is made such that, when the hammer rotates, prior to the engagement of the hammer with the anvil, the hammer is engaged with the lock releasing member to release the lock of the locking mechanism, and with the hammer being engaged with the anvil, the lock releasing member is made to pivot between the hammer and the anvil; therefore, when the hammer rotates, the lock of the locking mechanism is first released so that the anvil is made rotatable. Moreover, since the impact force of the hammer is directly transmitted to the anvil without passing through the lock releasing member, the impact force of the hammer is efficiently transmitted even when the rigidity of the lock releasing member is low.

DESCRIPTION OF EMBODIMENTS

Embodiment 1

Figure 1:
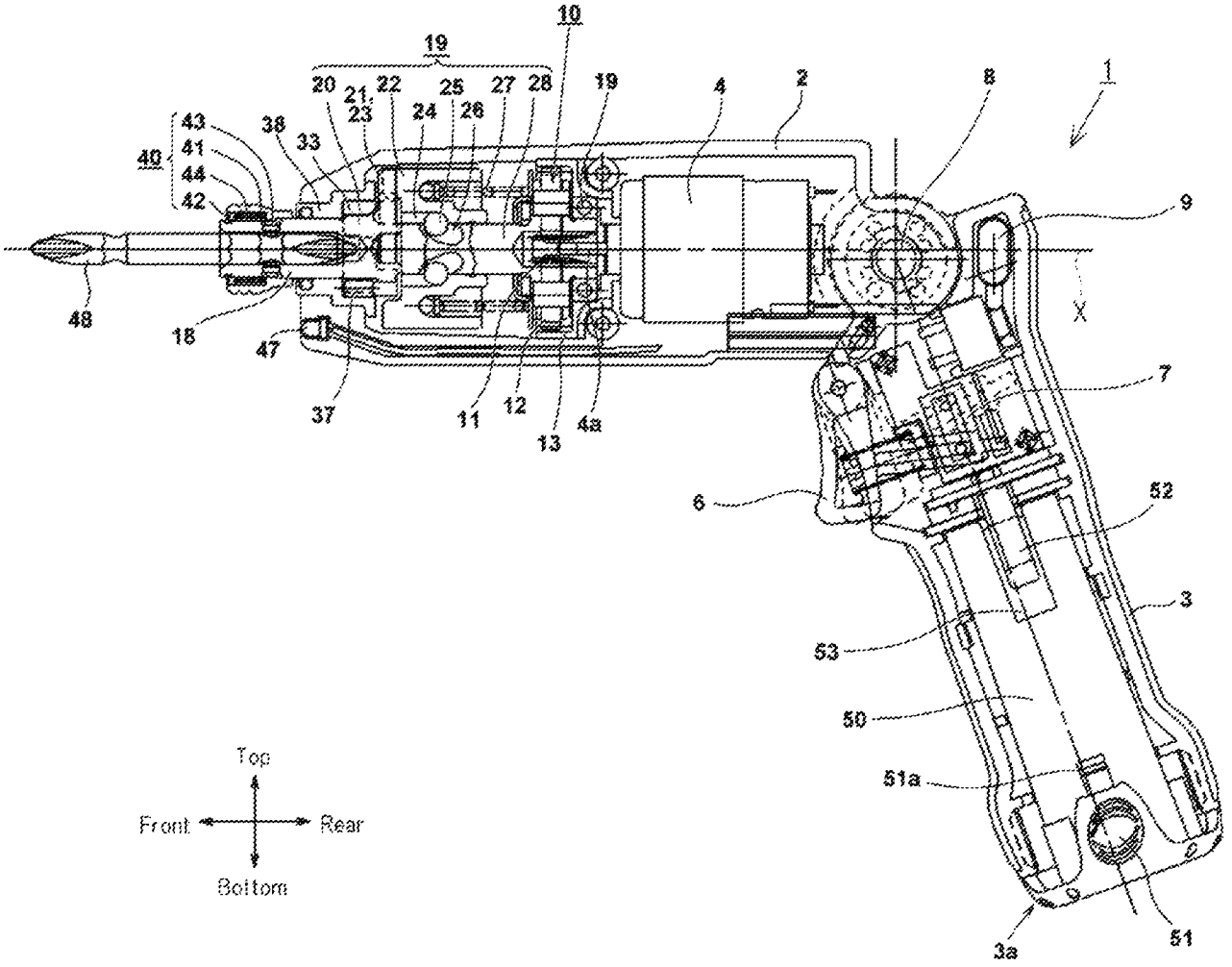
FIG. 1 is a longitudinal cross-sectional view illustrating the entire structure of an impact tool in accordance with a first embodiment of the present invention.

Hereinafter, a first embodiment of the present invention will be described with reference to the drawings. Additionally, in the following drawings, the same portions are indicated by the same reference numerals, and repetitive explanations will be omitted. In the present specification, explanations will be given on the premise that longitudinal directions and lateral directions correspond to directions indicated in the drawings. FIG. 1 is a cross-sectional view illustrating the entire portion of an impact tool 1 that is one example of a power tool in accordance with the first embodiments of the present invention. The impact tool 1 includes a motor 4, a reducer mechanism 10, an output shaft 18, an anvil 20, a hammer 22 and a spindle 28. The motor 4, the reducer mechanism 10, the output shaft 18, the anvil 20, the hammer 22 and the spindle 28 are disposed in a concentric manner centered on an axis X.

Among these components, the output shaft 18 is disposed at the forefront in a direction along the axis X, and the motor 4 is disposed at the backmost in the direction along the axis X. The axis X corresponds to an axis of the output shaft 18 in the present invention. The reducer mechanism 10, the anvil 20, the hammer 22 and the spindle 28 are disposed between the motor 4 and the output shaft 18 in the direction along the axis X. In the present specification, the term "frontward" refers to a direction along the axis X, corresponding to an approaching direction to the output shaft 18 or a portion closer to the output shaft 18. In the present specification, the term "rearward" refers to a direction along the axis X, corresponding to an approaching direction to the motor 4 or a portion closer to the motor 4.

The impact tool 1 utilizes electric power supplied from a battery pack 50, and rotates the motor 4 serving as a driving source. The battery pack 50 has a substantially cylindrical shape capable of being attached and detached to and from the inner space through an opening 3*a* at an end portion of a battery housing 3, and is designed to form of a so-called cassette. Two latch portions 51*a* are formed on the battery pack 50. Moreover, concave portions are formed on an inner wall of the battery housing 3. The latch portions 51*a* and the concave portions are engaged with each other so that the battery pack 50 is held.

To detach the battery pack 50, the battery pack 50 is pulled out through the opening 3*a*, while a latch 51 is being pressed. Three lithium ion battery cells are housed inside the battery pack 50, and its rated voltage is set to a DC voltage of 10.8 V. The rear end portion of the battery pack 50, that is, the lower side of FIG. 1, has such a shape as to cover the opening 3*a* of the battery housing 3. A substrate 54 is formed on the other end of the attaching space of the battery pack 50 continued to the opening 3*a*, and a plurality of terminals 52 are installed extending from the substrate 54 toward the opening 3*a*. A plurality of terminals 53 are formed on the front end portion of the battery pack 50. The front end portion of the battery pack 50 means an end portion on a trigger switch 7 side in the battery pack 50. By attaching the battery pack 50 into the battery housing 3, the terminals 53 are made in contact with the terminals 52 formed on the substrate 54 side.

The rotation of the motor 4 is decelerated by the reducer mechanism 10, and transmitted to the spindle 28 so that spindle 28 is driven to rotate at a predetermined velocity. The housing of the impact tool 1 is composed of a motor housing 2 and the battery housing 3. Each of the motor housing 2 and the battery housing 3 is pivotable by about 70 degrees centered on a pivot shaft 8, and FIG. 1 illustrates a state in which they have been pivoted. In the case when a fastening member is manually tightened and loosened by using the main body of the impact tool 1, by making an action of an output-shaft locking mechanism, which will be described later, the operation is preferably carried out after the battery housing 3 has been pivoted as illustrated in FIG. 1.

Moreover, although not illustrated in the drawings, the battery housing 3 may be pivoted so as to be disposed coaxially with the spindle 28 and the rotation shaft 4*a* of the motor. The motor housing 2 is formed by a molding process of a synthesized resin, such as plastics, so as to be divided into two right and left divided portions, and the right and left portions are fixed by using screws, not illustrated. In the power tool of the present embodiments, the impact mechanism 19 and the reducer mechanism 10 are directly housed inside the motor housing 2 made of a synthesized resin. Additionally, a substantially cup-shaped case, for example, a hammer case, which is made of a metal and formed by an integral molding process, may be installed. In this structure, the impact mechanism 19 and the reducer mechanism 10 are housed in the hammer case, and the hammer case is then connected to the motor housing.

A trigger switch 7 for use in controlling On-Off of the rotation of the motor 4 is attached to the impact tool 1. The On-state of the motor 4 means that the motor 4 is rotated, and the Off-state of the motor 4 means that the motor 4 is stopped. The trigger switch 7 allows the worker to pull a trigger 6 so that the On-state or Off-state is exerted. In the present embodiment, the trigger switch 7 serves as an On-Off changeover switch. Additionally, in place of the changeover switch, a variable switch may be installed so that the number of revolutions of the motor 4 may be adjusted in response to the pulling amount of the trigger 6.

A rotation changeover switch 9 is a switch for use in switching the rotation direction of the motor 4, and makes it possible to switch the rotation direction of the output shaft 18 in a forward/reverse direction. In the present specification, explanations will be given on the premise that a screw or a bolt can be tightened when the rotation direction of the output shaft 18 is in the forward rotation direction, while a screw or a bolt can be loosened when the rotation direction of the output shaft 18 is in the reverse rotation direction.

The reducer mechanism 10 includes a plurality of planetary gears 12 through which the rotation shaft 4*a* of the motor 4 is connected to a sun gear 11, and the planetary gears 12 revolve around the sun gear 11 while rotating in a gap relative to an inner gear 13 positioned on the outer circumferential side. The spindle 28 is a member for use in rotating the hammer 22, and the rear end side of the spindle 28 is connected to the rotation shaft of each of the plurality of planetary gears so as to exert functions as a planetary carrier. As a result, the revolving movements of the planetary gears 12 are converted to the rotating movements of the spindle 28. The spindle 28 is coupled to the hammer 22 by a cam mechanism, and this cam mechanism is composed of a V-shaped cam groove 26 formed on the outer circumferential surface of the spindle 28, a cam groove 24 formed on the inner circumferential surface of the hammer 22 and steel balls 25 to be engaged with these cam grooves 24 and 26.

The hammer 22 is always pressed frontward by a spring 27, and when kept in a stationary state, is positioned with a gap from the end face of the impact arm 21 by the engagements between the steal ball 25 and the cam grooves 24 and 26. Moreover, at two portions on rotation planes that are mutually opposed to each other of the hammer 22 and the anvil 20, a hammer claw 23 serving as a protruding portion and the impact arm 21 are formed symmetrically with each other. When the spindle 28 is driven to rotate, the rotation is transmitted to the hammer 22 via the cam mechanism, and before the hammer 22 has made a half rotation, the hammer claw 23 of the hammer 22 is engaged with the impact arm 21 of the anvil 20 so that the anvil 20 is rotated, and at this moment, when a relative rotation is generated between the spindle 28 and the hammer 22 by an engaging repulsive force, the hammer 22 starts to retreat toward the motor 4 side along the cam groove 26 of the cam mechanism, while compressing the spring 27.

When the hammer claw 23 climbs over the impact arm 21 by the retreating movement of the hammer 22, with the result that the engaged state of the two members is released, the hammer 22 is shifted forward by the pressing force of the spring 27 while being rapidly accelerated forward, that is, in the rotation direction, by the reaction of the elastic energy accumulated in the spring 27 and the reaction of the cam mechanism together with the rotation force of the spindle 28 so that the hammer claw 23 to strongly strikes the impact arm 21, thereby rotating the anvil 20. That is, the anvil 20 is continuously or intermittently rotated by the hammer 22. The output shaft 18 is connected to the forward side of the anvil 20 so that, via a tip tool 48 attached to the mounting hole of the output shaft 18, a rotary impact force is transmitted to a screw. Thereafter, the same rotating and impacting operations are repeated, and, for example, a fastening member, such as a screw, is screwed into a member to be fastened, not illustrated, such as a lumber or the like. Additionally, in the present embodiment, since the output shaft 18 and the anvil 20 are produced by an integral molding process, no rattling is caused between these members so that it is possible to achieve an impact tool having superior rigidity and quiet in impact sound. That is, it is possible to reduce a collision sound generated upon transmitting the rotary impact force from the hammer 22 to the output shaft 18. Moreover, since the shapes of the anvil 20 and periphery of the anvil 20 are simplified, it is possible to reduce the manufacturing costs of the impact tool 1.

Figure 2:
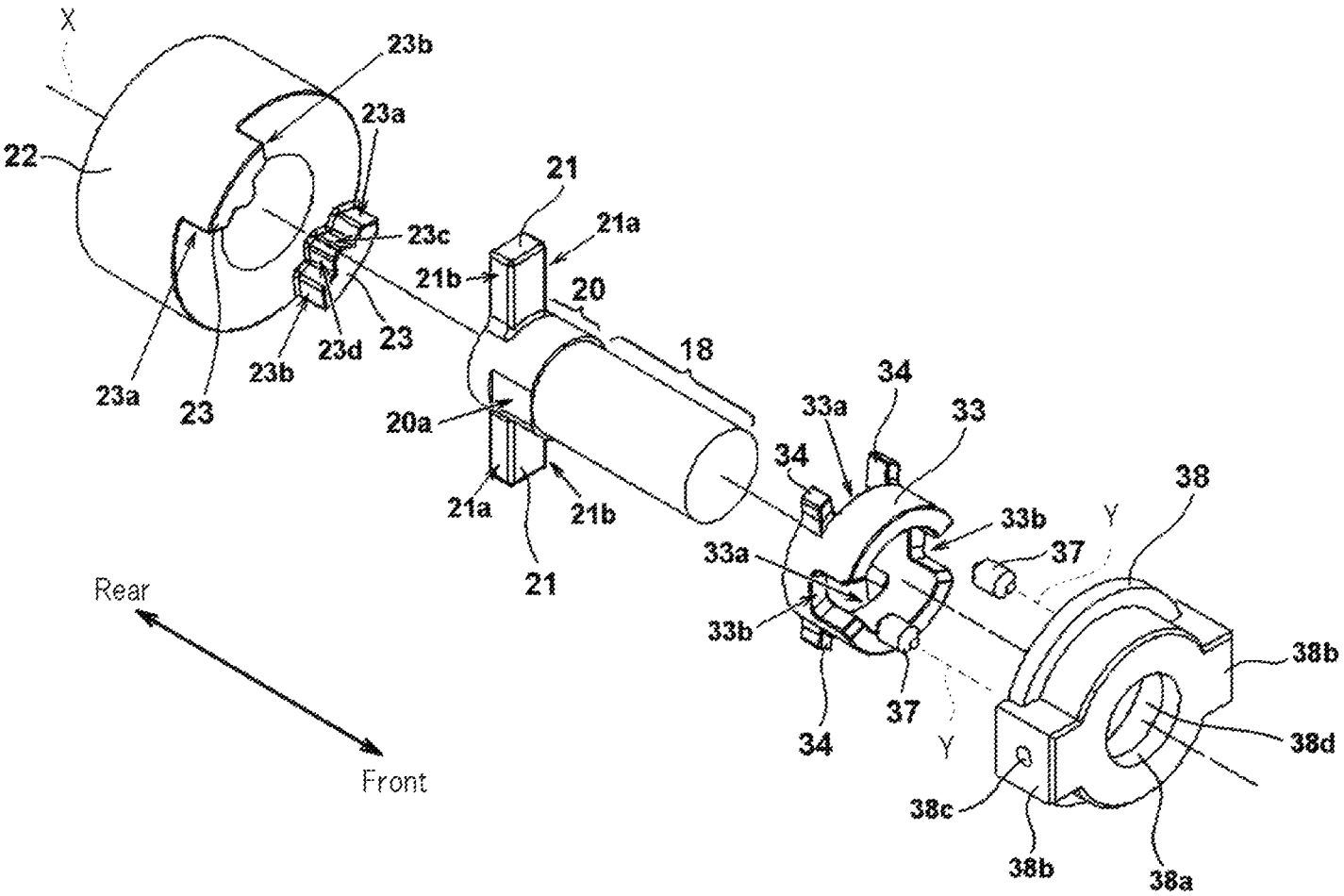
FIG. 2 is an exploded perspective view illustrating a vicinity of an impact portion of FIG. 1.

FIG. 2 is an exploded perspective view illustrating an assembly structure in a vicinity of the impact portion of FIG. 1. In the present first embodiment, the anvil 20, which is conventionally used in a mechanical impact mechanism, a lock ring 38 that pivotally supports the output shaft 18 integrally formed together with the anvil 20 onto the motor housing 2, and a locking mechanism, which switches states as to whether or not to lock the relative rotation of the anvil 20 relative to the motor housing 2, more specifically, to the lock ring 38, are installed. The locking mechanism is mainly composed of a relief surface 20*a* formed on one portion of the anvil 20, the lock ring 38, and two engaging pins 37. The relief surface 20*a* is a flat surface that is formed on one portion of the outer circumferential surface of the anvil 20.

The engaging pins 37 limit the relative rotation between the anvil 20 and the lock ring 38, in the case when the hammer 22 is stopped and rotating the anvil 20 relative to the motor housing 2. Both of the two engaging pins 37 have a column shape, with the center line Y of each of the engaging pins 37 being kept in parallel with the axis X of the output shaft 18. The lock ring 38 limits the output shaft 18 of the carrier 33 from moving in the direction of the axis X. Moreover, in the present first embodiment, the carrier 33 serving as a lock releasing member for releasing the locked state of the locking mechanism is installed. The carrier 33 is capable of rotating within a predetermined angle range in the circumferential direction centered on the axis X relative to the anvil 20. The carrier 33 corresponds to the carrier member of the present invention. The engaging pins 37 correspond to the engaging members of the present invention. The carrier 33, which is interpolated between the lock ring 38 and the anvil 20, has a cylindrical shape centered on the axis X. Additionally, in accordance with the addition of the carrier 33 and the two engaging pins 37, one portion of each of shapes of the hammer 22 and the anvil 20 is changed. The hammer 22 is produced in an integral molding process of a metal so as to have a predetermined mass, and coupled to the spindle 28 via the cam mechanism. On the front side of the hammer 22, hammer claws 23 serving as first protruding portions are formed on two portions in the circumferential direction. Each of the hammer claws 23, which is prepared as a protruding portion to form an impact surface against which the impact arm 21 is struck, protrudes so as to be extended forward, and is provided with an impact surface 23*a* in a forward rotation direction and an impact surface 23*b* in a reversed rotation direction that are respectively formed on two side faces in the circumferential direction. In the present specification, explanations will be given on the premise that the term "forward rotation direction" refers to a direction in which, for example, a screw or a bolt is tightened, and the term "reversed rotation direction" refers to a direction in which the screw or bolt is loosened. In each of the hammer claws 23 of the present embodiment, an impact surface 23*c* serving as a second impact surface formed on the inner circumferential side of the impact surface 23*a* is formed, and in the same manner, an impact surface 23*d* is formed on the inner circumferential side of the impact surface 23*b*. The second impact surface is prepared as a concave portion hollowed in the circumferential direction as well as in the impact direction relative to the first impact surface.

The anvil 20, which is a member against which the hammer 22 is struck, has a shape in which, in the present first embodiment, the output shaft 18 is connected to the tip side of the anvil 20, and these members are produced by an integral molding process. Additionally, FIG. 2 schematically illustrates the output shaft 18, a mounting hole through which the tip tool 48 is mounted and a through hole formed in a radial direction so as to insert the ball 43 are omitted from the illustration. In the present specification, the term "radial direction" refers to a radial direction of a circle centered on the axis X. The anvil 20 has a cylindrical shape, and on the outer circumferential surface of the anvil 20, two of the impact arms 21 that extend in the radial direction are formed. The two impact arms 21 are second protruding portions, and the two impact arms 21 are formed at positions separated from each other by 180 degrees in the rotational angle centered on the axis X. The two impact arms are extended outward in the radial direction so as to be engaged with the hammer claws 23. Because of its nature as a member to be struck, each of the impact arms 21 has a square pillar shape in its shape extending from the anvil 20.

The shape of the impact arm 21 may have a column shape, or another simple shape, as long as sufficient strength and durability are ensured against the impact. On the two impact arms 21, two plane-shaped impact-subject surfaces 21*a* and 21*b* are respectively formed. One surface in the circumferential direction centered on the axis X forms the impact-subject surface 21*a* in the forward direction, and the other surface in the circumferential direction forms the impact-subject surface 21*b* in the reversed direction. At each of two portions of the main body portion of the anvil 20 separated from each other by 180 degrees, a relief surface 20*a* is formed by cutting off one portion thereof into a plane.

The lock ring 38 is provided on the outer circumferential side of the output shaft 18. A main function of the lock ring 38 is to pivotally support the output shaft 18 rotatably, and a sliding bearing made of a metal or the like is integrally formed on the inner circumferential surface of the lock ring 38. On two portions separated from each other by 180 degrees in the circumferential direction of the lock ring 38, screw bosses 38*b*, each having a cubic shape, are formed, and screw holes 38*c* are formed on right and left side faces of each of the screw bosses 38*b*. In the present first embodiment, in place of using the cup-shaped hammer cover that covers the entire portion of the impact mechanism 19, by using the lock ring 38, the output shaft 18 is fixed onto the motor housing 2. Since the motor housing 2 is formed into two right and left divided units, by fixing the lock ring 38 from the outside of the motor housing 2 by using screws, not illustrated, the output shaft 18 is pivotally supported and also the right and left motor housing units 2 are joined to each other.

The carrier 33, which functions as a lock releasing member, has a cylindrical shape in its basic shape, and is disposed on the outside in the radial direction of the anvil 20 coaxially with the anvil 20. The carrier 33 is not fixed onto the anvil 20, but attached to the anvil 20 so as to be relatively shifted by a fine angle on the same axis with the anvil 20, that is, to be relatively rotatable on the axis. The fine angle corresponds to a predetermined angle. The carrier 33 has a cylinder portion having an inner diameter that is substantially equal to an outer diameter of the cylindrical portion of the anvil 20. In this case, between the carrier 33 and the anvil 20, a gap that allows the carrier 33 and the anvil 20 to relatively rotate by a fine angle is maintained. Moreover, on the carrier 33, at the rear portion of the cylinder portion, a plurality of concave portions, more specifically, two concave portions (second cut-out portions) 33*a* are formed. The concave portions 33*a* are formed at two portions on a diagonal line, in the circumferential direction of the carrier 33.

A cut-out portion 33*b* and each concave portion 33*a* are formed at different positions in the direction along the axis X. The cut-out portion 33*b* is formed by cutting out the end portion closer to the lock ring 38 of the carrier 33 in the direction along the axis X. The concave portion 33*a* is formed by cutting out the end portion closer to the hammer 22 of the carrier 33 in the direction along the axis X. Moreover, in the circumferential direction of the carrier 33, protruding portions (third protruding portions) 34, which protrude in the radial direction from edges (two end portions) of the two concave portions 33*a*, are formed. The gap of the two end portions in the circumferential direction of each concave portion 33*a* is designed to be slightly wider than the width in the radial direction of the impact arm 21.

In the present first embodiment, since the two impact arms 21 are formed on the outside from positions separated from the column shaped portion of the anvil 20 by 180 degrees, protruding portions 34 at four positions opposed to the respective impact-subject surfaces are formed. In other words, the protruding portions 34 are respectively formed so as to correspond to the impact-subject surfaces 21*a* and 21*b*. In this case, the term "correspond" means that the layout positions of the protruding portions 34 and the layout positions of the impact-subject surfaces 21*a* and 21*b* are overlapped with each other at least in one portion in the radial direction centered on the axis X. Each of the protruding portions 34 is a portion that is in contact with the additional impact surfaces 23*c* and 23*d* additionally formed on the hammer 22, and by allowing these portions to be struck by the impact surfaces 23*c* and 23*d*, the position of the carrier 33 relative to the anvil 20 can be changed. Each of the protruding portions 34 is provided in association with the impact surface 23*c*.

In this case, the term "correspond" means that the layout positions of the protruding portions 34 and the layout position of the impact surface 23*c* are overlapped with each other at least in one portion in the radial direction centered on the axis X. The relative position between the carrier 33 and the anvil 20, that is, a relative rotation angle, is about −10 or +10 degrees. At each of positions opposed to the relief surface 20*a* of the carrier 33, a cut-out portion 33*b* serving as a first cut-out portion is formed. The cut-out portions 33*b* are formed at two portions on a diagonal line in the circumferential direction of the carrier 33. Each cut-out portion 33*b* is formed by cutting out the opening portion on the front side of the cylinder portion of the carrier 33 rearward into a concave shape in the direction along the axis X. The opening portion on the front side of the cylinder portion of the carrier 33 refers to an opening portion closer to a sleeve 41 in the direction along the axis X of the carrier 33.

The cut-out portion 33*b* is used for defining a space for housing each engaging pin 37, and the inner circumferential side of the cut-out portion is covered with the relief surface 20*a* of the anvil 20. The outer circumferential side of the cut-out portion 33*b* is covered with the cylinder portion 38*d* of the lock ring 38. The front side of the cut-out portion 33*b* is covered with a step portion 38*e* of the lock ring 38. The rear side and the two ends in the radial direction of the cut-out portion 33*b* are covered with the wall portions of the cut-out portion 33*b*.

In this manner, each engaging pin 37 is allowed to roll in the space defined by the cut-out portion 33*b* substantially in synchronism with the anvil 20. That is, the engaging pin 37 is allowed to revolve on the circumference centered on the axis X. When the relative position between the anvil 20 and the carrier 33 deviates in the radial direction, the engaging pin 37 serves as a locking mechanism for limiting the relative rotation between the anvil 20 and the lock ring 38, and this action will be described later in detail.

Figure 3:
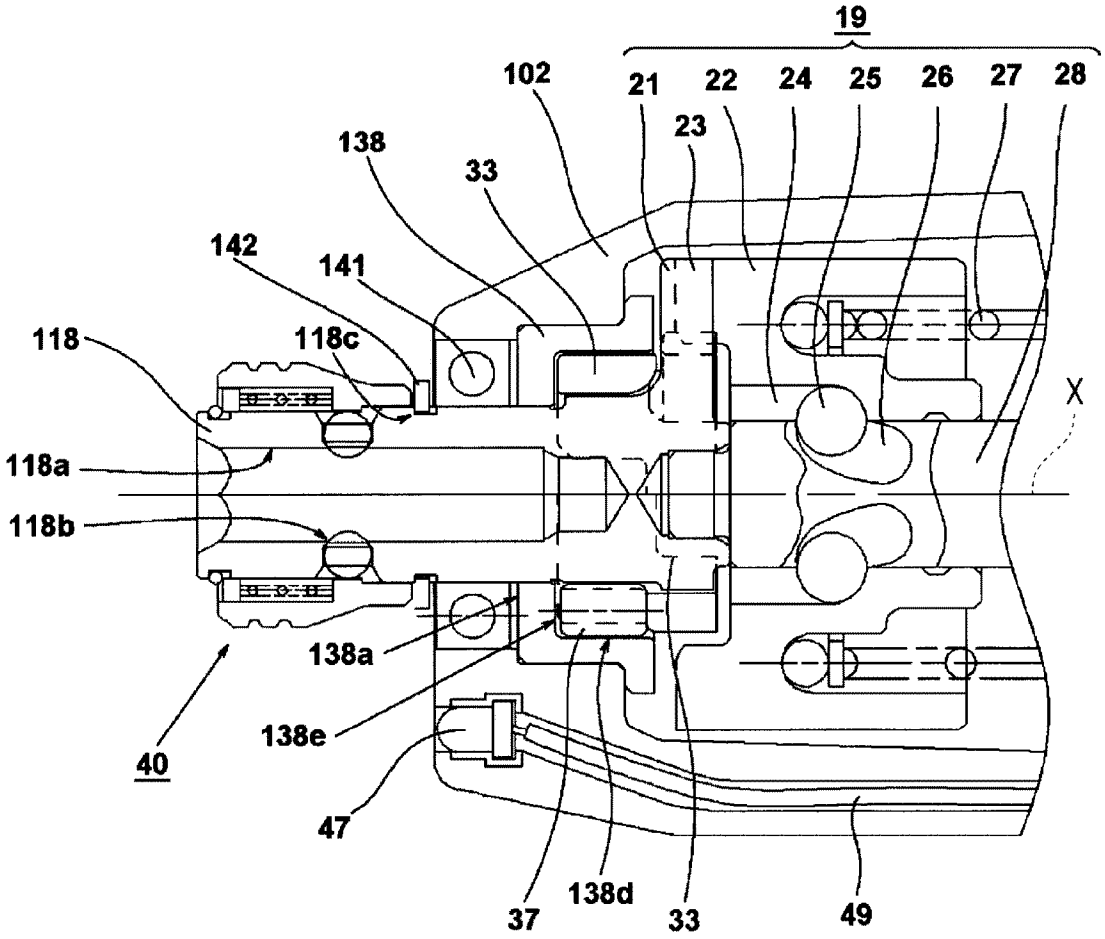
FIG. 3 is an expanded cross-sectional view illustrating the vicinity of the impact portion of FIG. 1.

FIG. 3 is an enlarged cross-sectional view illustrating the vicinity of the impact portion of FIG. 1. As can be understood from FIG. 3, the carrier 33 is disposed at the tip side of the hammer 22 so as to have its rear end portion disposed in the same manner as the rear end portion of the impact arm 21. The tip portion of the carrier 33 has its front end side held by the step portion 38*e* of the lock ring 38, with the outer circumferential side being held by the cylinder portion 38*d* and with the inner circumferential side being held by the outer circumferential surface of the anvil 20. A fitting hole 38*a* having a column shape is formed in the vicinity of the center on the rear end side of the anvil 20, and a fitting axis 20*b* formed at the tip of the spindle 28 is housed in the hole.

Since the rear end of the anvil 20 and the front end of the spindle 28 are pivotally supported in a manner as if they relatively rotate with each other, it is possible to achieve an impact portion with high rigidity. The lock ring 38 has a column shape, and the lock ring 38 is attached to the motor housing 2 so as not to rotate. In order to prevent the frictional resistance between the lock ring 38 and the engaging pin 37 from becoming high, a fine contact region, for example, a convex portion, is preferably formed on the tip of the engaging pin 37 in the direction along the axis X. Note that an O-ring 39 is attached to a shaft receiving portion 38*a* of the lock ring 38 so as to prevent grease from leaking from the impact mechanism portion.

In order to insert the tip tool 48, a mounting hole 18*a* having a hexagonal shape in its cross section within a plane perpendicular to the axis X is formed at the tip of the output shaft 18. A mounting portion 40 of the tip tool 48 is formed on the tip side of the output shaft 18. On the side face of the output shaft 18, a through hole 18*b* that houses balls 43 being movable therein is formed, and it is formed in such a shape as to prevent the balls 43 from coming off and falling onto the inner circumferential side from the through hole 18*b*. The outside in the radial direction of the balls 43 is held by a sleeve 41 that is energized thereon by a spring 44. A washer 42 is attached to the inside of the sleeve 42, and the washer 42 is held so as not to move in a direction along the axis X by a C-ring 45.

Upon attaching or detaching the tip tool 48 to or from the output shaft 18, the sleeve 41 is moved in a direction along the axis X, that is, in a departing direction from the lock ring 38, from the normal position illustrated in FIG. 3 against the energizing force of the spring 44. When the sleeve 41 is moved, the outer circumferential portions of the balls 43 are released from the abutting state to a convex surface formed on the inner circumferential side of the sleeve 41 so that, since the balls 43 are allowed to move toward the outside in the radial direction, the attaching or detaching process of the tip tool 48 can be carried out without any resistance. Additionally, on one portion of the motor housing 2, that is, on the lower side of the output shaft 18, an LED 47 for use in illuminating in the tip tool direction is formed. Electric power is supplied to the LED 47 through a power source line 49.

Figure 4:
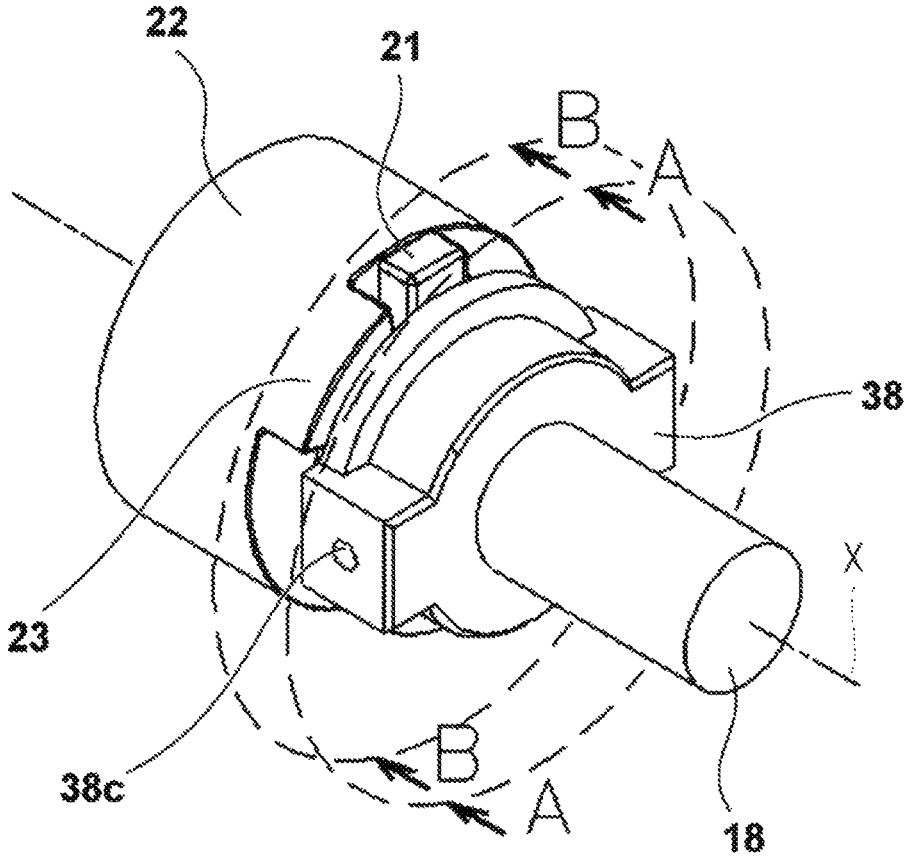
FIG. 4 is an assembly perspective view illustrating the vicinity of the impact portion of FIG. 1.

FIG. 4 is a perspective view illustrating the vicinity of the impact portion of FIG. 1 after its assembling process. FIG. 4 illustrates a state in which no motor housing 2 is attached thereto so as to clearly indicate the positional relationship.

Upon the assembled state, as illustrated in the Drawing, no carrier 33 is seen when viewed diagonally, and the shape is substantially the same as that of an existing impact tool. In the present first embodiment, however, by using the carrier 33 and the two engaging pins 37, specific operations can be carried out. In the following drawings, with using the cross-sectional view of the A-A portion and the cross-sectional view of the B-B portion, operations of the impact tool 1 in accordance with the present first embodiment will be described. In this case, the cross section of the A-A portion refers to a plane passing through the two screw holes 38*c* formed in the lateral direction of the lock ring 38, and corresponds to a cross section perpendicular to the axis X. The cross section of the B-B portion refers to a plane passing through the centers of the hammer claw 23 and the impact arm 21, and corresponds to a cross section perpendicular to the axis X.

Figure 5:
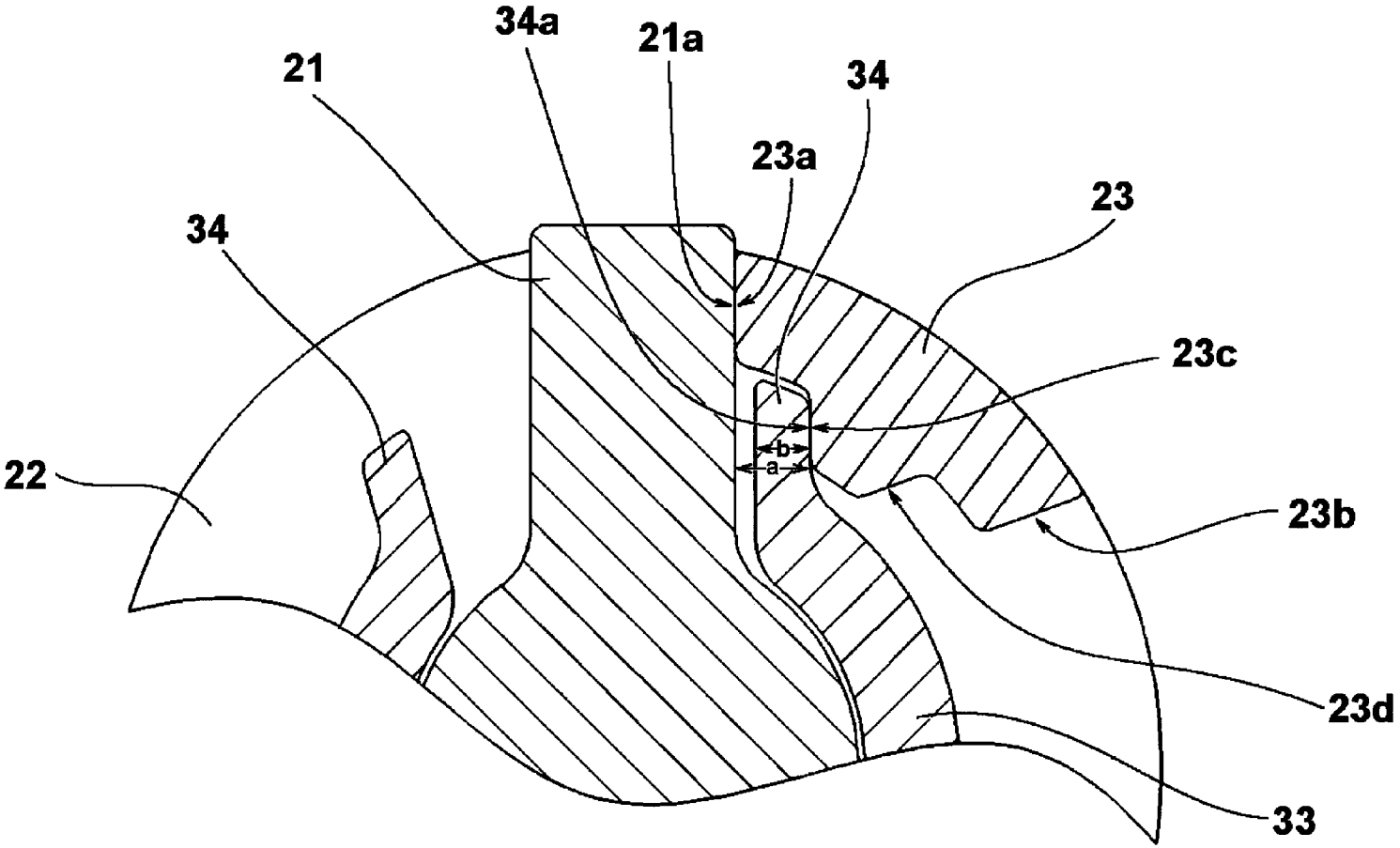
FIG. 5 is a partially expanded view illustrating shapes of a hammer, a carrier and an anvil in accordance with the embodiments of the present invention.

FIG. 5 is a partially expanded cross-sectional view illustrating shapes of the hammer and the carrier in accordance with the embodiment of the present invention, and corresponds to the cross-sectional view of the B-B portion of FIG. 4. The two hammer claws 23, disposed at diagonal corners in the circumferential direction, are designed such that, in addition to the two impact surfaces 23*a* and 23*b* positioned on the outer circumferential side in an elliptical circumferential direction, two impact surfaces 23*c* and 23*d* are added and formed on the inner circumferential side. Here, the impact surfaces 23*a* and 23*b* are formed so as to strike the impact-subject surfaces 21*a* and 21*b*, and they have the same functions as those of hammer claws to be used in an existing impact tool, and have also substantially the same basic shapes. The impact surfaces 23*c* and 23*d* are used for pressing the protruding portion 34 of the carrier 33.

As can be understood from the positional relationship of FIG. 5, when, upon fastening a screw, the hammer 22 is rotated, the impact surface 23*c* of the hammer claw 23 is first made in contact with an impact-subject surface 34*a* of the protruding portion 34. The rotation direction of the hammer 22 is a counter-clockwise direction in FIG. 5. As described earlier, the carrier 33 and the impact arm 21 can be relatively moved by a fine angle, the impact surface 23*c* is only allowed to push the impact-subject surface 34*a*, and is not so strongly as to strike the surface 34*a*. The fine angle is set to about 20 degrees as a rotation angle of the hammer 22.

When, after that state, the carrier 33 is rotated counter-clockwise by the rotation of the hammer 22, the impact surface 23*a* of the hammer 22 collides with or is engaged with the impact-subject surface 21*a* of the impact arm 21. In this collision, since a repulsive force from the member to be tightened is transmitted from the tip tool 48 to the output shaft 18 integrally formed with the anvil 20, the collision becomes a strong impact. FIG. 5 illustrates a state at the moment when the impact surface 23*a* and the impact-subject surface 21*a* are engaged with each other, and such a structure as to generate a predetermined gap between the protruding portion 34 and the impact arm 21 at this moment is prepared.

In other words, the distance between the impact-subject surface 21*a* of the impact arm 21 and the impact surface 23*c* of the hammer claw 23 is "a" relative to the thickness "b" of the protruding portion 34 in the rotation direction, and the relationship of a and b is a<b. By using this structure, since, upon giving an impact thereto, or upon rotation prior to a mounting process of a bolt or the like, the force of the hammer claw 23 is directly exerted on the impact arm 21, the carrier 33 does not contribute to the torque transmission, with the result that no adverse effects due to the interpolation of the carrier 33 are caused. Moreover, since no strong impact force is transmitted to the carrier 33, it is possible to reduce the impact transmitted to the carrier 33, and consequently to provide a long service life.

Next, with reference to FIG. 6, descriptions will be given on a state in which a fastening job is carried out by driving the impact tool 1. FIGS. 6A to 6D respectively illustrate cross sections of the A-A portion in FIG. 4 and cross sections of the B-B portion in FIG. 4 that are laterally arranged side by side, and in this case, the hammer 22 is driven by the motor 4. The hammer 22, the anvil 20, the carrier 33 and the respective members accompanying with them are rotation-symmetrically (double symmetry) set with one another, centered on the rotation axis, and for convenience of illustration, reference numerals are given only to some of the components. The carriers 33 sandwich the impact arm 21 of the anvil 20, and are also provided with protruding portions 34 so as to have predetermined gaps from the impact-subject surfaces 21*a* and 21*b* of the anvil 20 so that the pivotal angle of the carriers 33 is limited to a predetermined range.

Figure 6A:
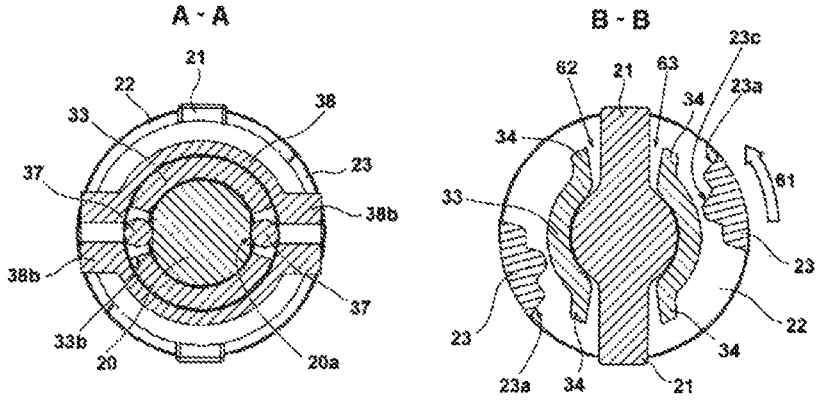
FIG. 6A is a diagram illustrating a state at the moment when a fastening job is carried out by driving the impact tool in accordance with the first embodiment of the present invention.

FIG. 6A illustrates a state in which the hammer claw 23 and the impact arm 21 are separated from each other, that is, for example, a state upon rotation start of the hammer 22. From the state of FIG. 6A, the rotation force of the motor 4 is transmitted to the spindle 28 via the reducer mechanism 10 illustrated in FIG. 1 so that the hammer 22, held by the cam mechanism, is allowed to rotate in a direction of an arrow 61. Here, the positional relationship between the position of the impact arm 21, that is, the rotation angle of the anvil 20, and the protruding portions 34 of the carriers 33 is as illustrated in the drawings.

Moreover, as illustrated in FIG. 2, the protruding portions 34, which are extended in the radial direction from the vicinities of the two side edges in the circumferential direction of the concave portion 33*a* of each carrier 33, are provided. The impact arm 21 and the protruding portions 34 are retained stably, with predetermined gaps 62 and 63 being prepared between the protruding portions 34 and the impact arm 21. As indicated by FIG. 6A, the shaft portion of the anvil 20, that is, the output shaft 18, is housed inside the cylinder portion of each carrier 33, and inside each of the inner spaces of the cut-out portions 33*b*, the engaging pin 37 is positioned. In this case, the carriers 33 and the anvil 20 are only fitted thereto, and by setting their shapes, they are designed to relatively rotate by only a fine angle.

Figure 6B:
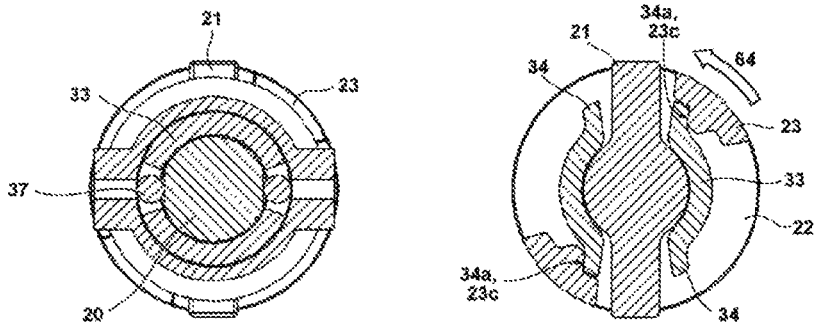
FIG. 6B is a diagram illustrating a state at the moment when the fastening job is carried out by driving the impact tool in accordance with the embodiments of the present invention.

FIG. 6B illustrates a state upon the rotation start of the carriers 33 in which the hammer 22 is further rotated in the direction of an arrow 64 so that the impact surfaces 23*c* of the hammer claws 23 are made in contact with the impact-subject surfaces 34*a* of the protruding portions 34. When the hammer 22 is rotated by driving the motor, the hammer 22 is made in contact with the carriers 33 prior to rotating to strike the anvil 20 so that the carriers 33 are allowed to rotate. For this reason, the shape of each of the hammer claws 23 is set such that, at the moment when the impact surface 23*c* is made in contact with each of the protruding portions 34, the impact surface 23*a* is not made in contact with the impact arm 21. When further rotated from this state, as illustrated in the view on the right side of FIG. 6C, the hammer claw 23 allows the impact surface 23*a* to be made in contact with the impact-subject surface 21*a* of the impact arm 21, while rotating the carriers 33 in a direction of an arrow 65.

That is, the anvil 20 is struck. As described with reference to the FIG. 5 above, there are gaps between the impact-subject surfaces 21*a* and 21*b* of the anvil 20 and the protruding portions 34. In other words, as indicated by a thick line in FIG. 6C, since there is a gap 67, the carriers 33 are prevented from impacting the impact arm 21. Moreover, at this time, the gap 66 is made larger than the gap 62 illustrated in FIG. 6A. In this manner, when each of the carriers 33 is rotated by a fine angle relative to the impact arm 21, as illustrated in the view on the left side of FIG. 6C, the edge portion is consequently made in contact with the outer circumferential portion of the engaging pin 37 in the circumferential direction of the cut-out portion 33*b* of each of the carriers 33, with the result that the engaging pin 37 is pushed to retreat to the vicinity of the center of the relief surface 20*a* formed on the circumferential surface of the anvil 20. The hammer 22 strikes the anvil 20 while rotating the carriers 33, and transmits the rotation to the tip axis side. The anvil 20 rotates with the inner circumferential side of the engaging pin 37 being made in contact with the relief surface 20*a*; however, the contact portion, that is, a line portion in parallel with the axis X, is maintained substantially in the center of the relief surface 20*a* in the circumferential direction.

Figure 6C:
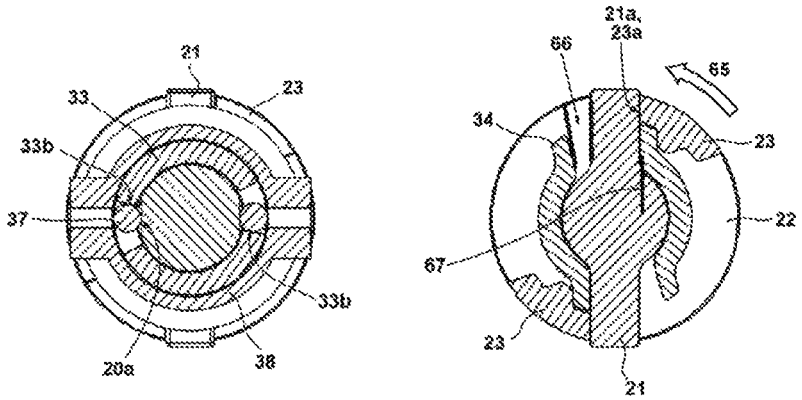
FIG. 6C is a diagram illustrating a state at the moment when the fastening job is carried out by driving the impact tool in accordance with the embodiments of the present invention.
Figure 6D:
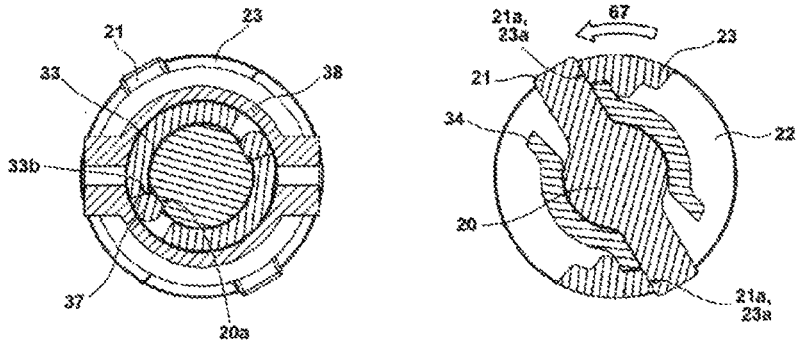
FIG. 6D is a diagram illustrating a state at the moment when the fastening job is carried out by driving the impact tool in accordance with the embodiments of the present invention.

FIG. 6D is a diagram illustrating a state in which from the state illustrated in FIG. 6C, the hammer 22 is further rotated. In this state, the impact surface 23*a* of the hammer claw 23 pushes or strongly strikes the impact-subject surface 21*a* of the impact arm 21 so that the anvil 20 is rotated. At this time, the engaging pin 37 is kept in contact with the edge portion of the cut-out portion 33*b* of each of the carriers 33. For this reason, the engaging pin 37 does not interfere with the inner surface of the lock ring 38. Moreover, the rotation components, that is, the anvil 20, the carriers 33 and the engaging pins 37, can be continuously rotated by the hammer 22, with the relative positional relationships being maintained. That is, it is possible to prevent the carriers 33 from vigorously rotating to cause each of the engaging pins 37 rolled by the carriers 33 to collide with the lock ring 38 and the end portion of the relief surface 20*a* of the anvil 20. Moreover, it is also possible to prevent the hammer 22 from falling into a gap between the anvil 20 and the carriers 33, and consequently to positively rotate the carriers 33 prior to the rotation of the anvil 20.

Figure 7A:
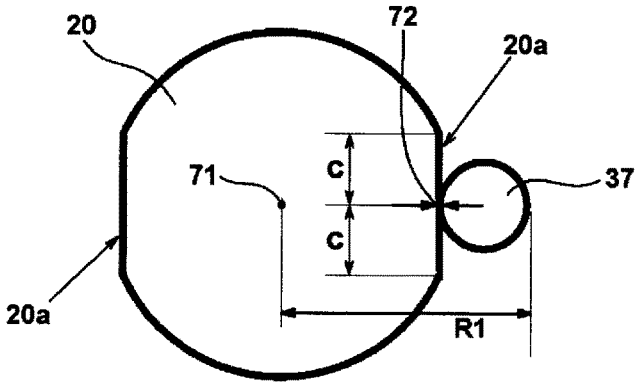
FIG. 7A is a diagram for explaining a positional relationship between the anvil and an engaging pin taken along an A-A cross-sectional position of FIG. 4.
Figure 7B:
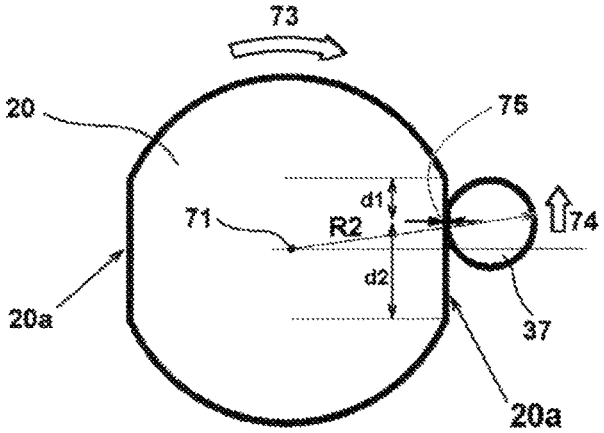
FIG. 7B is a diagram for explaining a positional relationship between the anvil and the engaging pin taken along the A-A cross-sectional position of FIG. 4.

FIGS. 7A and 7B are diagrams describing the positional relationship between the anvil 20 and the engaging pins 37 at the A-A cross-sectional position of FIG. 4. As illustrated in FIG. 6D, during the time when the hammer 22 is rotating, the impact surface 23*a* of the hammer claw 23 rotates the anvil 20 in such a manner as to push the impact-subject surface 21*a* of the impact arm 21 so that the positional relationship between the anvil 20 and the engaging pins 37 is maintained as illustrated in FIG. 7A. In this state, each of the engaging pins 37 is located substantially in the center in the vertical direction (circumferential direction) of the relief surface 20*a*. That is, supposing that the width in the vertical direction (circumferential direction) of the relief surface 20*a* is 2*c*, contact points 72 between the anvil 20 and the engaging pins 37 are located at a position with a distance "c" from the top and a position with a distance "c" from the bottom. In this state, the farthest distance from a rotation center 71 to the outer circumferential surface of the engaging pins 37 is represented by R1. R1 is represented as follows.

$R1$=(Radius of the anvil 20)−(Cut-out amount of the relief surface 20*a*)+(Diameter of the engaging pin 37)

In the present first embodiment, by setting R1 smaller than the inner diameter of the cylinder portion 38*d* of the lock ring 38, the engaging pins 37 are kept free from limiting the rotation of the anvil 20 and the carriers 33.

Figure 8A:
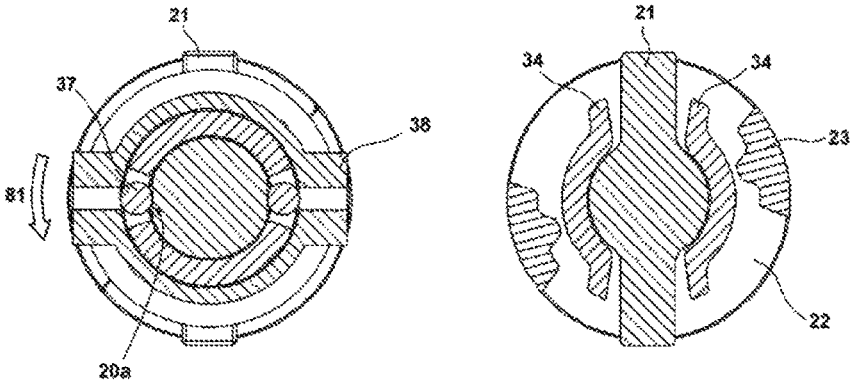
FIG. 8A is a diagram illustrating a state in which a manual fastening job is carried out at the moment when the impact tool in accordance with the embodiments of the present invention is stopped.
Figure 8B:
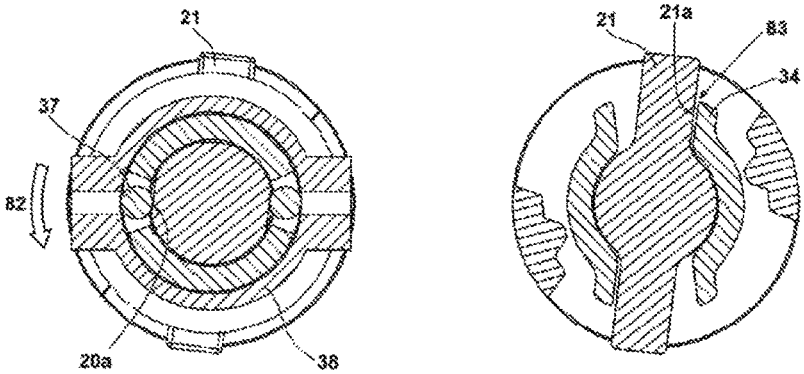
FIG. 8B is a diagram illustrating a state in which the manual fastening job is carried out at the moment when the impact tool in accordance with the embodiments of the present invention is stopped.
Figure 8C:
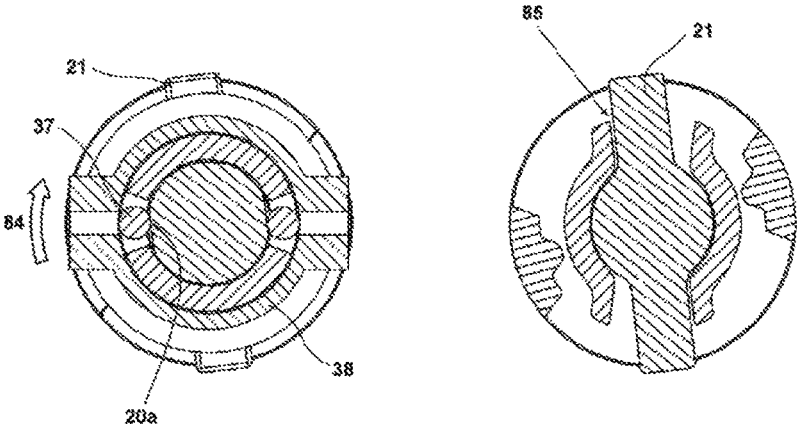
FIG. 8C is a diagram illustrating a state in which the manual fastening job is carried out at the moment when the impact tool in accordance with the embodiments of the present invention is stopped.

Next, with reference to FIGS. 8A to 8C, the following description will explain a state in which, after stopping the rotation of the motor 4, by rotating the impact tool 1 with the tip tool 48 being fitted to a screw head that is not illustrated, the worker manually fastens the screw or the like in the same manner as the screw driver, that is, a manual fastening job. FIG. 8A is a cross-sectional view illustrating a state immediately before rotating the impact tool 1 itself, that is, a neutral position. FIGS. 8A to 8C respectively illustrate cross sections of the A-A portion in FIG. 4 and cross sections of the B-B portion in FIG. 4 that are laterally arranged side by side. Additionally, when performing the manual fasting job, since no hammer 22 is used, the rotation position of the hammer 22 is not important, and the position of the hammer 22 illustrated in FIGS. 8A to 8C is only exemplary described, and does not particularly have a meaning. In FIG. 8A, the worker rotates the motor housing 2 so as to carry out a manual fastening job. By rotating the motor housing 2, the lock ring 38 is allowed to rotate in a direction of an arrow 81. As a result, at the A-A cross-sectional position, the impact arm 21 is brought into the same state as to be relatively rotated by a fine angle in a direction opposite to the direction of an arrow 81.

Next, when the worker further rotates the impact tool 1 as illustrated in FIG. 8B, the impact-subject surface 21*a* of the impact arm 21 abuts each of the protruding portions 34. As a result, the relative positional relationship between the carriers 33 and the anvil 20 is changed, and the relative positional relationship between the relief surfaces 20*a* formed on the anvil 20 and the engaging pins 71 is consequently changed. FIG. 7B shows a change in this relative positional relationship. In FIG. 7B, when the anvil 20 is relatively rotated as indicated by an arrow 73, the engaging pins 37 are brought into the same positional relationship as that in which the engaging pins are relatively moved in a direction of an arrow 74. However, only the anvil 20 side is moved while the engaging pins 37 are not moved. As a result, the position at which each of the engaging pins 37 and the relief surface 20*a* are made into contact with each other is moved from the contact point 72 of FIG. 7A to a contact point 75 of FIG. 7B. That is, the center position of the relief surface 20*a* is separated from each of the engaging pins 37. The center position of the relief surface 20*a* corresponds to the center in the circumferential direction of the anvil 20. As a result, the farthest distance from the rotation center 71 of the anvil 20 to the outer circumferential surface of each of the engaging pins 37 is changed from R1 to R2 of FIG. 7A. As can be understood from the drawings, with respect to R2, a positional relationship of R1<R2 is satisfied so that, by setting the size of the inner diameter Rc of the lock ring 38 so as to satisfy a relationship of R1<Rc<R2, each of the engaging pins 37 is allowed to intrude between the lock ring 38 and the end portion of the relief surface 20*a* of the anvil 20 by the change in the relative positional relationship of each of the engaging pins 37 as illustrated in FIG. 7B, and the lock ring 38 and the anvil 20 are formed into an integral unit and function as a locking mechanism for the output shaft. That is, in the case when the worker rotates the inactive impact tool 1, since the rotation of the anvil 20 is kept in a locked state, it is possible to effectively carry out a manual fastening job.

Note that, in addition to fastening a screw or the like by rotating the impact tool 1, upon carrying out a loosening process, the rotation of the anvil 20 is also locked. FIG. 8C shows this state, and the rotation of the anvil 20 is locked in the same manner, with only a deviation of the relative positional relationship between the relief surface 20*a* formed on the anvil 20 and the engaging pins 37 is caused in a rotation direction reversed to that of FIG. 8B. As described above, in the present first embodiment, when a manual fastening job is carried out by rotating the impact tool 1 after stopping the motor 4, the anvil 20 is locked to be unrotatable relative to the lock ring 38 by a function of the lock ring 38, so that an output shaft locking function is achieved. Thus, even in the case of a power tool for carrying out an impact fastening process, a manual fastening job can be easily carried out. Moreover, even in the case when jobs are shifted from the fastening job by using a driving source to the manual fastening job, no special operations, such as a pulling operation of a lever or the like by the worker, are required at all, and it is only necessary to simply rotate the impact tool 1, so that a power tool that is really convenient for use can be achieved.

In the case when, after completion of this manual fastening job, a fastening process for the next screw is carried out, the motor 4 is rotated by pulling the trigger 6. In this case, as illustrated in FIGS. 6A to 6C, since the hammer claw 23 pushes each of the protruding portions 34 of the carriers 33, the relative position of the engaging pins 37 to the anvil 20 is returned to the position of FIG. 7A and brought into a free state, that is, a lock-released state. For this reason, the same fastening job as existing ones can be carried out without giving any adverse effects to a normal fastening job by the use of the motor 4.

As described above, in accordance with the impact tool 1 of the present first embodiment, the anvil 20 and the output shaft 18 are produced as one integral structure, and simply by adding the carriers 33 and the engaging pins 37 to the structure, an output-shaft locking mechanism is achieved. Thus, it is possible to simplify the shape of the anvil 20 and also to efficiently transmit the impact energy of the hammer 22 to the tip tool 48. In particular, since the anvil 20 and the output shaft 18 are formed into a dividable structure, and since no joining structure is required, it is possible to remarkably reduce a collision sound and vibrations generated upon striking by the use of the hammer 22 as well as transmitting the rotation from the impact-subject surfaces 21*a* and 21*b* of the anvil 20 to the output shaft 18. Furthermore, since the impact tool 1 can be bent centered on the pivotal axis 8, it is possible to apply a high torque when a fastening job is carried out by rotating the main body.

Furthermore, the following description will explain a process in which, in order to carry out a fastening process by the motor 4, when the output shaft 18 is rotated in a tightening direction from a state in which the lock ring 38 and the output shaft 18 are fixed, that is, a process in which the output shaft 18 is rotated in a direction reversed to the manual tightening direction. In this case, when the hammer 22 is rotated so as to abut the carriers 33, the locked state between the housing 2*b* and the output shaft 18 is released. Therefore, no attempt is required for switching jobs between the manual fastening job by the use of the locking function of the output shaft 18 and the fastening job by the use of the motor 4. In this manner, in the present first embodiment, without the necessity of operating an output shaft lock switch or the like, by rotating the impact tool 1 main body in a tightening direction of a fastening member after completion of a fastening process and the motor is stopped, an additional tightening process of the fastening member and a confirmation of the fastened state can be carried out.

Embodiment 2

Figure 9:
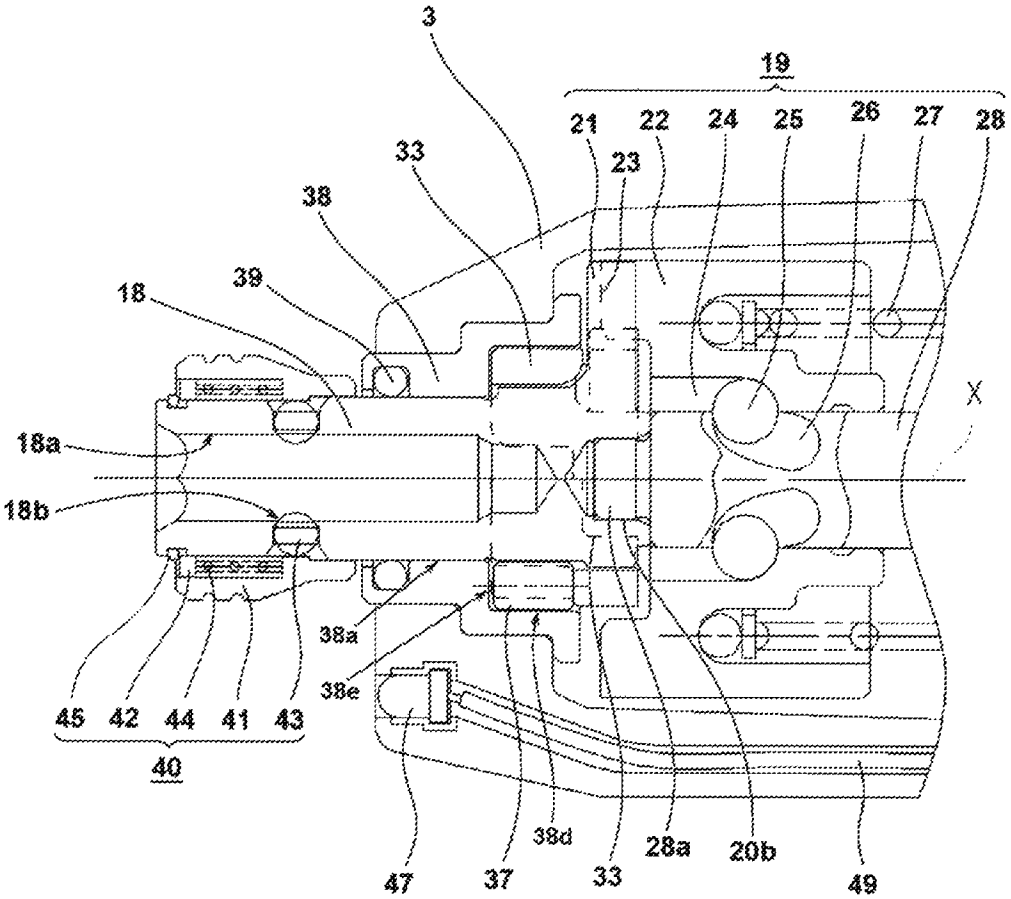
FIG. 9 is an expanded cross-sectional view illustrating a vicinity of an impact portion in accordance with a second embodiment of the present invention.

Next, with reference to FIG. 9, the following descriptions will explain a second embodiment of the present invention. The same components as those of the first embodiment are indicated by the same reference numerals, and since the structures and operations are the same, repetitive descriptions will be omitted. The second embodiment is different from the first embodiment in that a ball bearing 141 is used for pivotally supporting the output shaft 118 in place of metal members. Although in accordance with its shape, the shape of a lock ring 138 is also changed, the changed portion is limited to the vicinity of its tip, and the shape of a cylinder portion 138*d* for supporting the engaging pins 37 and the sizes and shapes of the screw boss portion and the screw holes, not illustrated, are the same as those of the lock ring 38 illustrated in FIG. 2. Moreover, the shape of the tip of a motor housing 102 is slightly changed so as to hold the ball bearing 141. Furthermore, the output shaft 118 is also designed such that a groove 118*c* that is continuously extended in the circumferential direction is formed so as to prevent the ball bearing 141 from coming off frontward in the axis X direction of the ball bearing 141, and a stop ring 142 is attached to the groove 118*c*. As indicated by the second embodiment, by pivotally supporting the output shaft 118 by using the ball bearing 141, an impact tool having high rigidity and being capable of rotating smoothly can be achieved.

According to the present invention, such a structure is provided in which, when the hammer is rotated, the first protruding portion is engaged with the lock releasing member prior to being engaged with the second protruding portion so as to release the lock of the locking mechanism, with a concave portion for use in receiving one portion of the lock releasing member being formed on the first protruding portion; therefore, when the hammer is rotated, first the lock of the locking mechanism is released to make the anvil rotatable. In the case when the concave portion for receiving the lock releasing member is provided on the second protruding portion on the anvil side, the rigidity of the anvil is lowered while it comes to the shaft portion located on the inner side in the radial direction from the second protruding portion; however, since the concave portion is provided to the first protruding portion on the hammer side, the lowering of the rigidity of the anvil can be suppressed, and the impact force of the hammer is consequently transmitted efficiently.

According to the present invention, since the carrier member that is capable of rotating relative to the anvil by a fine angle on the same axis is formed, since a relief surface in a plane shape is formed on one portion of the outer circumferential surface of the anvil, and since an engaging member for limiting the relative rotation between the anvil and the lock ring is provided to the cut-out portion of the carrier member, it is possible to achieve the locking mechanism for the output shaft by the simple structure. Moreover, the output shaft locking mechanism can be achieved without changing the basic structure of existing anvil and output shaft so much, so that the torque can be efficiently transmitted to the tip tool. Moreover, in the case when an additional tightening job is carried out manually after the fastening operation by using a power tool, the job can be carried out by using the power tool.

According to the present invention, since the engaging members, each prepared as a column-shaped member, are respectively arranged to the cut-out portions one by one, with the center line of each engaging member being arranged in parallel with the axis X of the output shaft, it is possible to ensure the engaging region to have a comparatively large size and consequently to firmly lock the rotation of the anvil relative to the housing.

According to the present invention, in the case when the anvil is rotated relative to the housing during the stoppage of the hammer rotation, since the relative rotation between the anvil and the lock ring is limited, no special operations for locking the output shaft are required so that it is possible to provide a power tool having high operability and high reliability without causing erroneous operations.

According to the present invention, when the relative rotation angle between the carrier member and the anvil becomes greater than a predetermined angle so that the center position of the relief surface is separated from the engaging member, a locked state is exerted; therefore, the worker is allowed to lock the output shaft easily by simply rotating the housing main body slightly, with the tip tool being pressed onto a member to be tightened.

According to the present invention, during the rotation of the driving unit, since the engaging member is held so as to be positioned in the center of the relief surface by allowing the engaging member to be in contact with the carrier member to be shifted, it is possible to bring the housing and the output shaft to a free idle rotating state, and consequently to carry out a normal fastening job by using the driving source without causing any problems.

According to the present invention, since the protruding portion has a shape protruding in the radial direction from the edge in the circumferential direction of the second cut-out portion, the carrier member can be easily rotated relative to the anvil by utilizing the hammer impact surface, and since it is not necessary to extend the distance between the anvil and the lock ring so as to dispose the carrier member, an output shaft locking mechanism can be achieved without causing a lowering in assembling efficiency.

According to the present invention, since the hammer is provided with a first impact surface for use in striking the anvil and a second impact surface that is made in contact with the carrier member, by simply changing the shape of the claw portion of the hammer, it is possible to strike the two members, that is, the anvil and the carrier member.

According to the present invention, when the hammer is rotated, the second impact surface first abuts the carrier member, and the first impact surface next abuts the anvil: therefore, the carrier member can be shifted immediately before the anvil is struck by the hammer so that it is possible to positively release the locked state of the output shaft.

In the foregoing, the present invention has been described based upon the second embodiment. However, the present invention is not limited to the embodiment, and various modifications may be made thereto without departing from the gist of the invention. For example, the second embodiment has been described with exemplifying an impact tool of a mechanical system as a power tool; however, the present invention can be applied to an impact tool of an oil pulse system in the same manner. Moreover, not limited only to the impact tool, the present invention can be applied to a driver drill in the same manner.

Embodiment 3

Figure 10:
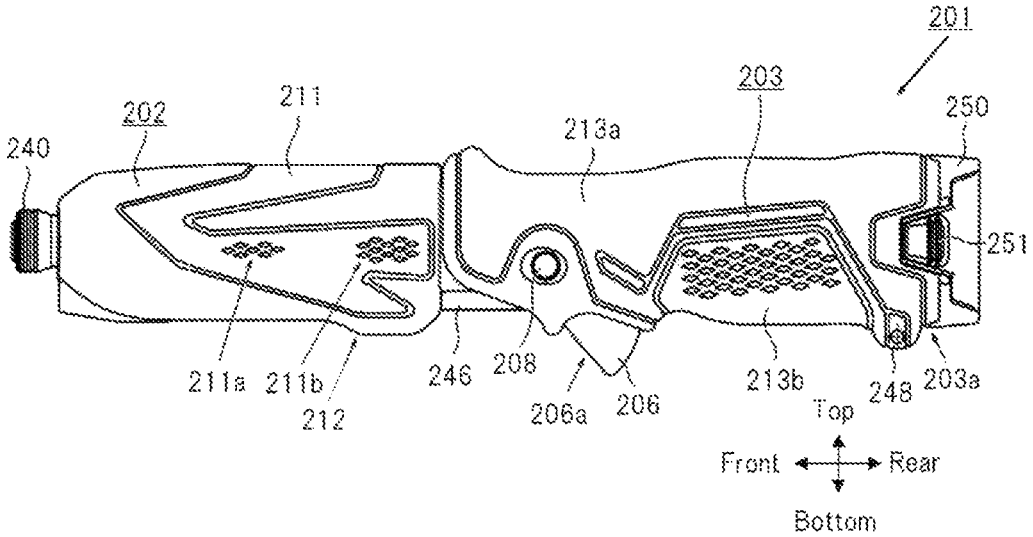
FIG. 10 is a side view illustrating an appearance of the impact tool when straightened in accordance with a third embodiment of the present invention.
Figure 12:
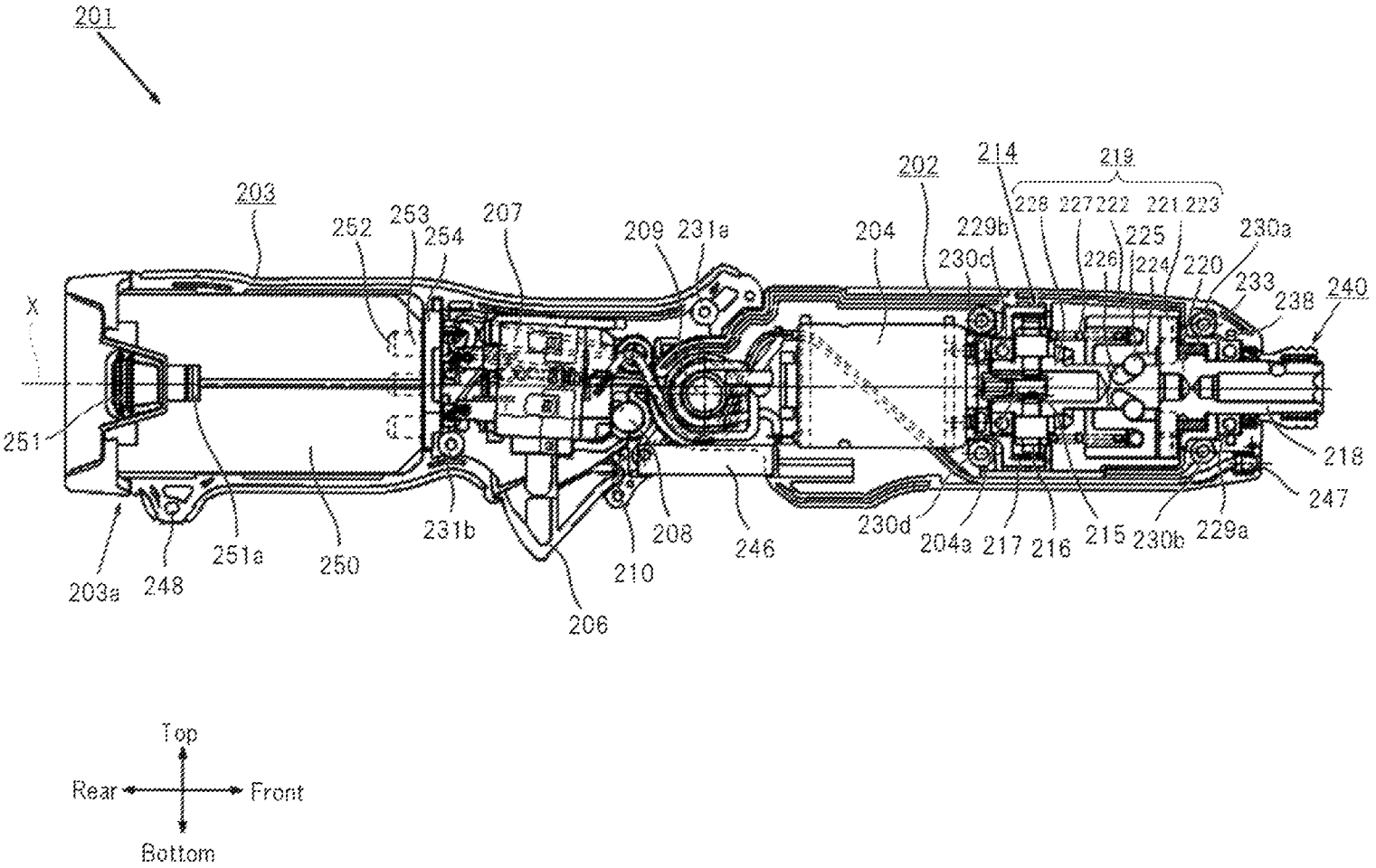
FIG. 12 is a diagram illustrating an inner structure of the impact tool of FIG. 10, and also a longitudinal cross-sectional view illustrating a front side from a motor and a trigger portion.

With reference to the drawings, the following descriptions will explain a third embodiment of the present invention. Additionally, in the following drawings, the same portions are indicated by the same reference numerals, and repetitive descriptions will be omitted. In the present specification, explanations will be given on the premise that longitudinal directions and lateral directions correspond to directions indicated in the drawings. FIG. 10 is a cross-sectional view illustrating the entire portion of an impact tool 201 that is one example of a power tool according to the third embodiment of the present invention. As illustrated in FIG. 12, the impact tool 201 includes a motor 204, a reducer mechanism 214, an anvil 220, an output shaft 218, a hammer 222, a spindle 228, a bearing 229*a*, a lock ring 238 and a mounting portion 240, which are disposed in a concentric manner centered on an axis X. The output shaft 218 is supported by the bearing 229*a* so as to freely pivot thereon. In a direction along the axis X, between the mounting portion 240 and the motor 204, the reducer mechanism 214, the anvil 220, the output shaft 218, the hammer 222, the spindle 228, the lock ring 238 and the bearing 229*a* are disposed. In the direction along the axis X, the bearing 229*a* is disposed between the mounting portion 240 and the lock ring 238.

The impact tool 201 utilizes, as a power supply, a battery pack 250 that is chargeable and detachably attached, and uses the motor 204 serving as a driving source so as to apply a rotating force and an impact force to the output shaft via a power transmitting mechanism so that the rotating force and the impact force are transmitted to a tip tool such as a driver bit that is held in a mounting hole covered with the mounting portion 240 so that a job such as a screw fastening or bolt fastening process is carried out. The housing of the impact tool 201 is composed of a main housing (front housing) 202 and a handle housing (rear housing) 203. The main housing 202 is formed by an integral molding process of a polymeric resin such as a plastic material and composed of laterally dividable two units, and the right and left units are fixed by using screws, not illustrated. The handle housing 203 is formed into a substantially cylindrical shape or cylinder shape having an opening 203*a* on its rear end, and produced by an integral molding process of a polymeric resin such as a plastic material and manufactured as a laterally dividable unit. The main housing 202 and the handle housing 203 are coupled to each other in a vicinity of the center portions in the front to rear direction by a pivotal mechanism having a pivotal shaft, not illustrated, and allowed to pivot by about 70 degrees centered on the pivotal shaft. This plane on which the pivotal movements are made corresponds to a plane (the same plane as the plane of the paper) including the frontward and rearward directions as well as upward and downward directions when viewed in FIG. 10. Thus, as illustrated in FIG. 10, the main housing 202 and the handle housing 203 are changed from a so-called straight-type shape in which they are disposed side by side on the same axis to a so-called gun-type shape in which, as illustrated in the FIGS. 11 and 12, they are pivoted centered on the pivotal shaft 209. The worker can set them in either the straight-type or the gun-type depending on a working site and a working object so as to carry out the job.

The impact tool 201 of the present third embodiment, which is a power tool using a known impact mechanism as a power transmitting mechanism, may be achieved as a so-called driver drill, and other power tools of a cordless system, for example, an electrical power tool and a tightening tool. The motor 204 is housed inside the main housing 202, and its rotation shaft is connected to a power transmitting mechanism for use in rotating the tip tool. The battery pack 250, which is provided with a case having a substantially cylindrical shape that is attached and detached to and from the inner space of the handle housing 203 through the opening 203*a* at the end of the handle housing 203, is formed in a so-called cassette style serving as a power supply that can be easily exchanged. Two latch portions 251*a* are formed to the case of the battery pack 250, and they are engaged with concave portions (not illustrated) formed on an inner wall of the handle housing 203 so that the battery pack 250 is held. In order to detach the battery pack 250, the battery pack 250 is pulled out rearward through the opening 203*a*, while pressing latch portions 251 formed on right and left two positions. The shape of the rear end of the battery pack 250 is formed so as to cover the opening 203*a* of the handle housing 203, with the rear face of the battery pack 250 forming one portion of the outer edge of the handle housing 203. Inside the battery pack 250, a plurality of lithium ion cells are housed, and the sizes, the number, and the like of the batteries may be optionally set.

Inside the handle housing 203 corresponding to a space of a portion adjacent to the pivotal mechanism, a trigger 206 for operating a switch (main switch) for controlling supply/stop of electric power to the motor 204 and a forward/reverse switching lever 208 for switching the rotation directions of the motor 204 are housed. In the present third embodiment, as the main switch, a so-called variable resistance switch in which, in accordance with the pulling amount of the trigger 206, its resistance value is changed, is used so that the number of revolutions of the motor 204 is changed in accordance with the amount of operation of the trigger 206. The trigger 206 has a finger cushion portion 206*a* having a width wide enough for one finger to be put thereon, and is designed such that, by allowing the front side to rock (pivot) centered on the shaft point (rocking axis to be described later) by a predetermined angle, the rear end of the trigger 206 is allowed to rock in a substantially longitudinal direction. The forward/reverse switching lever 208 is provided substantially above the pivotal axis of the trigger 206. The forward/reverse switching lever 208 is a changeover switch for switching the rotation direction of the motor 204 between "a forward rotation direction (tightening direction)" and "a reverse rotation direction (loosening direction)", and the switch is operated by sliding the lever laterally.

The handle housing 203 is used as a grip portion grabbed mainly by the worker, and is designed to have such a shape as to fit the hand of the worker when grabbed by the worker, and elastic members 213*a* and 213*b* are formed on the upper and lower sides of the handle housing 203. Additionally, in the present specification, in the case when directions of the handle housing 203 are referred to, the directions are indicated based upon a state in which the impact tool 201 is put in the straight state, as illustrated in FIG. 10, unless otherwise specified. The elastic members 213*a* and 213*b* are formed by using a constituent material of the handle housing 203, for example, a constituent material having elasticity higher than that of plastic materials, and prepared as a thin surface layer on the lower layer forming the constituent member of the handle housing 203 with a resin having high elasticity, by using, for example, a two-layer molding technique. In the vicinity of the opening 203*a* on the lower side of the handle housing 203, a hook hole 248 through which a string or the like for use in hanging is inserted is formed.

The main housing 202 is sometimes grabbed by the worker in an assisting manner, and for this reason, an elastic member 211 is also formed on the surface on the main housing 202 side. The elastic member 211 is formed by using a constituent material of the main housing 202, for example, a constituent material having elasticity higher than that of plastic materials, and prepared as a thin surface layer on the lower layer forming the constituent member of the main housing 202 with a resin having high elasticity, by using, for example, a two-layer molding technique. Moreover, by devising a shape of specific areas of the elastic member 211, slip preventive portions 211*a* and 211*b* are partially formed so as to allow the worker to easily exert a force onto the main housing 202 through the grabbing fingers when it is grabbed by the worker. The slip preventive portions 211*a* and 211*b* are formed, for example, as a plurality of small concave portions formed on the elastic member 211. Since the purpose of the slip preventive portions 211*a* and 211*b* is to prevent the hand from slipping, the slip preventive portions 211*a* and 211*b* may be formed not only as the concave portions, but also as convex portions, grooves, steps, or the like. A cover 246 is disposed on a lower side of the pivotal center at which the main housing 202 and the handle housing 203 are bent from each other. The lower side refers to a space having a narrower angle that is formed between the main housing 202 and the handle housing 203. The cover 246 is a plate-shaped member and serves as an outer frame member that shields a space in a vicinity of the pivotal mechanism portion between the main housing 202 and the handle housing 203, in the case when the impact tool 201 is used in a mode as illustrated in FIG. 10, that is, in the straight state.

Figure 11:
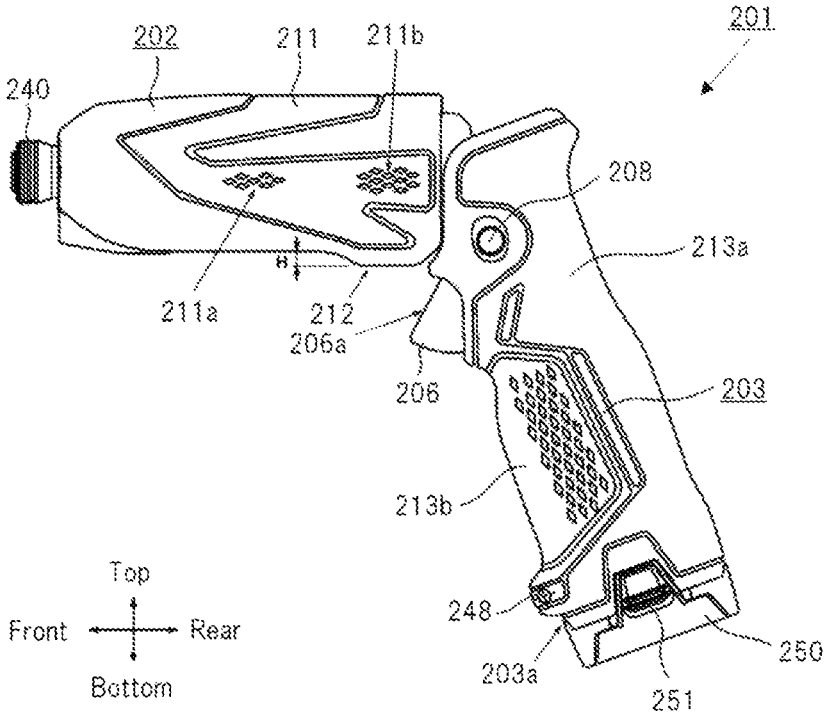
FIG. 11 is a side view illustrating an appearance of the impact tool when bent in accordance with the embodiment of the present invention.

FIG. 11 is a side view illustrating an operation state when the impact tool 201 is in a bent state illustrated in FIG. 10. In the bent state, the main housing 202 and the handle housing 203 are disposed with a crossing angle of about 70 degrees so as to have a so-called gun type form (pistol shape). A protruding portion 212 that protrudes by a distance of "H" is formed on the lower side of the main housing 202 so that, by the protruding portion 212, the finger of the worker, for example, the index finger, is naturally directed to the center of the finger cushion portion 206*a* of the trigger 206. Since the trigger 206 is easily operated by a pulling action of the index finger of the worker, it is possible to easily carry out a variable-speed driving operation of the motor 204.

FIG. 12 is a diagram illustrating an inner structure of the impact tool 201. The impact tool 201 utilizes electric power supplied from the battery pack 250, and rotates the motor 204 serving as a driving source. The battery pack 250 has a so-called cassette structure, and is capable of being attached and detached to and from the inner space through the opening 203*a* at the end portion of the handle housing 203. The two latch portions 251*a* are formed on the battery pack 250, and they are engaged with concave portions (not illustrated) formed on an inner wall of the handle housing 203. Three lithium ion battery cells (not illustrated) are housed inside the battery pack 250, and its rated voltage is set to a DC voltage of 10.8 V. On the other end of the mounting space of the battery pack 250 that is connected to the opening 203*a*, a substrate 254 is formed, and a plurality of terminals 253 are installed in a manner so as to extend from the substrate 254 toward the opening 203*a*. On the front end portion (upper side in the drawing) of the battery pack 250, a plurality of terminals 252 are provided, and the terminals 252 are made in contact with the terminals 253 formed on the substrate 254 side by attaching the battery pack 250 to the handle housing 203.

The rotation of the motor 204 is decelerated by a reducer mechanism 14, and transmitted to an impact mechanism 219. In the present embodiment, the reducer mechanism 214 and the impact mechanism 219 constitute a power transmitting mechanism so that the rotation force of the motor 204 is transmitted to the spindle 228. The main housing 202 and the handle housing 203 are allowed to pivot by about 70 degrees centered on a pivot shaft 209, and FIG. 12 illustrates a state in which they are brought into a straight shape. The main housing 202 is formed by a molding process of a synthesized resin, such as plastics, so as to be divided into two right and left elements, and the right and left elements are fixed by using screws not illustrated. For this reason, a plurality of screw bosses 230*a* to 230*d* are formed to one of the elements forming the main housing 202, and on the other element, a plurality of screw holes are formed. In the same manner, a plurality of screw bosses 231*a* and 231*b* are formed to the handle housing 203. Note that, in the power tool of the present third embodiment, the impact mechanism 219 and the reducer mechanism 214 are directly housed in the main housing 202 made of a synthesized resin; however, they may be housed in a substantially cup-shaped case (hammer case) made of a metal, and formed by an integral molding process, and the case may be housed in or connected to the main housing 202.

A trigger switch 207 allows the worker to pull a trigger 206 so that the On-state or Off-state is exerted, and the trigger 206 is rocked centered on a rocking axis 210 formed on the front side. The trigger switch 207 has a rotary changeover switch mechanism, and by operating the forward/reverse switching lever 208, it is possible to switch the rotation direction of the output shaft 218 in a forward direction (tightening direction) or a reverse direction (loosening direction). Note that, the trigger switch 207 is prepared as a variable switch for adjusting the number of revolutions of the motor 204 in accordance with a pulling amount of the trigger 206; however, this may be prepared as a simple ON/OFF switch. Below the mounting portion 240, an LED 247 for illuminating the front portion including the member to be tightened is installed.

The reducer mechanism 214 is provided with a plurality of planetary gears 216 through which the rotation shaft 204*a* of the motor 204 is connected to a sun gear 215, and the plurality of planetary gears 216 are engaged with inner gears 217 located on the outer circumferential side so that the plurality of planetary gears 216 can revolve around the sun gear 215 while rotating. The spindle 228 is a member for use in rotating the hammer 222, and the rear end side of the spindle 228 supports the plurality of planetary gears 216 so as to rotate thereon. That is, the spindle 228 functions as a carrier. That is, the revolving force of the planetary gears 216 forms the rotating force of the spindle 228. The spindle 228 is coupled to the hammer 222 serving as a driving member by a cam mechanism, and this cam mechanism is composed of a V-shaped cam groove 226 formed on the outer circumferential surface of the spindle 228, a cam groove 224 formed on the inner circumferential surface of the hammer 222 and steel balls 225 that are engaged with the cam groove 224.

The hammer 222 is always being energized by a spring 227 in an approaching direction to the bearing 229*a*. When the hammer 222 is kept in a stationary state, the hammer 222 is positioned with a gap from the end face of the impact arm 221 by the engagements between the steal balls 225 and the cam grooves 224 and 226. Moreover, at two portions on rotation planes which are mutually opposed to each other of the hammer 222 and the anvil 220, a hammer claw 223 serving as a protruding portion and the impact arm 221 are formed symmetrically with each other. When the spindle 228 is driven to rotate, the rotating force is transmitted to the hammer 222 via the cam mechanism, and before the hammer 222 has made a half rotation, the hammer claw 223 of the hammer 222 is engaged with the impact arm 221 of the anvil 220 so that the anvil 220 is rotated, and at this time, when a relative rotation is generated between the spindle 228 and the hammer 222 by an engaging repulsive force, the hammer 222 starts to retreat toward the motor 204 side along the cam groove 226 of the cam mechanism, while compressing the spring 227.

When the hammer claw 223 gets over the impact arm 221 by the retreating movement of the hammer 222, with the result that the engaged state of the two members is released, the hammer 222 is shifted forward by the energizing force of the spring 227 while being rapidly accelerated in the rotation direction by elastic energy accumulated in the spring 227 and the action of the cam mechanism, together with the rotation force of the spindle 228, so that the anvil 220 is rotated by allowing the hammer claw 223 to strongly strike the impact arm 221. In this manner, the anvil 220 is continuously or intermittently rotated by the hammer 222. The output shaft 218 is connected to the front side of the anvil 220 so that via a tip tool (not illustrated) attached to a mounting hole of the output shaft 218, a rotary impact force is transmitted to a screw. Thereafter, the same rotating and impacting operations are repeated, and, for example, a fastening member, such as a screw, is screwed into a member to be fastened, not illustrated, such as a lumber or the like. Note that, in the present third embodiment, since the output shaft 218 and the anvil 220 are produced by an integral molding process, no rattling is caused between these members so that it is possible to achieve an impact tool having superior rigidity and being quiet in impact sound.

Figure 13:
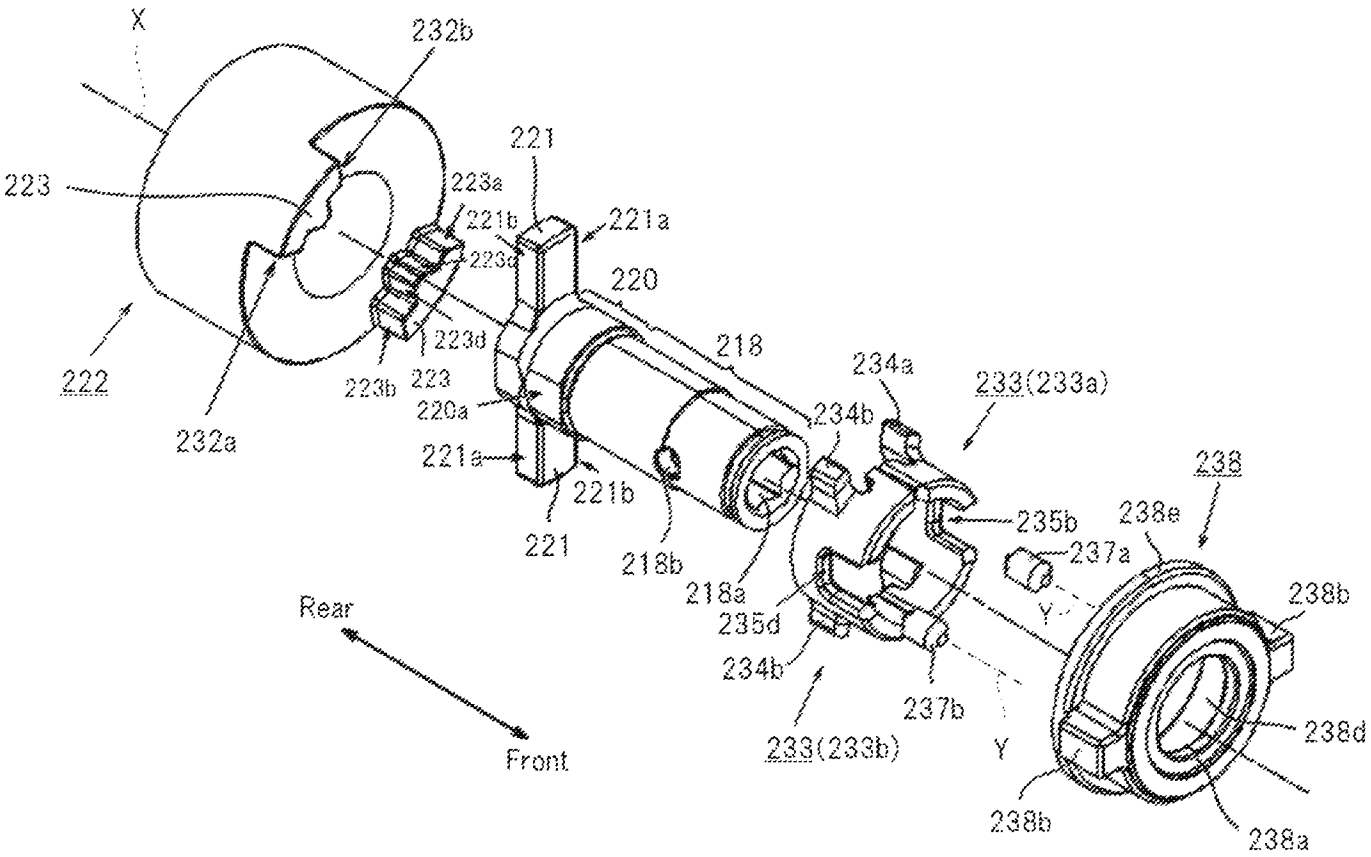
FIG. 13 is an exploded perspective view illustrating a vicinity of the impact portion of FIG. 10.

FIG. 13 is an exploded perspective view illustrating an assembly structure in a vicinity of an impact portion of FIG. 12. In the present third embodiment, the fixing structure of the lock ring 238 holding a carrier 233 to be attached to the output shaft 18 is improved. The carrier 233 located on the inner circumferential side of the lock ring 238 is composed of two right and left independent members 233*a* and 233*b*. The member 233*a* is a first carrier member and the member 233*b* is a second carrier member. In the anvil 220, two impact arms 221 that extend in radial directions of a circle centered on the axis X are formed, and the anvil 220 and the output shaft 218 are integrally formed. The locking mechanism is a mechanism for use in locking the relative rotation of the anvil 220 to the main housing 202, more specifically, to the lock ring 238. The locking mechanism mainly includes a relief surface 220*a* formed on one portion of the anvil 220, the carrier 233, the lock ring 238 and two engaging pins 237*a* and 237*b*. The two engaging pins 237*a* and 237*b* are formed as independent members. Both of the engaging pins 237*a* and 237*b* have a column shape, and the center lines Y of the engaging pins 237*a* and 237*b* are in parallel with the axis X. The engaging pin 237*a* is a first engaging member, and the engaging pin 237*b* is a second engaging member. The carrier 233 is used for a lock releasing member for releasing the locked state of the locking mechanism, and composed of the two members 233*a* and 233*b* that are divided into two pieces in the circumferential direction centered on the axis X. The two members 233*a* and 233*b* have the same shape, and more specifically are line-symmetrical to each other. The hammer 222 is produced by an integral molding process of a metal so as to have a predetermined mass, and is coupled to the spindle 228 by a cam mechanism. On the front side of the hammer 222, hammer claws 223 (first protruding portions) are formed at two portions in the circumferential direction. The hammer claws 223, which are protruding portions to form first impact surfaces for use in striking the impact arm 221, protrude toward the output shaft 218 side, and each of them has an impact surface 223*a* in a forward rotation direction and an impact surface 223*b* in a reverse rotation direction, which are formed on two side faces in the circumferential direction, respectively. In the present specification, descriptions will be given on the premise that the forward rotation direction corresponds to a direction in which, for example, a screw or a bolt is tightened, and the reverse rotation direction corresponds to a direction in which a screw or a bolt is loosened. Each hammer claw 223 of the present third embodiment is further provided with an impact surface 223*c* that is a second impact surface formed on the inner circumferential side of the impact surface 223*a*, and in the same manner, on the inner circumferential side of the impact surface 223*b*, an impact surface 223*d* is formed. This second impact surface 223*c* has a concave shape with respect to the circumferential impact direction relative to the first impact surface. In this case, each hammer claw 223 may have not only the shape protruding in the axial direction relative to the hammer 222, but also a shape protruding in a radial direction, or a shape protruding in an axial direction as well as in a radial direction.

The anvil 220 is a member to be struck by the hammer 222, and has a shape in which the output shaft 218 is connected to the tip side of the anvil 220, and they are produced in an integral molding process. Two impact arms 221 (second protruding portions) that extend in radial directions from the main body member having a cylindrical shape are formed on the anvil 220. The impact arms 221 are formed at positions opposed to each other by 180 degrees in the rotation angle in a manner so as to extend outward in the radial direction and also to be engaged with the first protruding portions of the hammer claws 223. Based upon its nature of being a member to be struck, each impact arm 221 is formed into a rectangular pillar shape in its shape extending from the anvil 220; however, not limited to this shape, the shape may be a column-shaped basic shape, or another simple shape, as long as sufficient strength and durability are ensured. It is important for each impact arm 221 to have two impact-subject surfaces having a plane shape or a shape in association with the impact surface formed thereon, and in the circumferential direction, one side face of the impact arm 221 forms an impact-subject surface 221*a* in the forward direction, and in the circumferential direction, the other side face forms an impact-subject surface 221*b* in the reverse direction. At two portions departed from each other by 180 degrees of the main body portion of the anvil 220, the relief surfaces 220*a*, each having one portion cut out into a plane, are formed.

In the periphery of the anvil 220 and the output shaft 218, the lock ring 238 is disposed. A main function of the lock ring 238 is to rotatably support the carrier 233. The output shaft 218 is supported by the bearing 229*a* installed in a vicinity of the lock ring 238. At two portions departed from each other by 180 degrees in the radial direction of the lock ring 238, protruding portions 238*b*, each having substantially a cubic shape, that are fitted to grooves formed on the inner wall of the main housing 202 are formed. The protruding portions 238*b* are convex portions formed at the two portions departed from each other by 180 degrees in the circumferential direction of the lock ring 238, and by fitting these convex portions into the concave portions formed on the inner circumferential surface of the main housing 202, the lock ring 238 is fixed onto the main housing 202. In this case, the convex portions, formed in the circumferential direction on the lock ring 238, are not limited by this structure, and may have a structure in which concave portions are formed on the lock ring 238 side, with convex portions being formed on the inner wall side of the main housing 202, or a structure having concave-convex portions in which concave and convex portions are optionally used, or may be formed as another known holding structure or rotation-stopping structure.

The carrier 233 functions as a lock releasing member, and has a structure in which, after joining two members 233*a* and 233*b*, a substantially cylindrical shape is formed; however, in the present third embodiment, one carrier 233 is composed of two members 233*a* and 233*b* formed by dividing a cylindrical member into two portions along a plane including the axial direction. The carrier 233 is disposed coaxially relative to the anvil 220, as well as on the outside of the anvil 220 in the radial direction. The carrier 233 is not fixed onto the anvil 220, but attached to the anvil 220 so as to be relatively shiftable (rotatable) by a fine angle, coaxially relative to the anvil 220. The carrier 233 has a cylinder portion having an inner diameter that is substantially equal to the outer diameter of the cylindrical portion of the anvil 220. In this case, a gap is maintained in such an extent required for allowing the carrier 233 and the anvil 220 to relatively rotate. At two positions on the rear portion of the cylinder portion, concave portions (second cut-out portions) are formed, and protruding portions 234*a* and 234*b*, which protrude in radial directions from two edges in the circumferential direction (two ends) of each concave portion, are also formed. The gap between the opposing protruding portion 234*a* and protruding portion 234*b* is designed to be slightly wider than the width in the radial direction of the impact arm 221. In the present embodiment, since the two impact arms 221 are formed outward from the positions departed from the column-shaped pillar portion of the anvil 220 by 180 degrees, the protruding portions 234*a* and 234*b* are formed at four positions in total, that is, the positions opposed to the respective impact-subject surfaces 221*a* and 221*b*.

The protruding portions 234*a* and 234*b*, which are made in contact with the impact surfaces 223*c* and 223*d* newly added to the hammer 222, are allowed to rotate relative to the anvil 220 of the carrier 233, by being struck by the impact surfaces 223*c* and 223*d*. In the radial direction centered on the axis X, the layout positions of the impact surfaces 223*c* and 223*d* and the layout positions of the protruding portions 234*a* and 234*b* are overlapped with each other. However, the angle at which the carrier 233 and the anvil 220 are relatively rotated is about −10 or +10 degrees. At a position of the carrier 233 opposed to the relief surface 220*a*, each of cut-out portions 235*b* and 235*d* serving as the first cut-out portions is formed. The cut-out portions 235*b* and 235*d* form spaces that house the first and second engaging members, that is, the engaging pins 237*a* and 237*b*. The inner circumferential side of each of the cut-out portions 235*b* and 235*d* is covered with the relief surface 220*a* of the anvil 220, and the outer circumferential side of each of the cut-out portions 235*b* and 235*d* is covered with the cylinder portion 238*d* of the lock ring 238. Moreover, a portion near the bearing 229*a* of each of the cut-out portions 235*b* and 235*d* is covered with a circular ring portion 238*a* of the lock ring 238. In this manner, the engaging pins 237*a* and 237*b* are disposed in the spaces defined by using the cut-out portions 235*b* and 235*d*, and are allowed to revolve in a manner so as to follow the rotation of the anvil 220. When the relative position between the anvil 220 and the carrier 233 deviates in a radial direction upon the stoppage of the motor 204, the engaging pins 237*a* and 237*b* function as a locking mechanism for limiting the relative rotation between the anvil 220 and the lock ring 238, and this locking function will be described later in detail.

Figure 14:
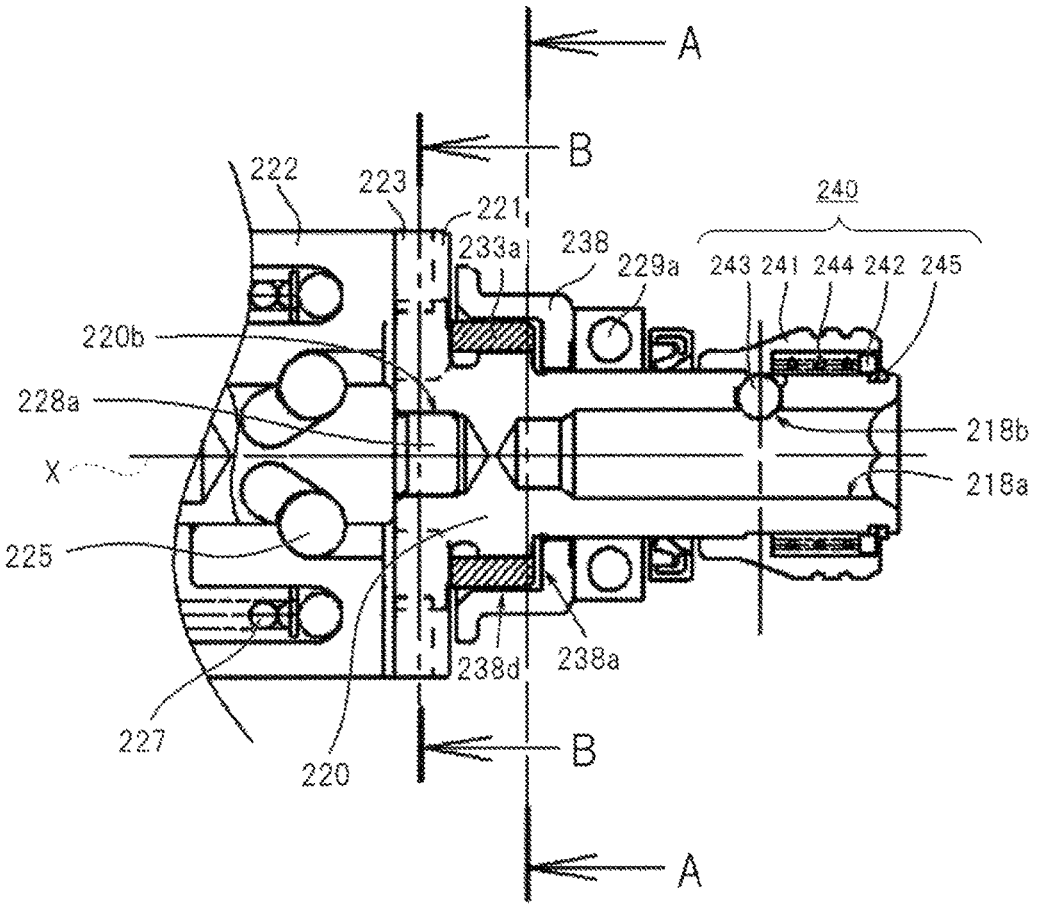
FIG. 14 is an enlarged partial cross-sectional view illustrating a mounting structure in a vicinity of a lock ring of FIG. 12.

FIG. 14 is an enlarged partial cross-sectional view illustrating the vicinity of the lock ring 238 of FIG. 12. The two members 233*a* and 233*b* forming the carrier 233 are disposed on the front side of the hammer 222 so as to make their rear ends disposed substantially the same position as that of the impact arm 221. The tip of the carrier 233 has its front end side limited by the circular ring portion 238*a* of the lock ring 238, and its outer circumferential side is held by the cylinder portion 238*d*, with its inner circumferential side being held by the outer circumferential surface of the anvil 220. In the vicinity of the center on the rear end side of the anvil 220, a fitting hole 220*b* having a column shape is formed, and in this hole 220*b*, a fitting axis 228*a* formed on the tip of the spindle 228 is housed. In this manner, since the rear end of the anvil 220 and the front end of the spindle 228 are pivotally supported so as to be relatively rotatable, it becomes possible to achieve the impact mechanism 219 having high rigidity. The lock ring 238 has a structure in which the circular ring portion 238*a* is formed on the inside of the front side of the cylinder portion 238*d*. On the rear side of the cylinder portion 238*d*, a circular ring portion 238*e* is formed on the outside to be formed into flange shape. Although the lock ring 238 is fixed so as not to rotate relative to the main housing 202, the engaging pins 237*a* and 237*b* are allowed to revolve centered on the axis X together with the anvil 220, as illustrated in FIG. 13. A fine contact region (convex portion or the like) is preferably formed on the tip of each of the engaging pins 237*a* and 237*b* in the axial direction so as to prevent the frictional resistance relative to the two members 233*a* and 233*b* from becoming too high. Note that, in the vicinity of the circular ring portion 238*a* of the lock ring 238, an O-ring, not illustrated, may be attached so as to prevent grease from leaking from the impact mechanism portion.

On the inner side of the tip of the output shaft 218, a mounting hole 218*a* having a hexagonal shape in its cross section, to which a tip tool is inserted, is formed vertically to the axial direction, with a mounting portion 240 for the tip tool being formed on the outer circumferential side of the tip. On the side face of the output shaft 218, a through hole 218*b* that houses balls 243 so as to be movable therein is formed, and it is formed in such a shape as to prevent the balls 243 from coming off and falling on the inner circumferential side from the through hole 218*b*. The outside in the radial direction of the balls 243 is held by a sleeve 241 that is energized by a spring 244. The front side of the spring 244 is fixed by a washer 242, and the washer 242 is held by a C-ring 245 so as not to move in the axial direction. Upon attaching or detaching a tip tool to or from the output shaft 218, the sleeve 241 is moved frontward in the axial direction from the normal position illustrated in FIG. 14 against the pressing force of the spring 244, so that the attaching or detaching operation is carried out. When the sleeve 241 is moved frontward, the outer circumferential portion of each of the balls 243 is released from an abutting state with a convex surface that is formed on the inner circumferential side of the sleeve 241 and continues in the circumferential direction, with the result that the balls 243 become movable outward in the radial direction. Thus, it is possible to carry out the attaching and detaching processes of the tip tool without any resistance.

Figure 15:
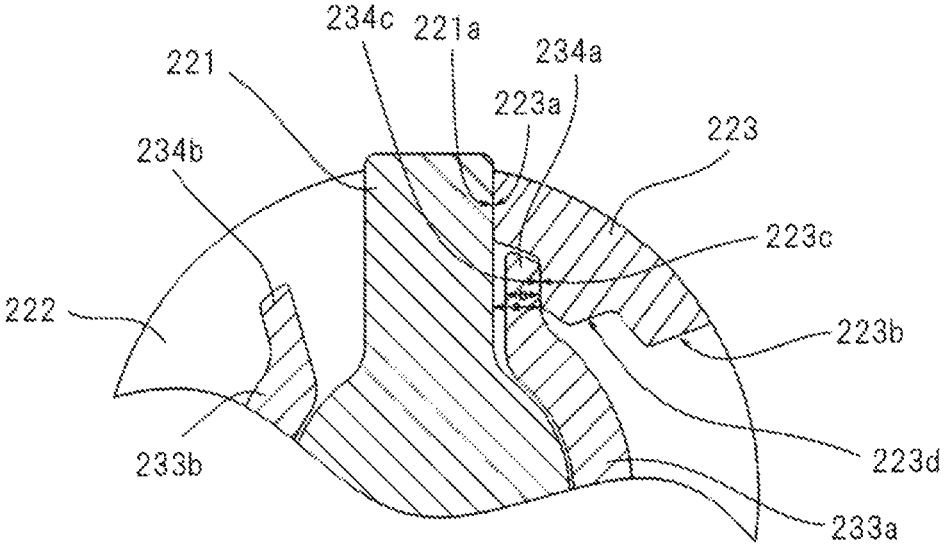
FIG. 15 is a partial cross-sectional view illustrating a vicinity of a hammer, a carrier and an anvil of FIG. 14.

FIG. 15 is a partially enlarged cross-sectional view illustrating shapes of the hammer 222 and the carrier 233, and corresponds to a cross-sectional view taken along B-B portion of FIG. 14. The two hammer claws 223, disposed at diagonal corners in the circumferential direction, are designed such that, in addition to the two impact surfaces 223*a* and 223*b* positioned on the outer circumferential side in a circumferential direction, two impact surfaces 223*c* and 223*d* are added and formed on the inner circumferential side. Here, the impact surfaces 223*a* and 223*b* are formed so as to strike the impact-subject surfaces 221*a* and 221*b*, and they have the same functions as those of hammer claws used in an existing impact tool, and also have substantially the same basic shapes. The impact surface 223*c* is used for pressing the protruding portion 234*a* of the member 233*a*. Here, as can be understood from the positional relationship in FIG. 15, when the hammer 222 is rotated counterclockwise upon fastening a screw, the impact surface 223*c* of the hammer claw 223 is first made in contact with the impact-subject surface 234*c* of the protruding portion 234*a*. As described earlier, the member 233*a* and the impact arm 221 are allowed to relatively move by a predetermined small angle, for example, by about 20 degrees centered on the axis X. For this reason, although the impact surface 223*c* presses the impact-subject surface 234*c*, no impact force is generated. After this state, when the member 233*a* rotates counterclockwise by the rotation of the hammer 222, the member 233*a* rotates relative to the impact arm 221 by a fine angle, and then the impact surface 223*a* of the hammer 222 collides with the impact-subject surface 221*a* of the impact arm 221. In this collision, since a repulsive force from the member to be tightened is transmitted from the tip tool to the output shaft 218 integrally formed with the anvil 220, the collision gives a strong impact. FIG. 15 shows a state at the moment when the impact surface 223*a* and the impact-subject surface 221*a* are engaged with each other, and such a structure as to generate a predetermined gap between the protruding portion 234*a* and the impact arm 221 at this time is prepared. In other words, the distance between the impact-subject surface 221*a* of the impact arm 221 and the impact surface 223*c* of the hammer claw 223 is taken as "a" relative to the thickness "b" of the protruding portion 234*a* in the rotation direction, the relationship is set as $a<b$. By using this structure, since, upon giving an impact thereto or upon rotation prior to a mounting process of a bolt or the like, the force of the hammer claw 223 is directly exerted on the impact arm 221, the member 233*a* does not contribute to the torque transmission, with the result that no adverse effects due to the interpolation of the member 233*a* are caused. Moreover, since no strong impact force is transmitted to the member 233*a*, it is possible to reduce the impact transmitted to the engaging pins 237*a* and 237*b* held by the member 233*a*, and consequently to provide a long service life of the locking mechanism. Note that, although its illustration is omitted in FIG. 15, the same contact and impact states are also generated on the member 233*b* side.

Next, with reference to FIGS. 16A to 16D, descriptions will be made on a state in which a fastening job is carried out by driving the impact tool 201. FIGS. 16A to 16D respectively illustrate cross sections of the A-A portion and cross sections of the B-B portion in FIG. 14 that are laterally arranged side by side, and in this case, the hammer 222 is driven by the motor 204. The hammer 222, the anvil 220, the members 233*a* and 233*b* and the respective members accompanying with them are rotation-symmetrically (double symmetry) set with one another, centered on the axis X, and for the convenience of illustration, reference numerals are given only to some of the parts.

Figure 16A:
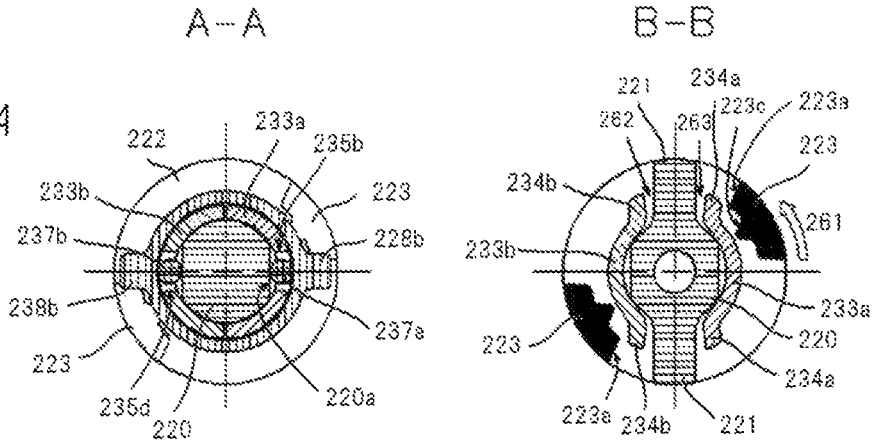
FIG. 16A is a cross-sectional view taken along an A-A cross-sectional position and a B-B cross-sectional position for explaining a positional relationship among the hammer, carrier and anvil.

The members 233*a* and 233*b* sandwich the impact arm 221 of the anvil 220, and are also provided with protruding portions 234*a* and 234*b* so as to have predetermined gaps from the impact-subject surfaces 221*a* and 221*b* of the impact arm 221 so that the pivotal angles of the members 233*a* and 233*b* are limited within a predetermined range. FIG. 16A illustrates a state in which the hammer claw 223 and the impact arm 221 are separated from each other, that is, for example, a state upon rotation start of the hammer 222. From this state, the rotation driving force caused by the rotation of the motor 204 is transmitted to the spindle 228 via the reducer mechanism 214 so that the hammer 222, held by the cam mechanism, is allowed to rotate in a direction of an arrow 261.

At this time, the positional relationship between the position of the impact arm 221, that is, the rotation angle of the anvil 220, and the protruding portions 234*a* and 234*b* of the members 233*a* and 233*b* is illustrated in the drawings. Moreover, the protruding portions 234*a* and 234*b*, which extend in radial directions from the members 233*a* and 233*b*, and the impact arm 221 are supported in a stable manner at positions with predetermined gaps 262 and 263 being kept therebetween. As can be understood from FIG. 16A, the axis portion of the anvil 220, that is, the output shaft 218, is housed inside the cylinder portions of the members 233*a* and 233*b*, with the engaging pins 237*a* and 237*b* being respectively positioned in the inside spaces of the cut-out portions 235*b* and 235*d*. In this case, the members 233*a* and 233*b* are only fitted to the outer circumferential portion of the anvil 220, and they are designed to be able to relatively rotate by a fine angle by setting their shapes.

Figure 16B:
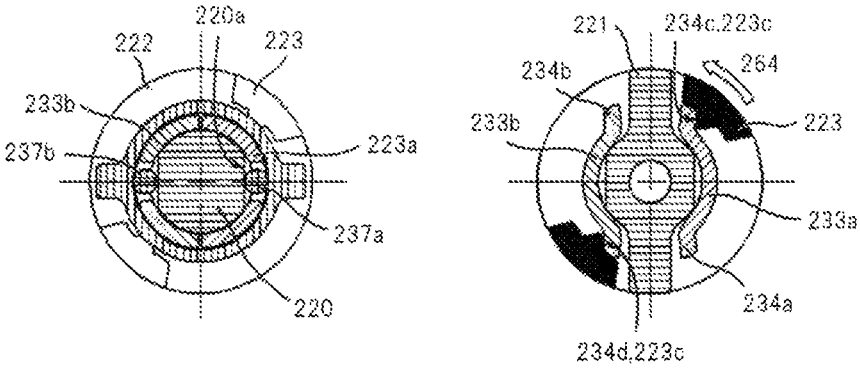
FIG. 16B is a cross-sectional view taken along the A-A cross-sectional position and the B-B cross-sectional position for explaining a positional relationship among the hammer, carrier and anvil.
Figure 16C:
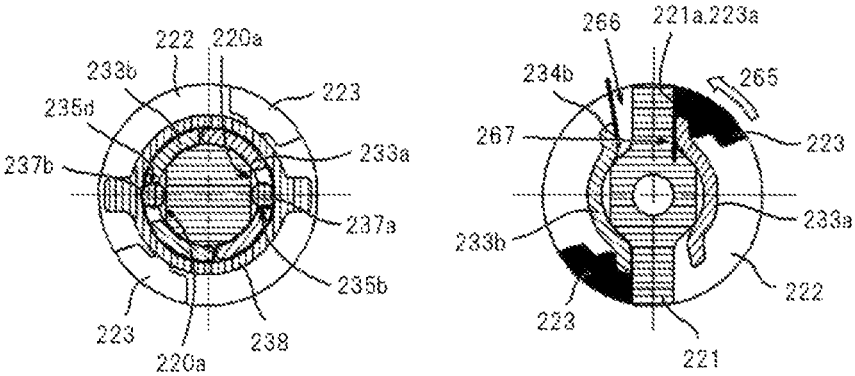
FIG. 16C is a cross-sectional view taken along the A-A cross-sectional position and the B-B cross-sectional position for explaining a positional relationship among the hammer, carrier and anvil.

FIG. 16B illustrates a state upon the rotation start of the members 233*a* and 233*b* in which the hammer 222 is further rotated in the direction of an arrow 264 so that the impact surfaces 223*c* of the hammer claws 223 abut the impact-subject surfaces 234*c* and 234*d* of the protruding portions 234*a* and 234*b*. When the hammer 222 is rotated by the torque of the motor 204, the hammer 222 is made in contact with the members 233*a* and 233*b* prior to rotating to strike the anvil 220, thereby rotating the members 233*a* and 233*b*. For this reason, the shape of each of the hammer claws 223 is designed such that, at the moment when the impact surface 223*c* abuts each of the protruding portions 234*c* and 234*d*, the impact surface 223*a* is not made in contact with the impact arm 221. When the hammer 222 is further rotated from this state, as illustrated in the view on the right side of FIG. 16C, the hammer claw 223 allows the impact surface 223*a* to collide with the impact-subject surface 221*a* of the impact arm 221, while rotating the members 233*a* and 233*b* in a direction of an arrow 265, thereby applying an impact force to the anvil 220. In this case, as illustrated in FIG. 16C, since there is a gap 267 indicated by a thick line, the member 233*a* is prevented from striking the impact arm 221. The above-mentioned function is exerted in the same manner also on the member 233*b* side. Moreover, at this time, the gap in the arrow 266 portion becomes larger than the gap 262 in FIG. 16A.

In this manner, in the case when each of the members 233*a* and 233*b* is rotated by a predetermined angle relative to the impact arm 221, as illustrated in the view on the left side of FIG. 16C, the edge portion of each of the cut-out portions 235*b* and 235*d* in the circumferential direction of the members 233*a* and 233*b* is consequently made in contact with the outer circumferential portion of each of the engaging pins 237*a* and 237*b* so that each of the engaging pins 237*a* and 237*b* is pushed to retreat to the center portion of the relief surface 220*a* formed on the circumferential surface of the anvil 220. The hammer 222 strikes the anvil 220 while rotating the members 233*a* and 233*b*, and transmits the rotation to the tip axis side. The anvil 220 rotates, with the inner circumferential side of each of the engaging pin 237*a* and 237*b* being made in contact with the relief surface 220*a*; however, the contact portion (a line portion in parallel with the axis X) is maintained substantially in the center of the relief surface 220*a* in the circumferential direction.

Figure 16D:
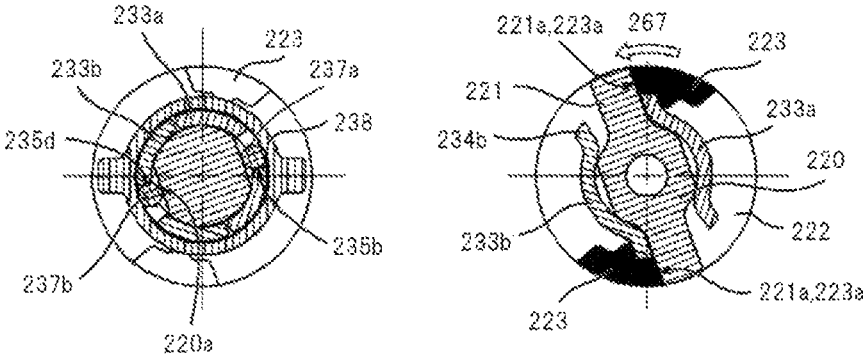
FIG. 16D is a cross-sectional view taken along the A-A cross-sectional position and the B-B cross-sectional position for explaining a positional relationship among the hammer, carrier and anvil.

FIG. 16D is a diagram illustrating a state in which the hammer 222 is further rotated in a direction of an arrow 280 from the state illustrated in FIG. 16C. In this state, the impact surface 223*a* of the hammer claw 223 pushes or strongly strikes the impact-subject surface 221*a* of the impact arm 221 so that the anvil 220 is rotated. At this time, each of the engaging pins 237*a* and 237*b* is kept in contact with the edge portion of each of the cut-out portions 235*b* and 235*d* of the members 233*a* and 233*b*. For this reason, the anvil 220, the members 233*a* and 233*b*, the engaging pins 237*a* and 237*b*, which are rotatable portions, can be continuously rotated by the hammer 222, without strongly interfering with the inner wall of the lock ring 38 that is a non-rotatable portion, with the relative positional relationship of FIG. 16D being maintained. That is, it is possible to prevent the members 233*a* and 233*b* from vigorously rotating to cause each of the engaging pins 237*a* and 237*b* rolled by the members 233*a* and 233*b* to collide with the lock ring 238 and the end portion of the relief surface 220*a* of the anvil 220.

Figure 17A:
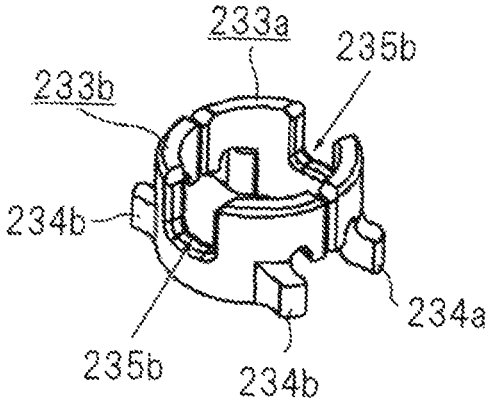
FIG. 17A is a perspective view illustrating the shape of the carrier of FIG. 13.
Figure 17B:
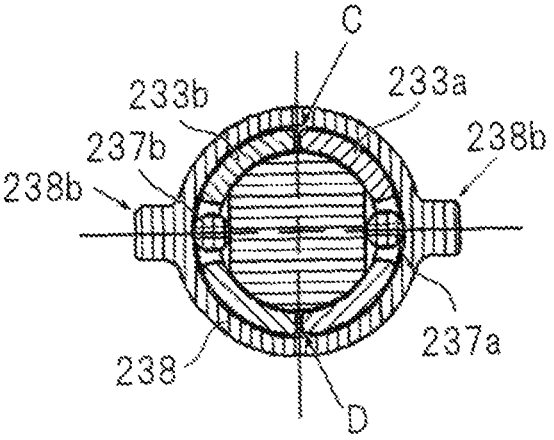
FIG. 17B is a cross-sectional view taken along the A-A portion of FIG. 14.

FIG. 17A is a perspective view illustrating a shape of the carrier 233 of FIG. 13, and FIG. 17B is a cross-sectional view at the A-A cross-sectional position of FIG. 14. The carrier 233 has a cylindrical shape, and in the present embodiment, it is designed to have a shape formed by dividing the cylindrical member along a plane including the axial direction. In the initial stage of developments, the inventors designed the member 233*a* and 233*b* so that the member 233*a* and 233*b* were integrally molded into a substantially cylindrical shape. However, in this case, it is found that problems might be caused during operations. For better understanding of the present third embodiment, with reference to FIGS. 20 and 21, the following descriptions will explain circumstances upon occurrence of problems caused by the integrally molded carrier in the initial stage of developments.

Figure 20A:
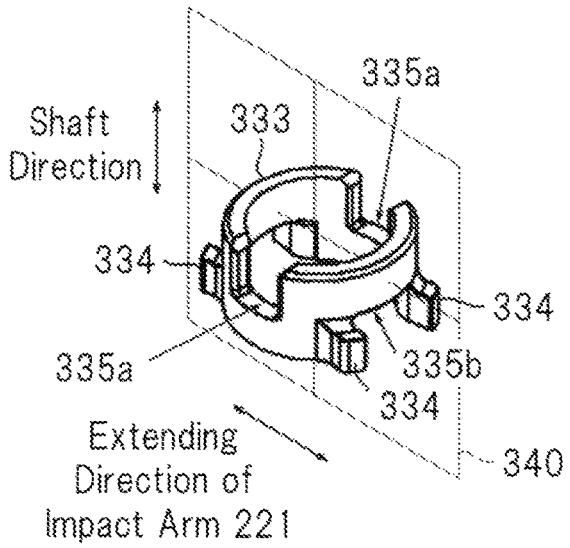
FIG. 20A is a perspective view illustrating a shape of the carrier.
Figure 20B:
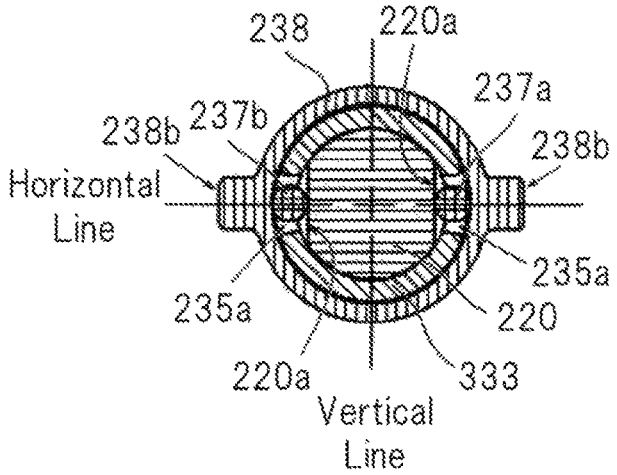
FIG. 20B is a cross-sectional view illustrating a positional relationship among the carrier, the engaging pin and the lock ring.

FIGS. 20A and 20B illustrate a carrier produced by an integrally molding process, and FIG. 20A is a perspective view illustrating a shape of a carrier 333, and FIG. 20B is a cross-sectional view illustrating a positional relationship among the carrier 333, engaging pins 237*a* and 237*b*, and a lock ring 238. The integrally molded carrier 333 is produced by a molding process of a metal alloy, and has a structure in which a cut-out portion 335*a* for use in defining a space for holding the engaging pins 237*a* and 237*b* on a base member having a cylindrical shape, and a cut-out portion 335*b* for housing the impact arm 221 of the anvil 220 are formed, with a protruding portion 334 being formed in a manner so as to protrude outward from an edge of the cut-out portion 335*b* in a circumferential direction. In FIG. 20A, the carrier 333 is designed so as to be plane-symmetrical to a virtual surface 340 including the direction in which the impact arm 221 extends and the axial direction of the output shaft 218. When the carrier 333 is attached to the anvil 220, and then the lock ring 238 is attached thereto, a positional relationship as illustrated in FIG. 20B is formed, with the engaging pins 237*a* and 237*b* being positioned substantially in the center of the two cut-out portions 335*a* of the carrier 333. At this time, the engaging pins 237*a* and 237*b* are positioned substantially in the center of the relief surface 220*a*.

Figure 21A:
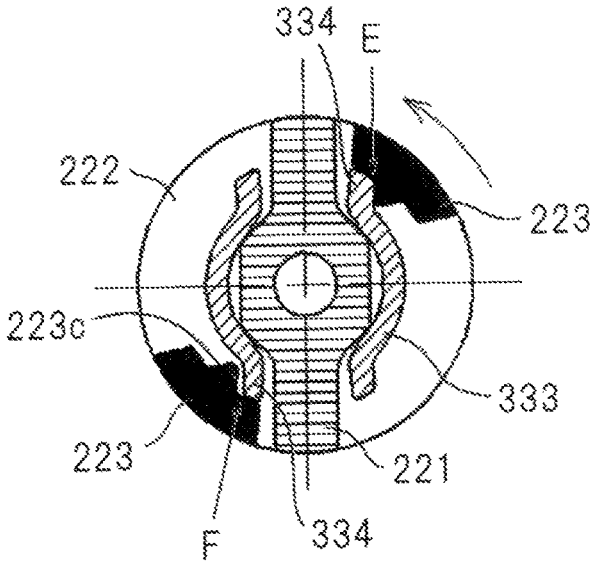
FIG. 21A is a diagram for explaining a positional relationship between the hammer and the anvil when the carrier of FIGS. 20A to 20B is used and also a cross-sectional view of a portion corresponding to the B-B cross-sectional position of FIG. 14.
Figure 21B:
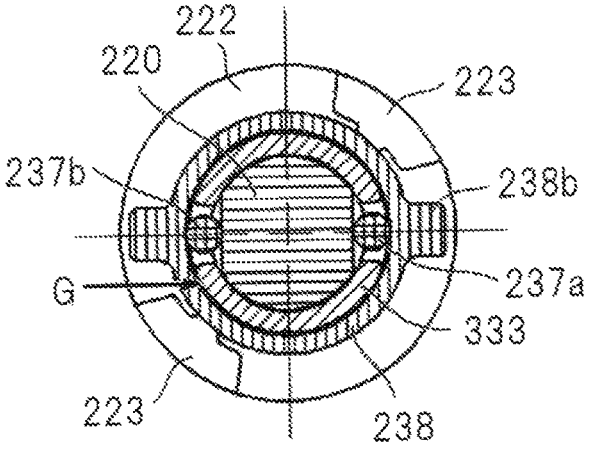
FIG. 21B is a diagram for explaining a positional relationship between the hammer and the anvil when the carrier of FIGS. 20A to 20B is used and also is a cross-sectional view of a portion corresponding to the A-A cross-sectional position of FIG. 14.

FIGS. 21A and 21B are diagrams for explaining the positional relationship between the hammer 222 and the anvil 220 when the carrier 333 of FIGS. 20A to 20B is used, and FIG. 21A is a cross-sectional view corresponding to a B-B cross-sectional position of FIG. 14, and FIG. 21B is a cross-sectional view corresponding to an A-A cross-sectional position of FIG. 14. As illustrated in FIG. 21A, when the hammer 222 rotates, the hammer claw 223 abuts the protruding portion 334 prior to colliding with the impact arm 221. When the hammer 222 is rotated as illustrated in 21A, before the hammer claw 223 collides with the impact arm 221, the hammer claw 223 abuts the protruding portion 334 in a vicinity of an arrow E in FIG. 21A. By this contact, the carrier 333 is rotated substantially in synchronism with the anvil 220. However, in the case when a slight warping or the like is caused by deviations upon producing the carrier 333, the carrier 333 tends to be slightly biased relative to the rotation axis of the carrier 333, and as indicated by an arrow F, a state in which, on one side of the hammer claw 223, no contact between the protruding portion 334 and the impact surface 223*c* tends to occur. In this case, although one of the engaging members (engaging pin) is released from a locked state, the other engaging member (engaging pin) is sometimes kept in the locked state, with the result that an impact load applied to the carrier 333 by the hammer 222 on the arrow E side tends to become twice as high as the normal load. For this reason, in order to prevent damages to the carrier 333 and also to ensure the durability thereof, it is necessary to produce the carrier 333 with sufficient strength. In order to ensure the sufficient strength in the carrier 333, the thickness of the carrier 333 needs to be made thicker, which causes a weight increase and makes the housing thick and bulky instead.

FIG. 12B is a diagram illustrating a positional relationship between the carrier 333 and the lock ring 238. Due to the one-side contact state in which the portion on the arrow E side makes a contact while the portion on the arrow F side has no contact, a gap is undesirably generated in the vicinity of an arrow G of FIG. 12B, resulting in a state in which the carrier 333 is not allowed to smoothly rotate relative to the lock ring 238. In order to avoid this problem, to further improve the machining precision of the carrier 333, the anvil 220 and the lock ring 238 and to enhance the assembling precision are required; however, they cause an increase in production costs.

Figure 18A:
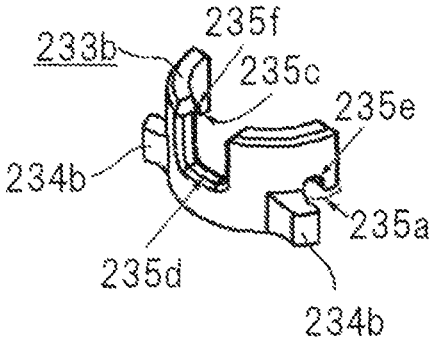
FIG. 18A is a perspective view illustrating a shape of a single unit of the carrier of FIG. 13.
Figure 18B:
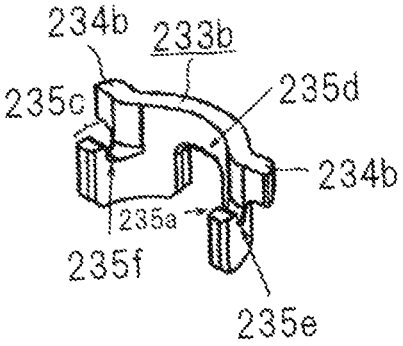
FIG. 18B is a perspective view illustrating a shape of a single unit of the carrier of FIG. 13.

FIGS. 17A to 17B are diagrams illustrating a method for solving the problems as indicated by FIGS. 20A to 20D and FIGS. 21A to 21D, in which the carrier 233 is divided into two members 233*a* and 233*b* along the virtual plane 340 illustrated in FIG. 20A. The virtual plane 340 is in parallel with a direction in which the impact arm 221 is extended, and corresponds to a plane including the axis X of the output shaft 218. By using the two divided members 233*a* and 233*b* as one unit, a single carrier 233 is formed. In the case when both of the two members 233*a* and 233*b* are designed to be plane-symmetric, or rotation-symmetric shapes, since they are used for either right or left side, the two of the same parts can be used as a pair, thereby making it possible to provide an advantageous method from the viewpoint of production costs. In the present embodiment, in order to house the impact arm 221, cut-out portions 235*a* and 235*c*, as illustrated in FIGS. 18A and 18B, are respectively formed on the two members 233*a* and 233*b*. Additionally, with respect to the position of the virtual plane for use in division, even when the dividing plane is shifted by slightly shifting the virtual plane 340 in the circumferential direction, no problems are raised as long as the shift is made within a range not reaching the protruding portion 334 in FIG. 20A.

FIG. 17B is a diagram illustrating a positional relationship among the members 233*a* and 233*b*, the engaging pins 237*a* and 237*b*, and the lock ring 238. Although this shape is substantially the same as that illustrated in FIG. 20B, dividing planes between the right and left members 233*a* and 233*b* are positioned near arrows C and D. This structure is preferably designed such that the members 233*a* and 233*b* are slightly separated from each other on these dividing planes; however, they may be lightly made in contact with each other near the arrows C and D, as long as the respective members 233*a* and 233*b* are allowed to move to optimal positions independently.

FIGS. 18A and 18B are diagrams illustrating the shape of the member 233*a* as a single member, in which FIG. 18A is a perspective view in which the member 233*a* is viewed from the outside in the radial direction, and FIG. 18B is a perspective view in which the member 233*a* is viewed from the inside in the radial direction. The member 233*a*, which is made of a metal, is integrally molded into a semi-cylindrical shape. A cut-out portion 235*d* is formed substantially in the center of the member 233*a* in the circumferential direction. The cut-out portion 235*b* is formed so as to house the engaging pin 237*b*. In this case, the semi-cylindrical shape refers to a shape in which a cylinder member, not illustrated, is divided into two, along a plane passing through the axis X, that is, the virtual plane 340 of FIG. 20A.

Protruding portions 234*b* are respectively formed on two edges in the circumferential direction of the member 233*b*. The cut-out portion 235*a* is formed on the member 233*a*, and the cut-out portion 235*c* is formed on the member 233*b*. The cut-out portion 235*a* and the cut-out portion 235*c* correspond to the second cut-out portions, and the second cut-out portions are formed over both of the members 233*a* and 233*b*. Each of the protruding portions 234*b* has a shape that is formed such that the portions of the cut-outs 235*a* and 235*c* are cut and bending each of the cut cut-outs outward in a radial direction, with the result that the cut-out portions 235*a* and 235*c* are formed in a manner so as to be adjacent to the protruding portion 234*b*. The cut-out portions 235*a* and 235*c* form a space through which the impact arm 221 penetrates. On the cut-out portions 235*a* and 235*c*, holes 235*e* and 235*f*, each having substantially a round shape, are formed. These holes 235*e* and 235*f* are formed so as to prevent damages caused by a stress applied to the protruding portion 234*a* from being concentrated onto the member 233*a*, which is concentrated on a specific portion of the protruding portion 234*a*, that is, in the vicinity of the connection portion between the cut-out portions 235*a* and 235*c*, and by allowing each of the holes 235*e* and 235*f* to have an R shape with an appropriate curvature radius R, the stress can be appropriately dispersed.

Figure 19A:
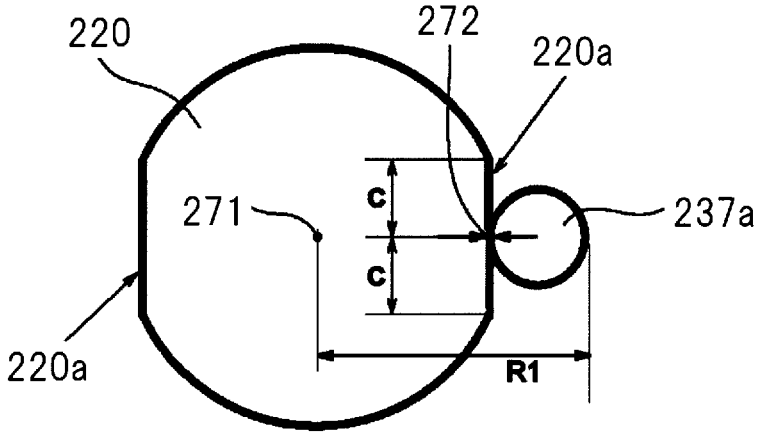
FIG. 19A is a diagram for explaining a positional relationship between the anvil and an engaging pin taken along an A-A cross-sectional position of FIG. 14.
Figure 19B:
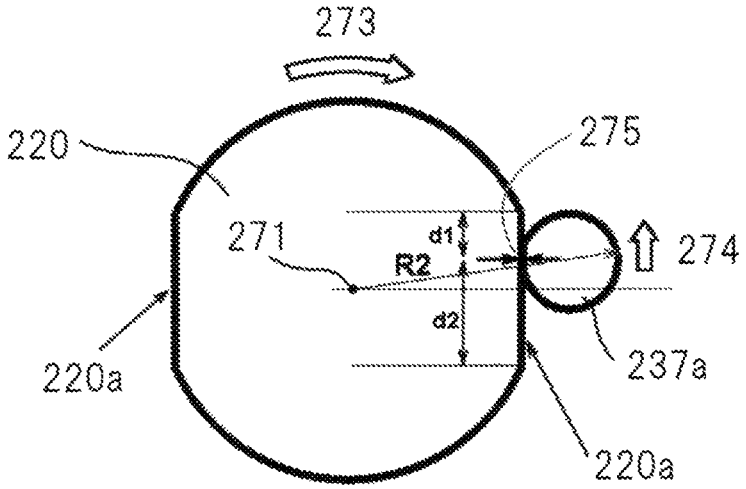
FIG. 19B is a diagram for explaining a positional relationship between the anvil and the engaging pin taken along the A-A cross-sectional position of FIG. 14.

FIGS. 19A and 19B are diagrams for explaining a positional relationship between the anvil 220 and the engaging pin 237*a* at the A-A cross-sectional position of FIG. 14. As illustrated in FIG. 16D, while the hammer 222 is rotating, the anvil 220 is rotated in a state where the impact surface 223*a* of the hammer claw 223 is pushing the impact-subject surface 221*a* of the impact arm 221, and thus the positional relationship between the anvil 220 and the engaging pin 237*a* is indicated by FIG. 19A, and this position forms a lock releasing position by the engaging pin 237*a*. In this state, each engaging pin 237*a* is positioned substantially in the center in the vertical direction (circumferential direction) of the relief surface 220*a*; that is, assuming that the width in the vertical direction (circumferential direction) of the relief surface 220*a* is 2*c*, the contact points 272 between the anvil 220 and the engaging pin 237*a* are located at a position with a distance "c" from the top and a position with a distance "c" from the bottom. In this state, the farthest distance from the rotation center 271 to the outer circumferential surface of the engaging pin 237*a* is represented by R1. R1 is represented as follows.

$R1$=(Radius of the anvil 220)−(Cut-out amount of the relief surface 220*a*)+(Diameter of the engaging pin 237*a*)

In the present embodiment, by setting R1 smaller than the inner diameter of the cylinder portion 238*d* of the lock ring 238, the engaging pin 237*a* is kept free from limiting the rotation of the anvil 220 and the carriers 233. Note that, not only by tightening a screw or the like by rotating the impact tool 201 itself, the rotation of the anvil 220 can be locked in the same manner even by loosening.

In FIG. 19B, when the anvil 220 is rotated as indicated by an arrow 273, the same positional relationship as that in the case when the engaging pin 237*a* is relatively moved in a direction indicated by an arrow 274 is formed, and this position forms a locking position by the engaging pin 237*a*. As a result, the position at which the engaging pin 237*a* and the relief surface 220*a* are made in contact with each other is moved from a contact point 272 of FIG. 19A to a contact point 275 of FIG. 19B. As a result, the farthest distance from the rotation center 271 of the anvil 220 to the outer circumferential surface of the engaging pin 237*a* is changed from R1 to R2 of FIG. 19A. As can be understood from the drawings, with respect to R2, a positional relationship of R1<R2 is satisfied so that, by setting the size of the inner diameter Rc of the lock ring 238 so as to satisfy a relationship of R1<Rc<R2, the engaging pin 237*a* is allowed to intrude between the lock ring 238 and the end portion of the relief surface 220*a* of the anvil 220 by the change in the relative positional relationship of the engaging pin 237*a* as illustrated in FIG. 19B, and the lock ring 238 and the anvil 220 are formed into an integral unit and function as a locking mechanism for the output shaft 218. That is, in the case when the worker rotates the impact tool 201 in no operation, since the rotation of the anvil 220 is kept in a locked state, it is possible to effectively carry out a manual fastening job.

Additionally, in addition to fastening a screw or the like by rotating the impact tool 201, upon carrying out a loosening process (in the case when the rotation direction of the impact tool 201 is reversed), the rotation of the anvil 220 is also locked. As described above, in the present embodiment, when stopping the motor 204 and then rotating the anvil 220 is rotated relative to the main housing 202 during the stoppage of the rotation of the hammer 222, the engaging pin 237*a* is sandwiched by the outer circumferential surface of the anvil 220 and the inner circumferential surface of the lock ring 238 at the moment when the center position of the relief surface 220*a* is separated from the engaging pin 237*a* serving as an engaging member. As a result, the rotation of the anvil 220 relative to the lock ring 238 is limited. Note that, although FIGS. 19A and 19B only illustrates the engaging pin 237*a* on one side, the same state occurs in the engaging pin 237*b* on the opposite side. In this manner, when a manual fastening job is carried out by rotating the impact tool 201, the anvil 220 is locked to be unrotatable relative to the lock ring 238 by a function of the lock ring 238, so that an output shaft locking function is achieved, and the manual fastening job can be easily carried out. Moreover, even in the case when jobs are shifted from the fastening job by using a driving source to the manual fastening job, special operations, such as a pulling operation of a lever or the like by the worker, are not required at all, and it is only necessary to simply rotate the impact tool 201 itself, so that a power tool that is really convenient for use can be achieved.

In the case when, after completion of this manual fastening job, a fastening process for the next screw is carried out, the motor 204 is rotated by pulling the trigger 206, and in this case, as illustrated in the FIGS. 16A to 16C, since the hammer claw 223 pushes each of the protruding portions 234*a* and 234*b* of the member 233*a* so that the relative position of the engaging pin 237*a* to the anvil 220 is returned to the position of FIG. 16A and brought into a free state, that is, a lock-released state. For this reason, the same existing fastening job can be carried out without giving any adverse effects to a normal fastening job by the use of the motor 204.

As described above, in accordance with the impact tool 201 of the present third embodiment, the anvil 220 and the output shaft 218 are produced as one integral structure, and simply by adding the carrier 233 having a dividable structure and the engaging pins 237*a* and 237*b* thereto, a locking mechanism of the output shaft 218 is achieved. Therefore, it is possible to simplify the shape of the anvil 220 and also to efficiently transmit an impact energy of the hammer 222 to a tip tool. Moreover, since the anvil 220 and the output shaft 218 are formed into an integral structure, it is possible to remarkably reduce a collision sound and vibrations generated upon transmitting the rotation from the impact-subject surfaces 221*a* and 221*b* of the anvil 220 to the output shaft 218 upon striking by the hammer 222. Moreover, since the carrier 233 is divided so as to be composed of a first carrier member and a second carrier member, the possibility that a torque twice as high as the normal one might be applied to only one side can be eliminated, and the thickness can be made thinner in comparison with an integral-type carrier member so that a locking mechanism that is light weight and can save the installation space is achieved. Furthermore, since the impact tool 201 can be bent centered on a pivotal axis 209 so that it becomes possible to apply a high torque upon carrying out a fastening process by rotating the main body.

In the present third embodiment, in the case in an attempt to carry out a fastening process by the use of the motor 204, the lock ring 238 and the output shaft 218 are rotated in a tightening direction (direction reversed to a manual tightening direction) from the fixed state, by simply rotating the hammer 222 to be first made in contact with the carrier 233, the housing 202*b* and the output shaft 218 are brought into a free idle rotating state, it is not necessary to attempt to switch jobs between the manual fastening job utilizing the output shaft lock and the fastening job by the use of the motor 204. In this manner, in the present embodiment, without the necessity of operating an output shaft locking switch or the like, by simply rotating the main body of the impact tool 201 in the tightening direction of a fastening member, after the completion of a fastening job and the stoppage of the motor 204, an additional tightening process of the fastening member and a confirmation for the tightened state can be carried out.

According to the present invention, since the divided carrier members have the same shape, a cost reduction can be expected by the mass production, and easy handling can be achieved in assembling processes.

According to the present invention, in the case when the anvil is rotated relative to the housing during the stoppage of the rotation of the hammer, since the relative rotation between the anvil and the lock ring is limited so that no special operation is required for locking the output shaft, it is possible to achieve a power tool having very high operability and high reliability, which is free from erroneous operations. In particular, when the relative rotation angle between the carrier member and the anvil becomes greater than a predetermined angle so that the center position of the relief surface is separated from the engaging member, a locked state is exerted; therefore, the worker is allowed to lock the output shaft easily by simply rotating the housing main body slightly, with the tip tool being pressed onto a member to be tightened.

Another preferred aim of the present invention lies in that, in a power tool having a locking function for fixing the rotation of the anvil for a manual fastening process, the shapes of the anvil and the periphery of the anvil are simplified so that the production costs can be reduced.

Still another object of the present invention lies in that, in the locking function for fixing the rotation of the anvil for a manual fastening process, by preventing a one-side contacting state in which the hammer claw is made in contact with only one of the carriers, a defective operation in the manual fasting mechanism can be prevented.

According to the present invention, since the protruding portion is formed into such a shape as to protrude substantially in parallel with an extending direction of the impact-subject surface of the anvil, the carrier member is easily rotated relative to the anvil by utilizing the impact surface of the hammer. During the rotation of the driving unit, the engaging member is maintained so as to be positioned in the center of the relief surface, with the engaging member being made in contact with the moving carrier member, so that the housing and the output shaft are kept in a free state so as to rotate idly, thereby making it possible to carry out a normal fastening job by a driving source without causing any problems.

According to the present invention, since such a structure is provided in which, when the hammer rotates, the hammer is engaged with the lock releasing member prior to being engaged with the anvil to release the lock by the locking mechanism so that the anvil is made rotatable without the necessity of carrying out any special operation.

According to the present invention, since the hammer is provided with a first impact surface for striking the anvil and a second impact surface that is made in contact with the carrier member, it is possible to strike two members (anvil, carrier member) by simply changing the shape of the hammer claw.

According to the present invention, when the hammer is rotated, the second impact surface is first made in contact with the carrier member, and the first impact surface is next made in contact with the anvil. Therefore, immediately before the anvil is struck by the hammer, the carrier member can be shifted so that it is possible to positively release the locked state of the output shaft. Moreover, since the impact force of the hammer is directly transmitted to the anvil, without passing through the lock releasing member, the impact force of the hammer is effectively transmitted even when the rigidity of the lock releasing member is low.

In the foregoing, the present invention has been described based upon embodiments; however, the present invention is not limited to the third embodiment and various modifications may be made thereto without departing from the gist of the invention. For example, the third embodiment has been described above exemplifying a power tool having a bending structure. However, the present invention can be applied to a power tool without a bending structure in the same manner. Moreover, the third embodiment has been described above exemplifying an impact tool of a mechanical system as a power tool. However, the present invention can be applied to an impact tool of an oil pulse system, an impact tool of an electronic pulse system, and a driver drill in the same manner. Furthermore, with respect to power tools, such as a grinder and a circular saw, by using the structure of the present invention as a locking mechanism for preventing the output shaft from rotating in the case of loosening a nut for fixing the tip tool, it becomes possible to lock the output shaft by simply holding the housing with the hands.

Embodiment 4

Figure 22:
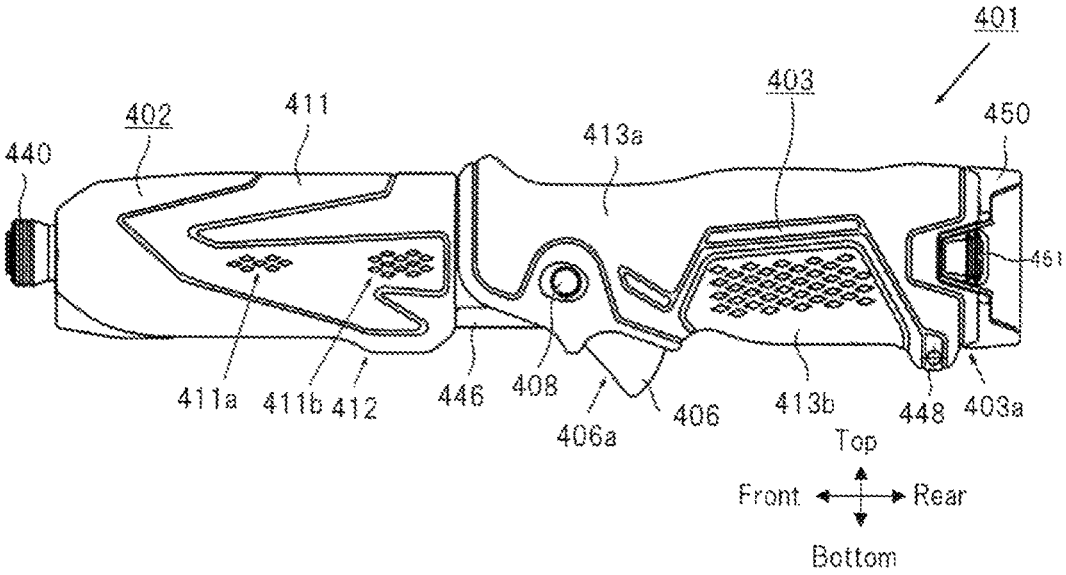
FIG. 22 is a side view illustrating an appearance of the impact tool when being straightened in accordance with a fourth embodiment of the present invention.

With reference to the drawings, a fourth embodiment of the present invention will be described. Note that, in the following drawings, the same portions are denoted by the same reference numerals, and repetitive explanations will be omitted. In the present specification, explanations will be given on the premise that longitudinal directions and lateral directions correspond to directions indicated in the drawings. FIG. 22 is a cross-sectional view illustrating the entire portion of an impact tool 401 that is one example of a tightening tool (power tool) in accordance with the present fourth embodiment of the present invention.

Figure 26:
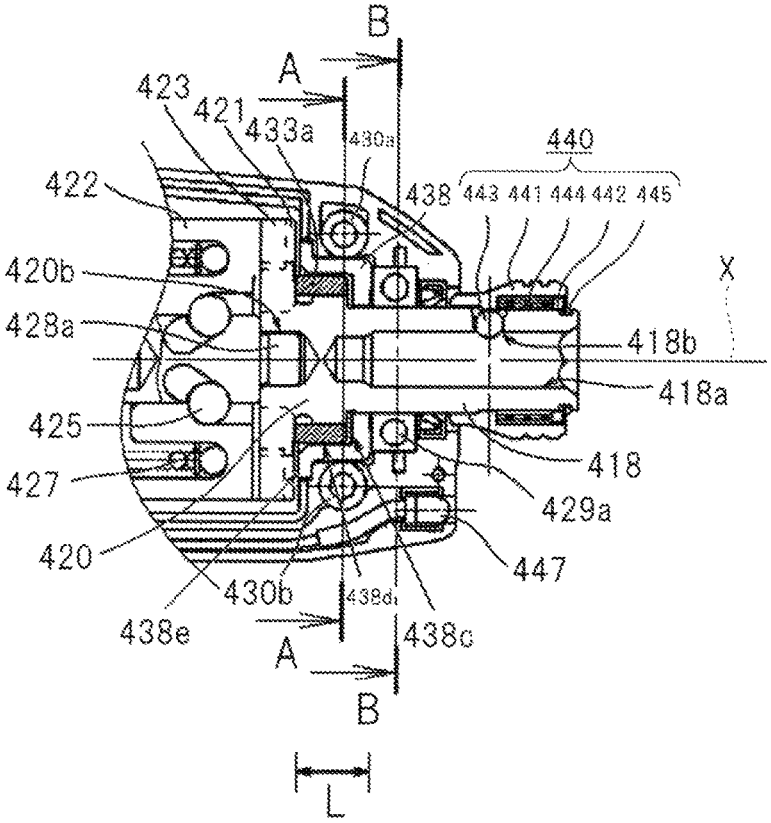
FIG. 26 is an enlarged partial cross-sectional view illustrating the vicinity of the lock ring of FIG. 24.
Figure 27:
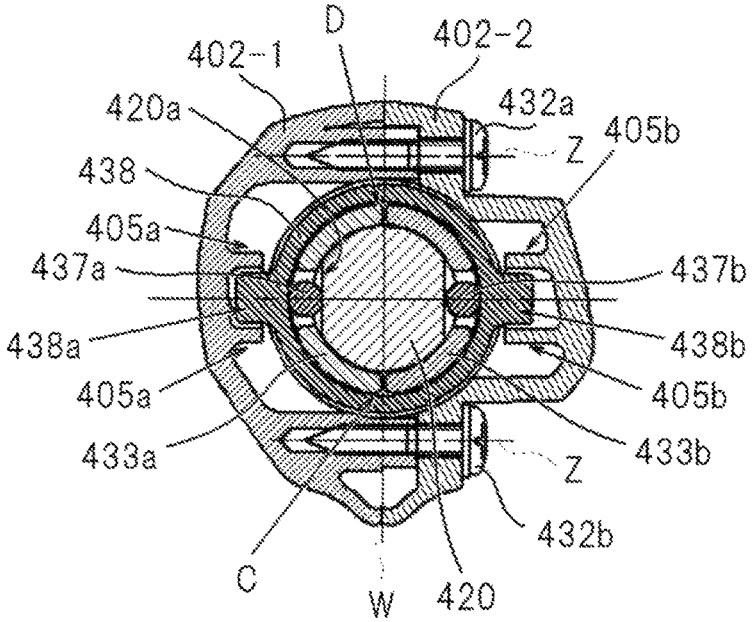
FIG. 27 is a cross-sectional view taken along an A-A portion of FIG. 26.

The impact tool 401 utilizes, as a power supply, a battery pack 450 that is chargeable and detachably attached, and applies a rotating force and an impact force to the output shaft via a power transmitting mechanism using a motor, not illustrated, as a driving source, so that the rotating force and the impact force are transmitted to a tip tool such as a driver bit that is held in a mounting hole covered with a mounting portion 440 and a job such as a screw fastening or bolt fastening process is carried out. The housing of the impact tool 401 is composed of a main housing (front housing) 402 and a handle housing (rear housing) 403. As illustrated in FIG. 27, the main housing 402 is composed by combining a plurality of structural members, more specifically, two structural members 402-1 and 402-2, with each other. The two structural members 402-1 and 402-2 are divided from each other, along a dividing plane W along the axis X serving as a border. As illustrated in FIG. 26, on the main housing 402, a shaft hole 801 is formed. The shaft hole 801 is formed on the side opposite to the handle housing 403.

Figure 23:
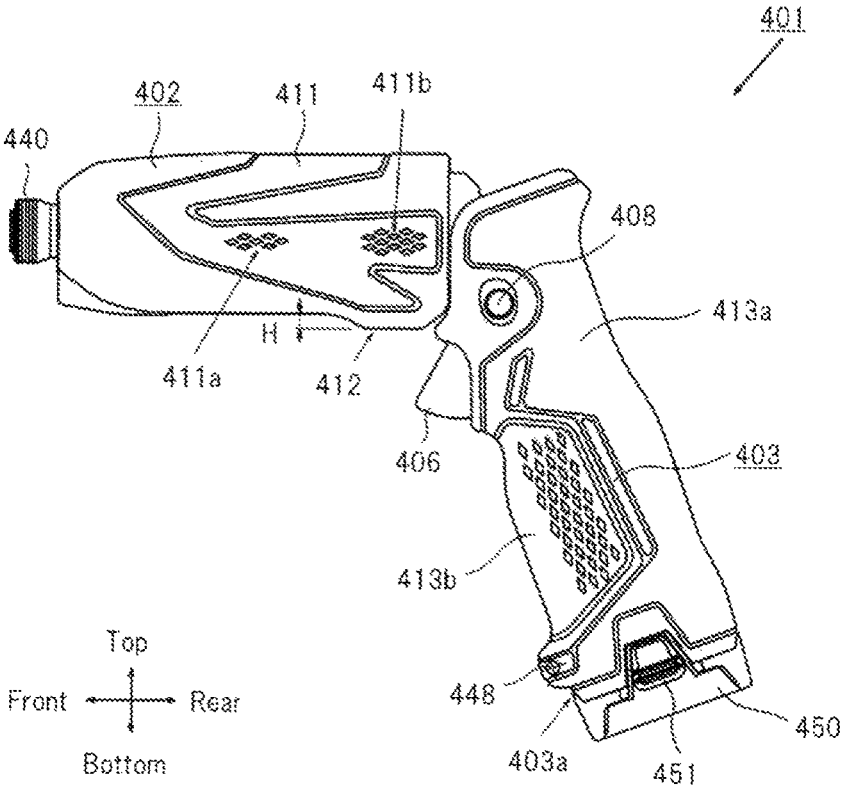
FIG. 23 is a side view illustrating an appearance of the impact tool when being bent in accordance with the embodiment of the present invention.

The main housing 402 is formed by an integral molding process of a polymeric resin such as a plastic material and composed of laterally dividable two units, and the right and left units are fixed by using screws, not illustrated. The handle housing 403 is formed into a substantially cylindrical shape or cylinder shape having an opening 403*a* on its rear end, and produced by an integral molding process of a polymeric resin such as a plastic material and formed as a laterally dividable unit. The main housing 402 and the handle housing 403 are coupled to each other in the vicinity of the center portions in the front to rear direction by a pivotal mechanism having a pivotal shaft, not illustrated, and allowed to pivot by about 70 degrees centered on the pivotal shaft. This plane on which the pivotal movements are carried out corresponds to a plane (the same plane as the paper face) including the frontward and rearward directions as well as upward and downward directions when viewed in FIG. 22. Also, as illustrated in FIG. 22, the main housing 402 and the handle housing 403 are changed from a so-called straight-type shape in which they are disposed on the same axis side by side to a so-called gun-type shape in which, as illustrated in FIG. 23 to be described later, they are pivoted. The worker can set them in either the straight-type or the gun-type depending on a working site and a working object so as to carry out the job.

The impact tool 401 of the present embodiment, which is a power tool using a known impact mechanism as a power transmitting mechanism, may be achieved as a so-called driver drill, and other power tools of a cordless system. The motor, which will be described later, is housed inside the main housing 202, and its rotation shaft is connected to a power transmitting mechanism (driving member) for use in rotating the tip tool. The battery pack 450, which is provided with a case having a substantially cylindrical shape that is attached and detached to and from the inner space thereof through the opening 403*a* at the end of the handle housing 403, is formed into a so-called cassette system serving as a power supply that can be easily exchanged. Two latch portions, not illustrated, are formed on the case of the battery pack 450, and they are engaged with concave portions (not illustrated) formed on an inner wall of the handle housing 403 so that the battery pack 450 is retained. In order to detach the battery pack 450, the battery pack 450 is pulled out rearward through the opening 403*a*, while latch portions 451 formed on right and left two positions are being pressed. The shape of the rear end of the battery pack 450 is formed so as to cover the opening 403*a* of the handle housing 403, with the rear face of the battery pack 450 forming one portion of the outer edge of the handle housing 403. Inside the battery pack 450, a plurality of lithium ion cells are housed, and the sizes, the number, and so forth of the batteries may be optionally set.

Inside the handle housing 403 corresponding to a space of a portion adjacent to the pivotal mechanism, a trigger 406 for use in operating a switch (main switch) for controlling a supply/stop of electric power to the motor and a forward/reverse switching lever 408 for use in switching the rotation directions of the motor are housed. In the present embodiment, as the main switch, a so-called variable resistance switch in which, in response to the pulling amount of the trigger 406, its resistance value is changed, is used so that the number of revolutions of the motor is changed in accordance with the amount of operation of the trigger 406. The trigger 406 has a finger cushion portion 406*a* having a width wide enough for one finger to be put thereon, and is designed such that, by allowing the front side to rock (pivot/rotate) centered on the shaft point (rocking axis to be described later) by a predetermined angle, the rear end of the trigger 406 is allowed to rock in a substantially longitudinal direction. The forward/reverse switching lever 408 is placed substantially above the pivotal axis of the trigger 406. The forward/reverse switching lever 408 is a changeover switch for switching the rotation direction of the motor between "a forward rotation direction (tightening direction)" and "a reverse rotation direction (loosening direction)", and by sliding the lever laterally, the switch is operated.

The handle housing 403 is used as a grip portion grabbed mainly by the worker, and is designed into such a shape as to fit the hand of the worker when grabbed by the worker, and elastic members 413*a* and 413*b* are formed on the upper and lower sides of the handle housing. Additionally, in the present specification, in the case when directions of the handle housing 403 are referred to, the directions are indicated based upon a state in which the impact tool 401 is put in the straight state, as illustrated in FIG. 22, unless otherwise specified (the same is true hereinbelow). The elastic members 413*a* and 413*b* are formed by using a constituent material having elasticity higher than that of a constituent material of the handle housing 403 (plastic materials), and prepared as a thin surface layer on the lower layer forming the constituent member of the handle housing 403 with a resin having high elasticity, by using, for example, a two-layer molding technique. In the vicinity of the opening 403*a* on the lower side of the handle housing 403, a hook hole 448 through which a string, or the like, for use in hanging is inserted is formed.

The main housing 402 is sometimes grabbed by the worker in an assisting manner, and for this reason, an elastic member 411 is also formed on the surface on the main housing 402 side. The elastic member 411 is formed by using a constituent material of the main housing 402, for example, a constituent material having elasticity higher than that of plastic materials, and prepared as a thin surface layer on the lower layer forming the constituent member of the main housing 402 with a resin having high elasticity, by using, for example, a two-layer molding technique. Moreover, slip preventive portions 411*a* and 411*b* are formed on the surface of the elastic member 411. The slip preventive portions 411*a* and 411*b* are formed, for example, as a plurality of small concave portions formed on the elastic member 411. Since the purpose of these portions is to prevent slipping, the slip preventive portions may be formed not only as the concave portions, but also as convex portions, grooves, steps, and the like. A cover 446 is disposed on the lower side of the pivotal center at which the main housing 402 and the handle housing 403 are bent from each other. The lower side refers to a space having a narrower angle that is formed between the main housing 402 and the handle housing 403. The cover 446 is a plate-shaped member, and serves as an outer frame member that shields a space in the vicinity of the pivotal mechanism portion between the main housing 402 and the handle housing 403, in the case when the impact tool 401 is used in a mode as illustrated in FIG. 22, that is, in the straight state.

FIG. 23 is a side view illustrating an operation state when the impact tool 401 is in a bent state as illustrated in FIG. 22. Upon the bent state, the main housing 402 and the handle housing 403 are disposed with a crossing angle of about 70 degrees so as to have a so-called gun type form (pistol shape). A protruding portion 412 that protrudes from the surface of the main housing 402 with a distance of H is formed on the main housing 402. By the protruding portion 412, the finger of the worker is directed to the center of the finger cushion portion 406*a* of the trigger 406. Since the trigger 406 is easily operated by a pulling action of the index finger of the worker, it is possible to easily carry out a variable-speed driving operation of the motor 404.

FIG. 22 is a diagram illustrating an inner structure of the impact tool 401. The impact tool 401 utilizes electric power supplied from the battery pack 450, and rotates the motor 404 serving as a driving source. The battery pack 450 has a so-called cassette structure, and is capable of being attached and detached to and from the inner space through an opening 403*a* at the end of the handle housing 403. Two latch portions (not illustrated) are formed on the battery pack 450, and they are engaged with concave portions (not illustrated) formed on an inner wall of the handle housing 403. Three lithium ion battery cells (not illustrated) are housed inside the battery pack 450, and its rated voltage is set to a DC voltage of 10.8 V. On the other end of the mounting space of the battery pack 450 that is connected to the opening 403*a*, a substrate 454 is formed, and a plurality of terminals 453 are installed in a manner so as to extend from the substrate 454 toward the opening 403*a*. On the front end portion (upper side in the drawing) of the battery pack 450, a plurality of terminals 452 are formed, and by attaching the battery pack 450 into the handle housing 403, the terminals 452 are made in contact with terminals 453 formed on the substrate 454 side.

The rotation speed (rate) of the motor 404 is decelerated by a reducer mechanism 414, and transmitted to an impact mechanism 419. In the present embodiment, the reducer mechanism 414 and the impact mechanism 419 form a power transmitting mechanism so that the rotation force of the motor 404 is transmitted to the spindle 428. The main housing 402 and the handle housing 403 are allowed to pivot by about 70 degrees centered on a pivot shaft 409, and FIG.

24 illustrates a state in which they are brought into a straight shape. The main housing 402 is formed by a molding process of a synthesized resin, such as plastics, so as to be divided into two right and left elements, and the right and left elements are fixed by using screws not illustrated. For this reason, a plurality of screw bosses 430*a* to 430*d* are formed on one of the housings forming the main housing 402, and in the other housing, not illustrated, a plurality of screw holes are formed. In the same manner, a plurality of screw bosses 431*a* and 431*b* are formed on the handle housing 403. Additionally, in the power tool of the present embodiment, the impact mechanism 419 and the reducer mechanism 414 are directly housed in the main housing 402 made of a synthesized resin. However, they may be housed in a substantially cup-shaped case (hammer case) made of a metal, and formed by an integral molding process, and the case may be housed in or connected to the main housing 402.

A trigger switch 407, which allows the worker to pull a trigger 406 so that the On-state or Off-state is exerted, and the trigger 406 is rocked centered on a rocking axis 410 formed on the front side. The trigger switch 407 has a rotary changeover switch mechanism, and by operating the forward/reverse switching lever 408, it is possible to switch the rotation direction of the output shaft 418 in a forward direction (tightening direction) or a reverse direction (loosening direction). Additionally, the trigger switch 407 is prepared as a variable switch for adjusting the number of revolutions of the motor 404 in accordance with a pulling amount of the trigger 406; however, this may be prepared as a simple ON/OFF switch. Below the mounting portion 440, an LED 447 for illuminating the front portion including the member to be tightened is installed.

The reducer mechanism 414 is provided with a plurality of planetary gears 416 through which the rotation shaft 404*a* of the motor 4 is connected to a sun gear 415, and the plurality of planetary gears 416 are engaged with inner gears 417 located on the outer circumferential side so that the planetary gears can revolve around the sun gear 415 while rotating. The spindle 428 is a member for use in rotating the hammer 422, and the rear end side of the spindle 428 is connected to the rotation shafts of the plurality of planetary gears so as to function as a planetary carrier. As a result, the revolving movement of the planetary gears 416 is converted to the rotating movement of the spindle 428. The spindle 428 is coupled to the hammer 422 by a cam mechanism, and this cam mechanism is composed of a V-shaped cam groove 426 formed on the outer circumferential surface of the spindle 428, a cam groove 424 formed on the inner circumferential surface of the hammer 422 and steel balls 425 that are engaged with these cam grooves.

The hammer 422 is always pressed forward by a spring 427, and when kept in a stationary state, is positioned with a gap from the end face of the impact arm 421 by the engagements between the steal balls 425 and the cam grooves 424 and 426. Moreover, at two portions on rotation planes that are mutually opposed to each other of the hammer 422 and the anvil 420, a hammer claw 423 serving as a protruding portion and the impact arm 421 are formed symmetrically with each other. When the spindle 428 is driven to rotate, the rotating force is transmitted to the hammer 422 via the cam mechanism, and before the hammer 422 has made a half rotation, the hammer claw 423 of the hammer 422 is engaged with the impact arm 421 of the anvil 420 so that the anvil 420 is rotated, and at this time, when a relative rotation occurs between the spindle 428 and the hammer 422 by an engaging repulsive force, the hammer 422 starts to retreat toward the motor 4 side along the cam groove 426 of the cam mechanism, while compressing the spring 427.

When the hammer claw 423 rides over the impact arm 421 by the retreating movement of the hammer 422, with the result that the engaged state of the two members is released, the hammer 422 is shifted forward by the pressing force of the spring 427 while being rapidly accelerated forward, that is, in the rotation direction, by the reaction of the elastic energy accumulated in the spring 427 and the reaction of the cam mechanism, together with the rotation force of the spindle 428, so that, by allowing the hammer claw 423 to strongly strike the impact arm 421, the anvil 420 is rotated. The output shaft 418 is connected to the front side of the anvil 420, and the output shaft 418 is inserted to a shaft hole 801. The tip of the output shaft 418 is exposed outside the main housing 402. As described above, the anvil 420 continuously or intermittently rotates.

Through a tip tool (not illustrated) attached to the mounting hole of the output shaft 418, a rotary impact force is transmitted to a screw. Thereafter, the same rotating and impacting operations are repeated, and, for example, a fastening member, such as a screw, is screwed into a member to be fastened, not illustrated, such as a lumber or the like. Additionally, in the present embodiment, since the output shaft 418 and the anvil 420 are produced by an integral molding process, no rattling is caused between these members so that it is possible to achieve an impact tool having superior rigidity and quiet in impact sound.

Figure 24:
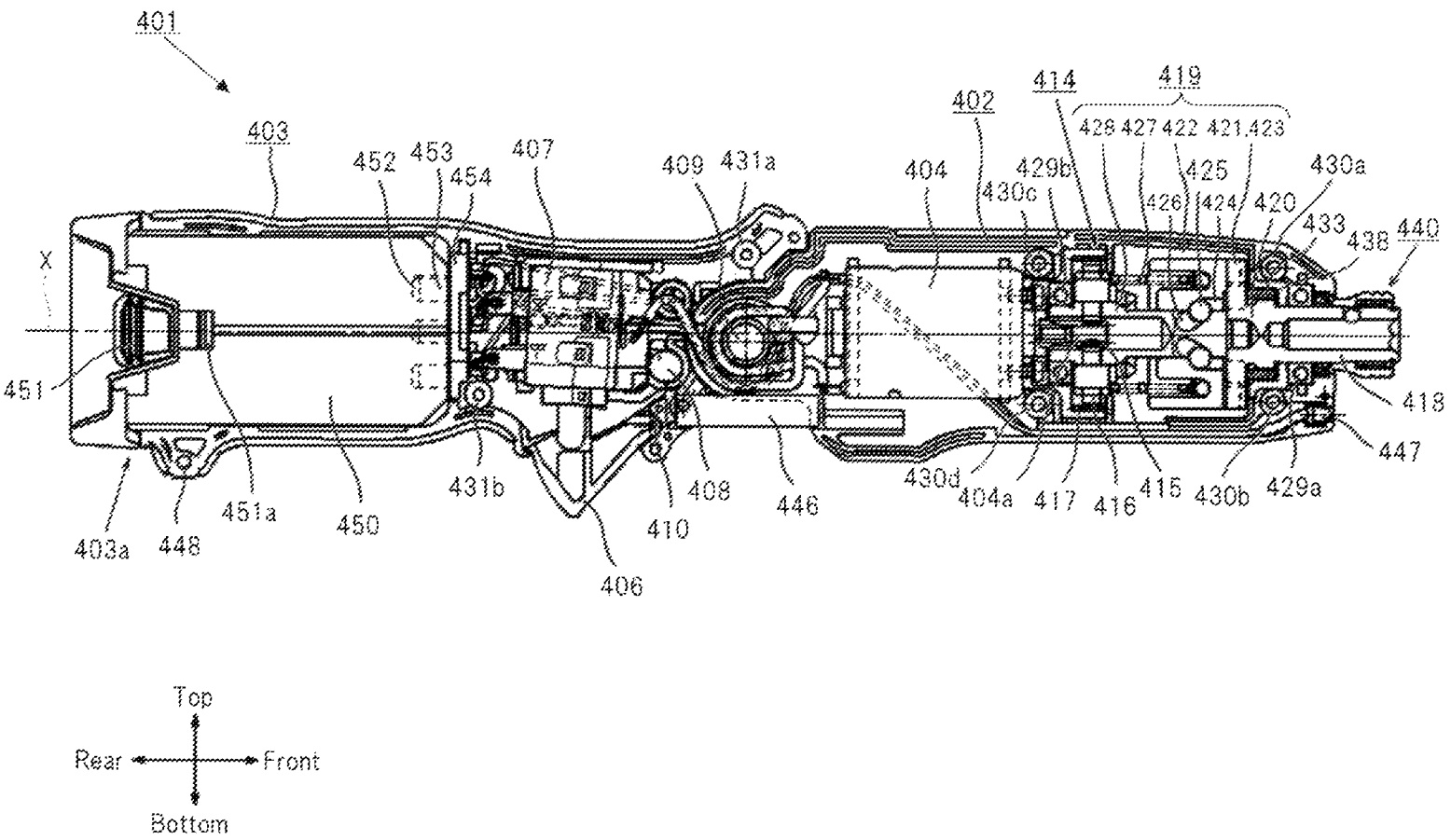
FIG. 24 is a diagram illustrating an inner structure of the impact tool of FIG. 22, and also is a longitudinal cross-sectional view illustrating a front side from a motor and a trigger portion.
Figure 25:
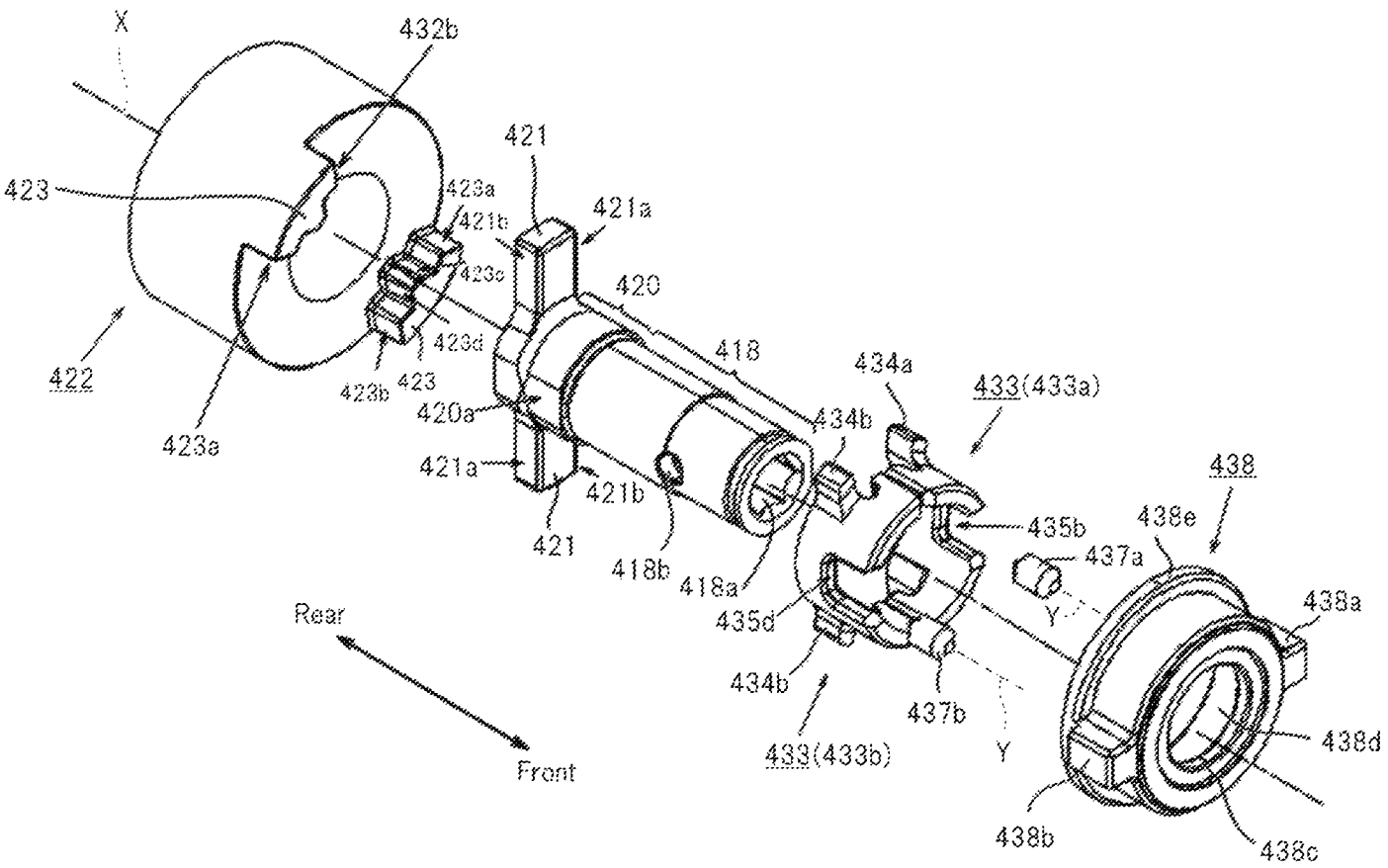
FIG. 25 is an exploded perspective view illustrating a vicinity of an impact portion of FIG. 22.

FIG. 25 is an exploded perspective view illustrating an assembly structure in the vicinity of an impact portion of FIG. 24. In the present embodiment, the fixing structure of a lock ring 438 holding a carrier 433 to be attached to the output shaft 418 is improved. The carrier 433 located on the inner circumferential side of the lock ring 438 is composed of two right and left independent members. In the anvil 420, two impact arms 421 that extend in radial directions are formed, and the anvil 420 and the output shaft 418 are integrally formed.

The locking mechanism is a mechanism for use in preventing the relative rotation of the anvil 420 to the main housing 402 and the lock ring 438. The locking mechanism includes a relief surface 420*a* formed on one portion of the anvil 420, the carrier 433, the lock ring 438 and two engaging pins 437*a* and 437*b*. The center lines Y of the engaging pins 437*a* and 437*b* are in parallel with the axis X. The two engaging pins 437*a* and 437*b* can be made in contact with the lock ring 438, the anvil 420 and the carrier 433.

The carrier 433 is used as a carrier member for use in releasing a locked state of the locking mechanism. The carrier 433 is composed of divided members 433*a* and 433*b* serving as two divided bodies. As illustrated in FIG. 27, the divided members 433*a* and 433*b* are members, each having a semi-cylindrical shape, divided laterally into two portions, along a dividing plane W serving as a border.

The hammer 422 is produced in an integral molding process of a metal so as to have a predetermined mass, and coupled to the spindle 428 via a cam mechanism. On the front side of the hammer 422, hammer claws 423 are formed on two portions in the circumferential direction. Each of the hammer claws 423, which is prepared as a protruding portion to form a second impact surface to be struck by the impact arm 421, protrudes so as to be extended forward, and is provided with an impact surface 423*a* in a forward rotation direction and an impact surface 423*b* in a reversed rotation direction that are respectively formed on two side faces in the circumferential direction. In the present specification, explanations will be given on the premise that the forward rotation direction refers to a direction in which, for example, a screw or a bolt is tightened, and the reverse rotation direction refers to a direction in which the screw or bolt is loosened. In each of the hammer claws 423 of the present embodiment, an impact surface 423*c* serving as a second impact surface formed on the inner circumferential side of the impact surface 423*a* is formed, and in the same manner, an impact surface 423*d* is formed on the inner circumferential side of the impact surface 423*b*. The second impact surface is prepared as a concave portion in the circumferential impact direction relative to the first impact surface. In this case, the hammer claw 423 may have not only a shape protruding in an axial direction relative to the hammer 422, but also a shape protruding in a radial direction, as well as a shape protruding in both of an axial direction and a radial direction.

The anvil 420, which is a member against which the hammer 422 is struck, is formed such that the output shaft 418 is connected to the tip side of the anvil 420, and these members are produced in an integral molding process. The anvil 420 is provided with two impact arms 421 formed on its cylindrical main body in a manner so as to extend in radial directions therefrom. The two impact arms 421 are formed at positions separated and opposed from each other by 180 degrees in the rotational angle, and the impact arms 421 are extended outward in the radial directions so as to be engaged with the hammer claws 423. Because of its characteristic as a member to be struck, each of the impact arms 421 has a square pillar shape in its shape extending from the anvil 420; however, it is not limited to this shape and the shape may be a column-shaped basic shape or another simple shape, as long as sufficient strength and durability are ensured. It is important for the each impact arm 421 to have two impact-subject surfaces prepared as planes or shapes corresponding to the impact surfaces, and one of the surfaces in the circumferential direction forms an impact-subject surface 421*a* in a forward direction, and the other surface in the circumferential direction forms an impact-subject surface 421*b* in the opposite direction. At each of two portions of the main body portion of the anvil 420 separated from each other by 180 degrees, a relief surface 420*a* is formed by shaving off one portion thereof into a plane.

On the periphery of the anvil 420 and the output shaft 418, the lock ring 438 is disposed. The main function of the lock ring 438 is to rotatably support the carrier 433. The carrier 433 is composed of two divided members 433*a* and 433*b*. The output shaft 418 is rotatably supported by a bearing mechanism placed near the lock ring 438, that is, by a bearing 229*a* of FIG. 24. At two portions departed from each other by 180 degrees in the radial direction of the lock ring 438, protruding portions 438*a* and 438*b* are formed. The protruding portions 438*a* and 438*b* correspond to first meshing portions. The protruding portions 438*a* and 438*b* are convex portions formed at the two portions departed from each other by 180 degrees in the circumferential direction of the lock ring 438. By fitting the protruding portions 438*a* and 438*b* into the concave portions 800 formed on the inner circumferential surface of the main housing 402, the lock ring 438 and the main housing 402 are prevented from relatively rotating centered on the axis X. The concave portions 800 are formed at two positions with a predetermined interval in the circumferential direction. The concave portions 800 correspond to second meshing portions.

With respect to the structure of the first engaging portion and second engaging portion that allow the lock ring 438 and the main housing 402 to relatively rotate within a predetermined angle range, the following structure may be used. That is, a concave portion may be formed on the lock ring 438 side, and a convex portion may be formed on the inner wall side of the main housing 402. Moreover, a concave portion and a convex portion may be formed on the lock ring 438, and a concave portion and a convex portion may be formed on the main housing 402.

The carrier 433 functions as a lock releasing member, and has a structure in which, after joining two divided members 433*a* and 433*b*, a substantially cylindrical shape is formed. However, in the present embodiment, a single carrier mechanism is achieved by the two divided members 433*a* and 433*b* formed by dividing a cylindrical member into two portions along a plane including the axial direction. The carrier 433 is disposed coaxially relative to the anvil 420, as well as on the outside of the anvil 420 in the radial direction. The carrier 433 is not fixed onto the anvil 420, but attached to the anvil 420 so as to be relatively shiftable (rotatable) within a predetermined angle range, coaxially relative to the anvil 420. The carrier 433 has a cylinder portion having an inner diameter that is substantially equal to an outer diameter of the cylindrical portion of the anvil 420. In this case, a gap is maintained in such an extent required for allowing the carrier 433 and the anvil 420 to relatively rotate. At two positions on the rear portion of the cylinder portion of the carrier 433, concave portions (second cut-out portions) are formed. Moreover, on the carrier 433, protruding portions 434*a* and 434*b*, which protrude in radial directions from two edges in the circumferential direction (two ends) of each concave portion, are also formed. The gap between the protruding portions 434*a* and 434*b* is designed to be slightly wider than the width in the radial direction of the impact arm 421. In the present embodiment, since the two impact arms 421 are formed outward from the positions departed from the column-shaped pillar portion of the anvil 420 by 180 degrees, the protruding portions 434*a* and 434*b* are formed at the total four positions, that is, the positions opposed to the respective impact-subject surfaces 421*a* and 421*b*.

The protruding portions 434*a* and 434*b*, which are contacted by the impact surfaces 423*c* and 423*d* newly added to the hammer 422, make it possible to change the relative position of the carrier 433 to the anvil 420, by being struck by the impact surfaces 423*c* and 423*d*. However, the rotational angle is about −10 or +10 degrees. At a position of the carrier 433 opposed to the relief surface 420*a*, each of the cut-out portions 435*b* and 435*d* is formed. The cut-out portions 435*b* and 435*d* are formed to define spaces that house the engaging pins 437*a* and 437*b*.

The inner circumferential side of each of the spaces is covered with the relief surface 420*a* of the anvil 420, and the outer circumferential side of the space is covered with the cylinder portion 438*d* of the lock ring 438. The front side of the space is covered with an inward flange 438*c* of the lock ring 438, and the rear side and the two edges in the radial direction of the space are covered with the wall portions of the cut-out portions 435*b* and 435*d*. The inward flange 438*c* is formed into an annular shape on one end of the cylinder portion 438*d* of the lock ring 438.

In this manner, the engaging pins 437*a* and 437*b* are disposed in the spaces formed by using the cut-out portions 435*b* and 435*d*, and are allowed to revolve in a manner so as to follow the rotation of the anvil 420. When the relative position between the anvil 420 and the carrier 433 slightly deviates in a radial direction upon the stoppage of the motor 404, the engaging pins 437*a* and 37*b* function as a locking mechanism for limiting the relative rotation of the anvil 420 and the lock ring 438. This locking function will be described later in detail.

FIG. 26 is an enlarged partial cross-sectional view illustrating the vicinity of the lock ring 438 of FIG. 24. The carrier 433 is disposed between the hammer 422 and a bearing 429*a* in a direction along the axis X. One portion of the layout position of the carrier 433 is overlapped with the layout position of the anvil 420. The tip of the carrier 433 has its front end side limited by the inward flange 438*c* of the lock ring 438, and its outer circumferential side is held by the cylinder portion 438*d*, with its inner circumferential side being held by the outer circumferential surface of the anvil 420. In the vicinity of the center on the rear end side of the anvil 420, a fitting hole 420*b* having a column shape is formed, and in this hole, a fitting axis 428*a* formed on the tip of the spindle 428 is housed.

In this manner, since the rear end of the anvil 420 and the front end of the spindle 428 are rotatably supported thereon, it becomes possible to achieve an impact mechanism 419 having high rigidity. The lock ring 438 has a structure in which the inward flange 438*c* is formed on the inside of the front side of the cylinder portion 438*d*, and on the rear side of the cylinder portion 438*d*, an outward flange 438*e* is formed on the outside on the rear portion of the cylinder portion 438*d*. The outward flange 438*e* is formed into an annular shape on the other end of the cylinder portion 438*d*. Although the lock ring 438 is fixed to the main housing 402, the engaging pins 437*a* and 437*b* are allowed to revolve centered on the rotation axis together with the anvil 420, when driven by the motor 404, as illustrated in FIG. 25. A convex portion or the like is preferably formed on the tip of each of the engaging pins 437*a* and 437*b* in the axial direction so as to prevent the frictional resistance of the carrier 433 relative to the lock ring 438 from becoming too high.

On the front side of the lock ring 438, a bearing 429*a*, such as a ball bearing or the like, is formed. The bearing 429*a* rotatably holds the output shaft 418, and the inner circumferential surface of the bearing 429*a* is made in contact with the output shaft 418, with the outer circumferential surface of the bearing 429*a* being held on the inner wall portion of the main housing 2. On the outside in the radial direction of the lock ring 438, two screw bosses 430*a* and 430*b* are formed. In the present fourth embodiment, such a positional relationship is prepared in which, when viewed in the axial direction, the screw bosses 430*a* and 430*b* are completely or partially included within a range in which the lock ring 438 is disposed.

That is, supposing that in a direction along the axis X, the length of the lock ring 438 is "L" in the drawing, the screw bosses 430*a* and 430*b* corresponding to fixed positions by the screws are disposed so as to be overlapped and included within the range of the length L when viewed in the axial direction. As a result, the lock ring 438, which is sandwiched by the main housing 402 to be divided to right and left members, can be maintained with high precision, and the lock ring 438 can be firmly fixed and can also be fixed so as to be relatively rotatable within a predetermined angle, depending on the dimension of the main housing 402. Moreover, the outer circumference of the lock ring 438 in the radial direction is advantageous for use in forming the screw bosses 430*a* and 430*b* from the viewpoint of spaces.

On the inner side of the tip of the output shaft 418, a mounting hole 418*a* having a hexagonal shape in its cross section, to which a tip tool is inserted, is formed vertically to the axial direction, with a mounting portion 440 for the tip tool being formed on the outer circumferential side of the tip. On the side face of the output shaft 418, a through hole 418*b* that houses balls 443 so as to be movable therein is formed, and it is formed in such a shape as to prevent the balls 443 from coming off and falling on the inner circumferential side from the through hole 418*b*. The outside in the radial direction of the balls 443 is held by a sleeve 441 that is energized thereon by a spring 444. The front side of the spring 444 is fixed by a washer 442, and the washer 442 is held by a C-ring 445 so as not to move in the axial direction. Upon attaching or detaching a tip tool to or from the output shaft 418, the sleeve 441 is moved frontward in the axial direction from the normal position illustrated in FIG. 26 against the energizing force of the spring 444, so that the attaching or detaching operation is carried out. When the sleeve 441 is moved frontward, the outer circumferential portion of each of the balls 443 is released from an abutting state with a convex surface that is formed on the inner circumferential side of the sleeve 441 and continues in the circumferential direction, with the result that the balls 443 become slightly movable outward in the radial direction, therefore, it is possible to carry out the attaching and detaching processes of the tip tool without any resistance.

FIG. 27 is a cross-sectional view at the A-A portion of FIG. 26. A feature of the present fourth embodiment lies in that the lock ring 438 has not a structure in which the lock ring 438 is directly fixed onto the housing with screws, but a structure in which the lock ring 438 is sandwiched by the main housing 402. Although the carrier 433 has a cylindrical shape as its basic structure, it is designed in the present embodiment to have a shape formed by dividing the cylindrical member into two portions along a plane including the axial direction, that is, dividing planes are located near arrows C and D. In the initial stage of developments, the inventors designed so that the divided members 433*a* and 433*b* were integrally molded into a one unit, with the lock ring being directly fixed onto the main housing. However, after carrying out tests on this structure, it was found out that problems might be highly possibly caused during operations. Prior to explaining features of the present embodiment, the following description will explain circumstances upon occurrence of these problems, with reference to FIGS. 32A and 32B.

Figure 32A:
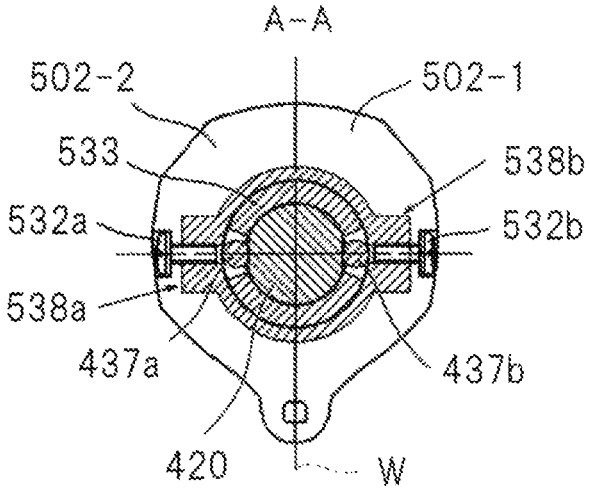
FIG. 32A is a cross-sectional view illustrating a structure in the case when the lock ring is fixed to a housing with screws, and also is a cross-sectional view of a portion corresponding to the A-A portion of FIG. 26.
Figure 32B:
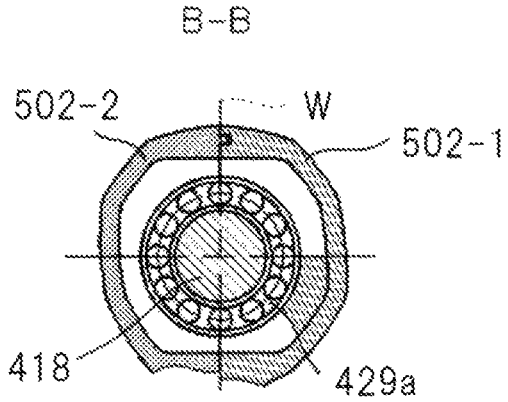
FIG. 32B is a cross-sectional view illustrating a structure in the case when the lock ring is fixed to a housing with screws, and also is a cross-sectional view of a portion corresponding to the B-B portion of FIG. 26.

FIGS. 32A and 32B are cross-sectional views illustrating a structure in which the lock ring is fixed onto the housing with screws, in which FIG. 32A is a cross-sectional view corresponding to the A-A portion of FIG. 26, and FIG. 32B is a cross-sectional view corresponding to the B-B portion of FIG. 26. In the initial stage of developments, the inventors designed so that a carrier 533 is formed into an integral shape, that is, a shape in which the divided members 433*a* and 433*b* illustrated in FIG. 25 are joined into one integral unit, and a lock ring 538 is fixed onto a housing 502 with two screws 532*a* and 532*b*. The housing 502 is composed of two divided members, that is, a structural member 502-1 on the left side and a structural member 502-2 on the right side. The structural members 502-1 and 502-2 are divided into two members along a division surface W serving as a border, and the structural member 502-1 and the structural member 502-2 are fixed to each other.

In this case, the lock ring 538 is provided with two protruding portions 538*a* and 538*b* that protrude outward in radial directions, and female screw holes are formed thereon respectively. The lock ring 538, which is fixed by the two screws 532*a* and 532*b*, also serves as a fixing member for fixing the structural members 502-1 and 502-2. In FIG. 31B, in the same manner as in the example illustrated in FIG. 24, a bearing 429*a*, such as a ball bearing or the like, is installed.

After operation experiments carried out by the inventors on this structure, it is found that the following problems are raised. Although the lock ring 538 is firmly fixed with the two screws 532*a* and 532*b*, the bearing 429*a* holding the output shaft 418 is supported by the inner wall of the housing 502. In this structure, however, in the case when an axial deviation occurs in the lock ring 538 due to a certain problem in machining precision, assembling precision or the like, the carrier 533 might be biased to cause the subsequent malfunction in the locking mechanism in such a case. For example, since the carrier 533 is supported on the anvil 420, with a gap being located between the carrier 533 and the lock ring 538, the deviation in precision of the anvil 420 tends to cause a deviation in the carrier 533.

Therefore, in the present embodiment, as illustrated in FIG. 27, such a structure is prepared in which the carrier 433 is divided so as to be composed of two divided members 433*a* and 433*b*, and the lock ring 438 is designed so as to be maintained somewhat loosely relative to the structural members 402-1 and 402-2. On the inside of the structural member 402-1 on the left side and the structural member 402-2 on the right side, and near portions at which the protruding portions 438*a* and 438*b* are opposed to each other, concave portions 405*a* and 405*b*, each having a square shape in its inner side cross section, are formed. The inner side shape of the concave portions 405*a* and 405*b* is formed into substantially the same shape as the substantially square shape of each of the protruding portions 438*a* and 438*b*; however, as illustrated in FIG. 27, they are maintained in a somewhat loosened manner so as to provide a predetermined gap between them. In FIG. 27, for better understanding of the present invention, the gap is illustrated in an enlarged manner.

In this case, the right and left structural members 402-1 and 402-2 are fixed with two screws 432*a* and 432*b*. Therefore, the lock ring 438 is simply sandwiched by the right and left structural members 402-1 and 402-2, and does not have to exert a function as a member for fixing the right and left structural members 402-1 and 402-2. As a result, it is possible to correctly center-align the lock ring 438 relative to the output shaft 418 held by the bearing 429*a*.

Moreover, since the carrier 433 is also designed to be composed of two divided members 433*a* and 433*b*, an aligning deviation hardly occurs, thereby it is possible to smoothly operate the two divided members 433*a* and 433*b* relative to the anvil 420 and the output shaft 418. Additionally, in the present embodiment, the outside shape of the protruding portions 438*a* and 438*b* is formed into substantially a square pillar shape; however, this may be formed into a column shape, a polygonal shape, or another desired shape. In this case, it is important to form the inside shape of each of the concave portions 405*a* and 405*b* into a shape corresponding to that of each of the protruding portions 438*a* and 438*b*, and it is also important to form them in a somewhat loosened manner so as to provide a predetermined gap between them.

The two screws 432*a* and 432*b* are disposed outside from the lock ring 438 in the radial direction centered on the axis X, as well as at such positions as to be overlapped with the layout position of the lock ring 438 in the direction along the center line X. The protruding directions of the protruding portions 438*a* and 438*b* from the outer circumferential surface of the lock ring 438 are in parallel with a tightening direction Z of the two screws 432*a* and 432*b*. The protruding direction of the protruding portions 438*a* and 438*b* from the outer circumferential surface of the lock ring 438 is a direction at a right angle to the division surface W.

Figure 28:
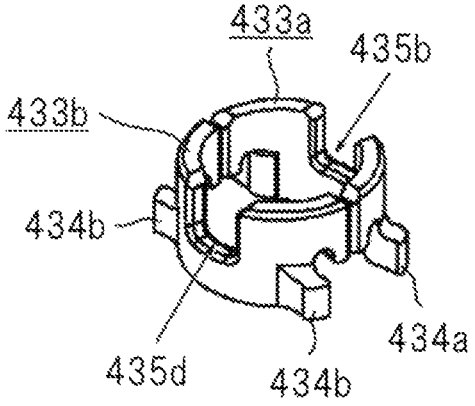
FIG. 28 is a perspective view illustrating a shape of divided members of FIG. 25.

FIG. 28 is a perspective view illustrating the shape of the two divided members 433*a* and 433*b* constituting the carrier 433 of FIG. 25. The carrier 433 has a cylindrical shape as its basic shape; however, in the present embodiment, it has a shape divided along a plane in parallel with the axial direction. The carrier 433 is composed of two divided members 433*a* and 433*b* formed with a division surface W including the axis X of the output shaft 418 as a border. The two divided members 433*a* and 433*b* are jointed to form the single carrier 433. In the case when both of the two divided members 433*a* and 433*b* are designed to have plane-symmetric, or rotation-symmetric shapes, since they are used for either right or left side, the two of the same parts can be used as a pair, thereby making it possible to reduce the production costs.

Figure 29A:
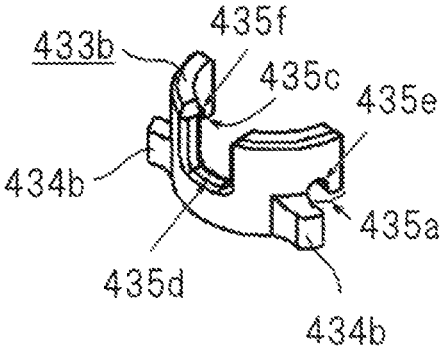
FIG. 29A is a perspective view illustrating a single unit of the divided members of FIG. 25.
Figure 29B:
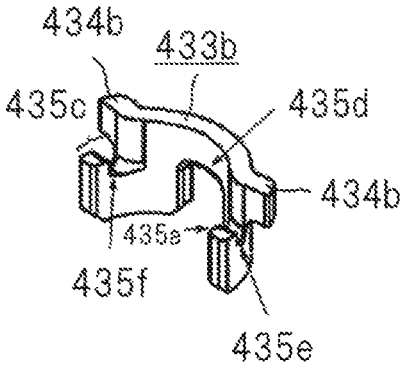
FIG. 29B is a perspective view illustrating a single unit of the divided members of FIG. 25.

FIGS. 29A and 29B are views illustrating the shape of the member 433*a* as a single member; and FIG. 29A is a perspective view in which it is viewed from the outside in the radial direction, and FIG. 29B is a perspective view in which it is viewed from the inside in the radial direction. The divided member 433*a*, which has a semi-cylindrical shape as its basic shape, is provided with a cut-out portion 435*b* for housing an engaging pin 437*a* formed near substantially the center in the circumferential direction of the semi-cylindrical shape. Protruding portions 434*a* are respectively formed on two edges in the circumferential direction thereof. The protruding portions 434*a* are formed into such shapes as to be formed by separating the cut-outs 435*a* and 435*c* and bending them so as to protrude outward in the radial direction, with the result that the cut-out portions 435*a* and 435*c* are formed so as to be adjacent to the protruding portions 434*a*. The cut-out portions 435*a* and 435*c* form a space through which the impact arm 421 penetrates. On the cut-out portions 435*a* and 435*c*, holes 435*e* and 435*f*, each having substantially a round shape, are formed. These holes 435*e* and 435*f* are formed so as to prevent damages from being given to the divided member 433*a*, caused by a stress applied to the protruding portion 434*a*, which is concentrated on a specific portion of the protruding portion 434*a*, that is, in the vicinity of the connection portion between the cut-out portions 435*a* and 435*c*, and by allowing each of the holes 435*e* and 435*f* to have an R shape with an appropriate curvature radius R, the stress to be applied to transition portions from the protruding portions 434*a* and 434*b* to the cut-out portions 435*a* and 435*c* can be appropriately dispersed.

Figure 30:
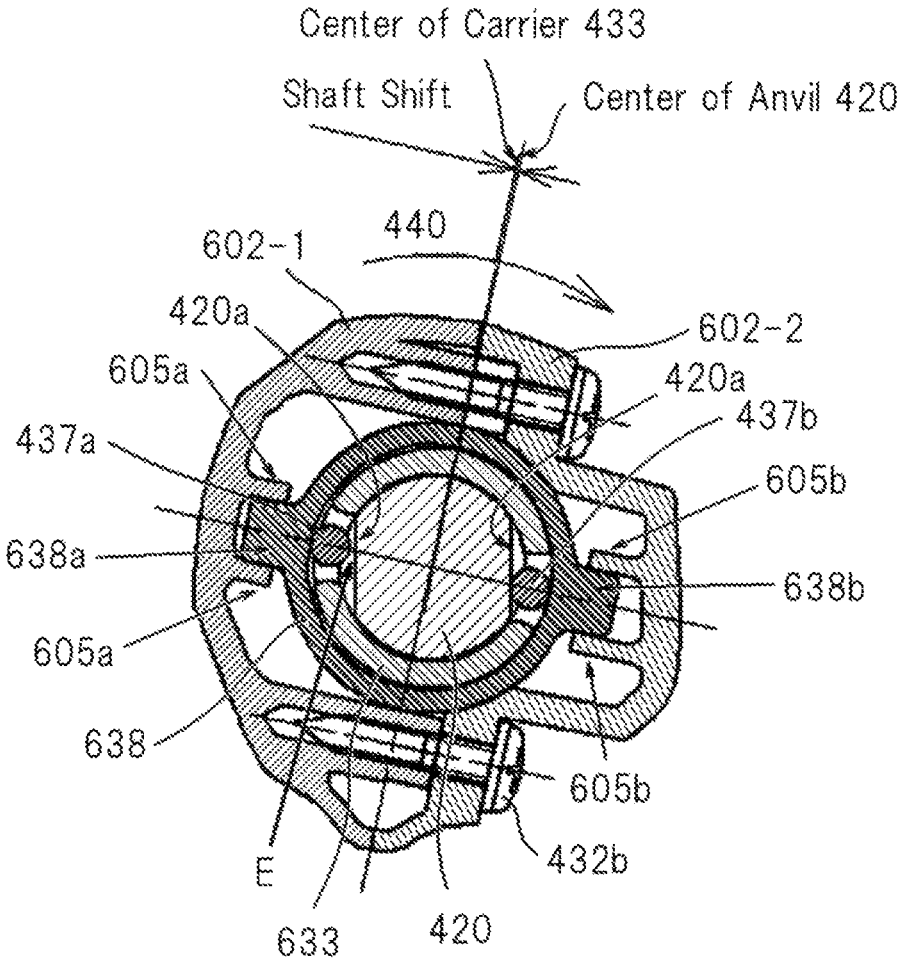
FIG. 30 is a diagram illustrating a state at the moment when a manual fastening job is carried out upon stoppage of the impact tool in accordance with the embodiment of the present invention, and also is a cross-sectional view of a position corresponding to the A-A portion of FIG. 26.

FIG. 30 is a diagram illustrating a state in the case when at the stoppage of the impact tool 401, a manual fastening job is carried out, and corresponds to a cross-sectional view illustrating the A-A portion of FIG. 26. FIG. 30 explains problems that might occur when a carrier 633 is formed into an integral product. When the worker rotates the main housing 402 with the hand as indicated by an arrow 640, the engaging pins 437*a* and 437*b* are rotated in the same direction, with the result that the contact position between the engaging pins 437*a*, 437*b* and the relief surface 420*a* is changed. As a result, the rotation of the anvil 420 relative to a lock ring 638 is blocked to form a locked state. Referring to FIG. 31, the following description will explain the principle that leads to this locked state.

Figure 31A:
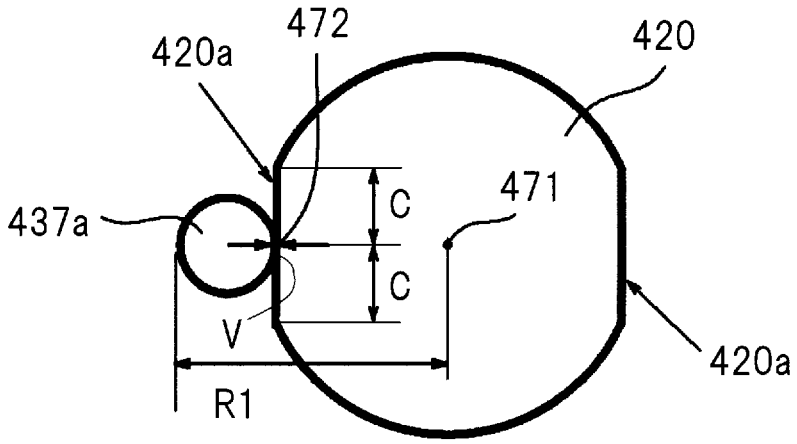
FIG. 31A is a diagram for explaining a positional relationship between the anvil and an engaging pin taken along an A-A cross-sectional position of FIG. 26.
Figure 31B:
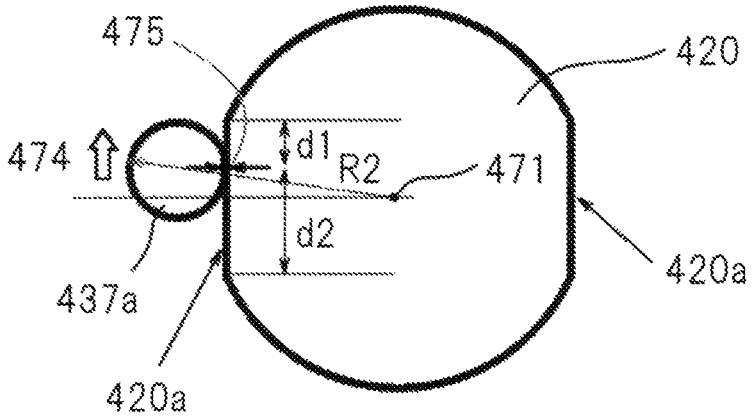
FIG. 31B is a diagram for explaining a positional relationship between the anvil and the engaging pin taken along the A-A cross-sectional position of FIG. 26.

FIGS. 31A to 31B are schematic views describing a positional relationship between the anvil 420 and the engaging pin 437*a* at the A-A cross-sectional position of FIG. 26. The shapes and sizes are not necessarily illustrated correctly. In the case when the hammer 422 is being rotated by the motor 404, since the anvil 420 is rotated in a manner so as to allow the impact surface 423*a* of the hammer claw 423 to push the impact-subject surface 421*a* of the impact arm 421, the anvil 420 and the engaging pin 437*a* are rotated, while maintaining a positional relationship (lock releasing position) of FIG. 31A. When the output shaft 418 is kept rotatable, the position of the engaging pin 437*a* relative to the relief surface 420 of the anvil 420 forms a lock releasing position.

In this positional state, the engaging pin 437*a* is located substantially in the center in the vertical direction (circumferential direction) of the relief surface 420*a*. That is, supposing that the width in the vertical direction (circumferential direction) of the relief surface 420*a* is 402*c*, the contact point 472 between the anvil 420 and the engaging pin 437*a* is located at a position with a distance "c" from above as well as with a distance "c" from below. That is, the contact point 472 is positioned in the center position V of the relief surface 420*a*. In this state, the farthest distance from the rotation center 471 to the outer circumferential surface of each of the engaging pins 437*a* and 437*b* is indicated by R1. R1 is represented as follows.

$R1$=(Radius of the anvil 420)−(Cut-out amount of the relief surface 420*a*)+(Diameter of the engaging pin 437*a*)

In the present embodiment, by setting R1 smaller than the inner diameter of the cylinder portion 438*d* of the lock ring 638 serving as the rocking member, the engaging pin 437*a* is kept free from limiting the rotation of the anvil 420 and the carrier 633. Additionally, the rotation of the anvil 420 is locked, even in the case of the loosening process in addition to the tightening process of a screw or the like by rotating the impact tool 401 itself.

In FIG. 31B, when the worker rotates the housing 601-1, 601-2 by the hand so that the anvil 420 is rotated relative to the lock ring 638, the engaging pins 437*a* is brought into the same positional relationship as that in which it is relatively moved in a direction of an arrow 474. As a result, the position at which the engaging pin 437*a* and the relief surface 420*a* are made in contact with each other is moved from a contact point 472 of FIG. 31A to a contact point 475 of FIG. 31B. That is, the contact position 475 is located at a position that is out of the center position V of the relief surface 420*a*.

As a result, the farthest distance from the rotation center 471 of the anvil 420 to the outer circumferential surface of the engaging pin 437*a* is changed from R1 to R2 of FIG. 31A. As can be understood from the Drawings, with respect to R2, a positional relationship of R1<R2 is satisfied so that by setting the size of the inner diameter Rc of the lock ring 638 so as to satisfy a relationship of R1<Rc<R2, the engaging pin 437*a* is allowed to intrude between the lock ring 638 and the end portion of the relief surface 420*a* of the anvil 420 by the change in the relative positional relationship of the engaging pin 437*a* as illustrated in FIG. 31B, and the lock ring 638 and the anvil 420 are formed into an integral unit and allowed to function as a locking mechanism for the output shaft 418.

That is, in the case when the worker rotates the impact tool 401 in no operation, since the rotation of the anvil 420 is kept in a locked state, it is possible to effectively carry out a manual fastening job. When the output shaft 418 is unrotatable, the position of the engaging pin 437*a* relative to the relief surface 420*a* of the anvil 420 is kept in the locked position.

Now, reference is again given to FIG. 30. In the example of FIG. 30, the lock ring 638 and the housings 602-1 and 602-2 are fixed so as not to rotate relatively. That is, concave portions 605*a* and 605*b* formed on the inner walls of the housings 602-1 and 602-2 are fixed in firmly fitted states with convex portions 638*a* and 638*b* of the carrier 633. In this case, an axial deviation between the rotation center of the carrier 633 and the rotation center of the anvil 420 tends to occur, and when the axial deviation is large, as shown by a portion indicated by an arrow E in FIG. 30, the engaging pin 437*a* might be separated from one of the relief surfaces 420*a*. In such a case, the locked state is kept only by the engaging pin 437*b* that is made in contact with the other relief surface 420*a*, with the result that a force twice as high as normal is undesirably applied onto the engaging pin 437*b* side.

Therefore, in the present embodiment, the concave portion formed on the inner surface of the housing and the convex portion formed on the carrier are not firmly fixed to each other, and as illustrated in FIG. 27, a gap in the circumferential direction is formed between the concave portion and the convex portion. By fixing the lock ring 438 loosely to the main housing 202, among the engaging pin 437*a* and the engaging pin 437*b*, only one of the engaging members is first locked. Then, since the locked engaging member pushes the lock ring 438 outward, the other engaging member comes close to the lock ring 438 so that both of the engaging members are locked. That is, the lock ring 438 is automatically moved in such a manner as to make the shaft center of the lock ring 438 in contact with the shaft center of the output shaft 418; thus, a so-called automatic shaft-center adjusting effect can be obtained. As a result, even if an axial deviation of the carrier 433 or a shaft deviation between the output shaft 418 and the lock ring 438 occurs, the resulting influence is not transmitted to the engaging pin 437*a*, 437*b* side so that it is possible to effectively prevent a rotation failure and a locking failure.

As described above, in the present embodiment, when a manual fastening job is carried out by rotating the impact tool 401 after stopping the motor 404, the anvil 420 is locked to be unrotatable relative to the lock ring 438 by a function of the lock ring 438, so that an output shaft locking function is achieved; therefore, even in the case of a power tool for carrying out an impact fastening process, a manual fastening job can be easily carried out. Moreover, even in the case when jobs are shifted from the fastening job by using a driving source to the manual fastening job, no special operations, such as a pulling operation of a lever or the like by the worker, are required at all, and it is only necessary to simply rotate the impact tool 401, so that a power tool that is really convenient for use can be achieved. Furthermore, even in the case when, after completion of this manual fastening job, a fastening process for the next screw is carried out, the motor 404 is rotated by simply pulling the trigger 406, and in this case, since no attempt for a switchover between the manual fastening job by the using of the output shaft lock and the fastening job by the use of the motor 404 is required, it is possible to achieve a power tool that is really convenient for use can be achieved.

Embodiment 5

Figure 33:
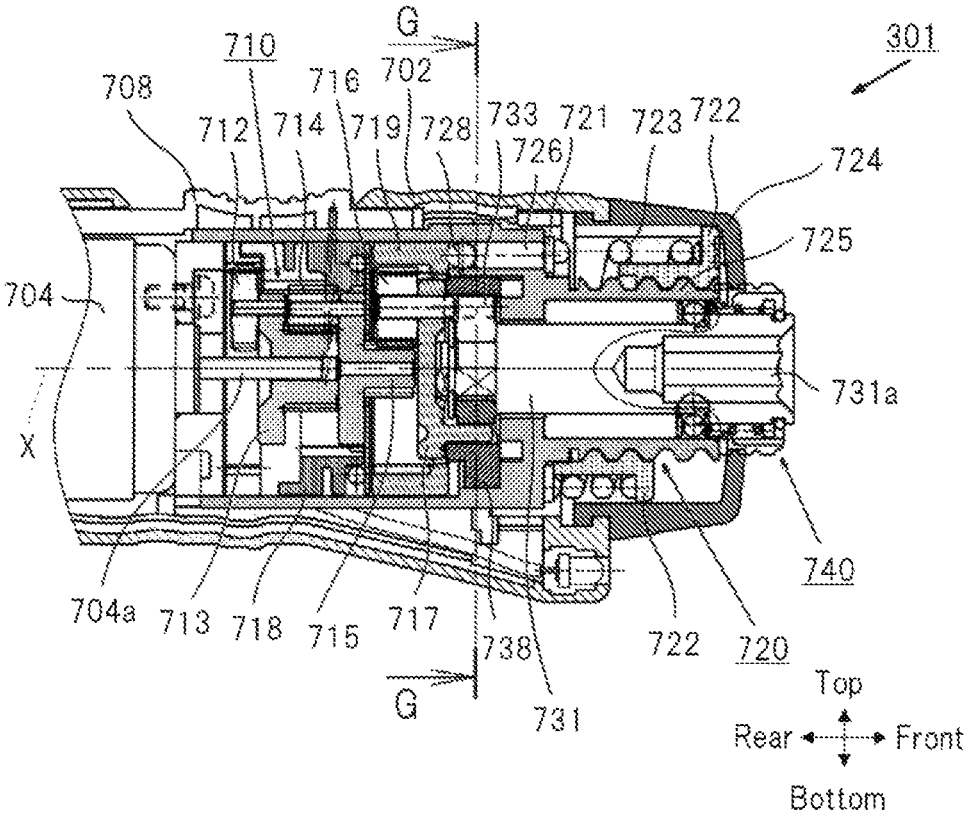
FIG. 33 is a partial cross-sectional view illustrating an inner structure of a main housing of a driver drill in accordance with a fifth embodiment of the present invention.
Figure 34:
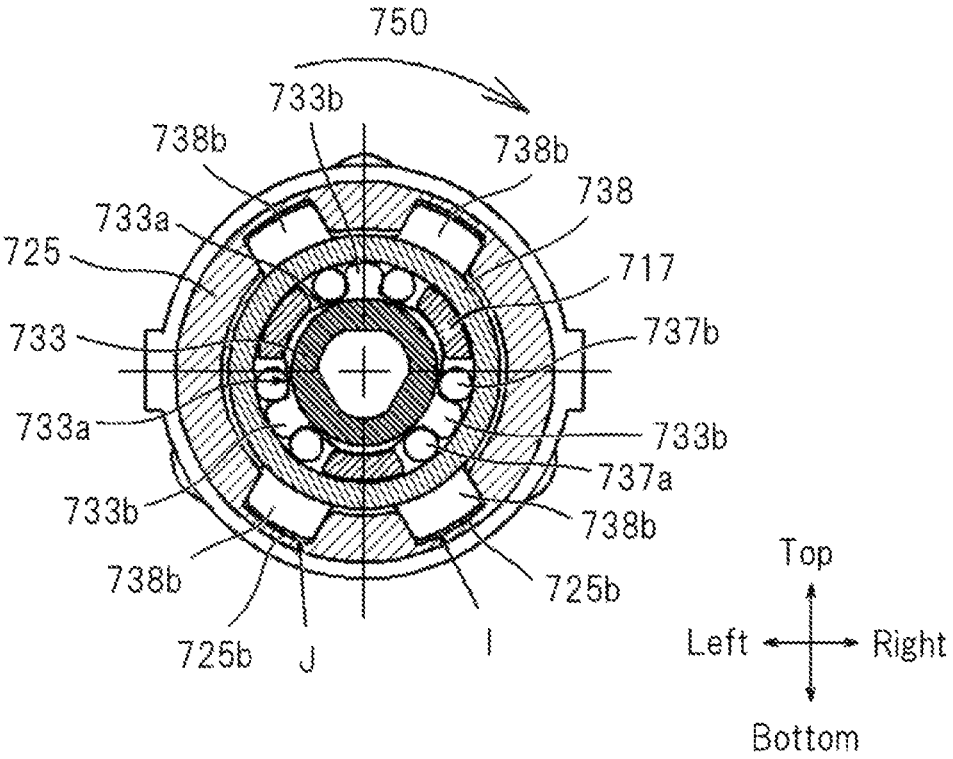
FIG. 34 is a cross-sectional view illustrating a G-G portion of FIG. 33.

Referring to FIGS. 33 and 34, the following description will explain a fifth embodiment of the present invention. FIG. 33 is a diagram illustrating an example in which a locking mechanism according to the present invention is applied to a driver drill 701. FIG. 33 is also a cross-sectional view illustrating a tip of an electric tool (driver drill 701) relating to the second embodiment. The driver drill 701, which has a motor 704, is provided with a main housing 702 that houses the motor 704 inside thereof, a reducer mechanism unit 710 that decelerates the rotation speed of the motor 704 at a predetermined reducing speed ratio, a clutch mechanism 720 installed on the front side of the reducer mechanism unit 710, and an output shaft 731 that extends to the front side of the clutch mechanism 720. A mounting unit 740 for use in attaching a tip tool is formed on the tip side of the output shaft 731, and a hexagonal hole 731*a* having a hexagonal shape in its cross section is formed on the inner side portion thereof. As the motor 704, the same motor as the motor 404 used in the first embodiment may be used, and the structure on the rear side from the motor 704 is formed into the same structure as that of the first embodiment.

The reducer mechanism unit 710, which multi-stage-reduces the input of the rotation of the motor 704 at a predetermined ratio by a planetary gear mechanism, transmits the resulting input to the clutch mechanism 720, and for example, this structure uses a three-stage-type planetary gear. To the rotation shaft 704*a* of the motor 704, a first planetary gear 713 serving as a first pinion is attached so that the first planetary gear 712 is rotated by the first planetary carrier 713. On the outer circumferential side of the first planetary carrier 713, a second planetary gear 714 rotates. The second planetary gear 714 is held by a second planetary carrier 715. On the periphery of the second planetary gear 714, a third planetary gear 716 rotates. The third planetary gear 716 is connected to a third planetary carrier 717 which is connected to a fitting axis on the rear side of the output shaft 731 that is disposed on the front side. The third planetary carrier 717 corresponds to a carrier member.

In this case, on the connection portion between the output shaft 731 and the third planetary carrier 717, a socket 733 having a substantially cylindrical shape and a plurality of pins 737*a* and 737*b*, each having a substantially column shape, are disposed on the same axis of those. The pins 737*a* serve as first engaging members, and the pins 737*b* serve as second engaging members. In this manner, since the three-stage-type planetary gear reducer mechanism is used as the reducer mechanism unit 710, it is possible to transmit a sufficient tightening torque to the output shaft 731 even when the output of the motor 704 is comparatively small. Moreover, a high-speed/low-speed switching mechanism is installed in the reducer mechanism unit 710 so that by using its operation lever 708, a ring gear 718 can be shifted forward/rearward so that the reducing speed ratio can be altered.

On the front side of the reducer mechanism unit 710, the clutch mechanism 720, which releases the rotation transmission between the reducer mechanism unit 710 and the output shaft 731 when a predetermined load torque is applied to the tip tool, is installed. The clutch mechanism 720 includes one portion of a gear case 725 formed into a cylindrical shape, a pressing dial nut 722 formed on the front-side outer circumferential portion of the gear case 725, a spring 723, and a clutch ring 721 that is energized by the spring 723. The gear case 725 corresponds to a case. Moreover, the clutch mechanism 720 includes a pin 726 that extends rearward through a through hole of the gear case 725 from the clutch ring 721, and balls 728 placed on the rear side of the pin 726. The gear case 725 is installed inside the main housing 702.

Moreover, the clutch mechanism 720 includes a concave portion (clutch claw), not illustrated, formed on the front side of the ring gear 719 and a dial 724 for use in adjusting the size of a load torque to be caused upon releasing the rotation transmission between the reducer mechanism unit 710 and the output shaft 731. The dial 724 has several keys (protrusions) formed inside thereof, which extend inward in the axial direction, and by allowing the keys to be fitted to grooves formed at several positions in the axial direction of the dial nut 722, the dial nut 722 can be rotated. The dial 724 may be produced by using a resin such as a plastic material.

Threads (male threads) are formed on the outer circumferential portion on the front half side of the gear case 725, and onto the outer circumferential side of the gear case 725, the cylinder-shaped dial nut 722, with threads to be engaged with the thread portion formed on the inner circumferential side thereof, is attached. Between the protruding portion in the radial direction on the front end of the dial nut 722 and the clutch ring 721, the coil spring 723 is formed. As a screw tightening process proceeds to cause the load applied to the output shaft 731 to exceed the pressing force of the spring 723 that presses the fixed state of the ring gear 718 serving as a fixed gear, the concave portion (clutch claw), not illustrated, formed on the front side of the ring gear 718 pushes the ball 728 and the clutch ring 721 forward so that the fixed state of the ring gear 718 is released to cause the ring gear 718 to rotate. The rotation of the ring gear 718 brings a state in which the rotation force from the motor 704 is not transmitted to the output shaft 731 so that the clutch mechanism 720 is activated.

The size of the load torque at the moment when the rotation transmission between the reducer mechanism unit 710 and the output shaft 731 is released upon activation of the clutch mechanism 720 may be adjusted by rotating the dial 724. Note that, in FIG. 33, for easiness of understanding on the structure, the dial nut 722 is illustrated in a divided manner on the upper side and the lower side of the axis X. However, actually, the dial nut 722 is a member having a cylindrical shape in which the upper side and the lower side of the axis X are continuously connected. In FIG. 33, the upper side from the axis X corresponds to a cross section illustrating a state in which the dial nut 722 is loosened to the maximum level to cause the torque capacity of the clutch mechanism 720 to be minimized. That is, the clutch mechanism 720 is in an OFF state in which no torque is transmitted. In contrast, the lower side from the axis X corresponds to a cross section illustrating a state in which the dial nut 722 is tightened to the maximum level to cause the torque capacity of the clutch mechanism 720 to be maximized. That is, the clutch mechanism 720 is in an ON state capable of transmitting a torque.

FIG. 34 is a cross-sectional view taken along a G-G portion of FIG. 33. The rotation force generated by the motor 704 is transmitted to the third planetary carrier 717 through the reducer mechanism unit 710. By synchronously rotating the third planetary carrier 717, a socket 733 placed on the outer circumferential side on the rear end portion of the output shaft 731, that is, on the inner circumferential side of the third planetary carrier 717, is rotated. A fitting axis (not illustrated) having a square shape in its cross section is formed on the rear end of the output shaft 731, and the square-shaped hole formed on the socket 733 is fitted to the fitting axis. Moreover, by fitting a stop ring to the output shaft 731 on the rear side of the socket 733, the socket 733 is held so as not to be shifted rearward.

In the case when the socket 733 is rotated, between the third planetary carrier 717 and the output shaft 731, by synchronously rotating the output shaft 731 via a plurality of convex portions 733*b* formed on the socket 733 and pins 737*b* disposed so as to form the rear side upon rotation in a forward rotation direction, the driving force is transmitted to the tip tool such as a chuck. Here, the pin 737*a* serving as the first engaging member disposed on the front side of the convex portions 733*b* when viewed in the rotation direction is rotated while being pressed by the convex portions 733*b*.

In the circumferential direction of the socket 733, relief surfaces 733*a* are formed on the two sides of each of the convex portions 733*b*. In the radial direction of the lock ring 738, the distance between each relief surface 733*a* and the inner circumferential surface of the lock ring 738 becomes greatest. The lock ring 738 has a cylindrical shape and the inner circumferential shape of the lock ring 738 is formed into a true circle. In the case when both of the pins 737*a* and 737*b* are rotated while being made in contact with the two side of each convex portion 733, since the pins 737*a* and 737*b* are located in the center of the relief surface 733*a*, they do not intervene with the relative rotations of the output shaft 731 and the lock ring 738.

When, after the motor 404 has been stopped, the worker manually rotates the main housing 702 in a direction of an arrow 750 relative to the tip tool so as to carry out a manual fastening job, the socket 733 is relatively moved in a direction opposite to the arrow 750 by the rotation force from the tip tool side. At this time, although the pin 737*a* on the front side in the rotation direction is not moved relative to each convex portion 733*b*, the pin 737*b* on the rear side is moved, while being pressed by the convex portion 733*b*, and is consequently kept located in the center of the relief surface 733*a*. As a result, the set position of the pin 737*a* on the front side relative to the convex portion 733*b* is changed; therefore, based upon the same principle as described with reference to FIGS. 31A and 31B, the three pins 737*a* on the front side in the circumferential direction are sandwiched between the lock ring 738 and the socket 733. The distance of this gap is smaller than the outer diameter of each pin 737*a*. Consequently, by a frictional force exerted between the inner diameters of the pin 737 and the lock ring 738, the lock ring 738 and the output shaft 731 is brought into a locked state. In the second embodiment, four protruding portions 738*b* that protrude outward in the radial direction are formed on the lock ring 738, and the protruding portions 738*b* are held in the concave portions 725*b* formed on the inner circumferential side of the gear case 725. Here, the protruding portions 738*b* are not firmly fixed to the concave portions 725*b*, but are fitted thereto with a gap in the radial direction and/or in the circumferential direction as indicated by arrows J and I in the drawing. In this manner, by providing the gap, the lock ring 738 can be correctly center-aligned relative to the socket 733, the output shaft 731 and the third planetary carrier 717. Therefore, the lock ring 738 can be smoothly operated. Additionally, in FIG. 34, the arrows J and I are only given to the concave portions 725*b* on the lower side; however, on the upper side as well, the fitting process is carried loosely, with slight gaps being provided. In FIG. 34, for easiness of understanding on the present invention, the gaps indicated by the arrows J and I are illustrated slightly larger than the actual sizes. However, in the actual product, it is sufficient to provide such a minimal gap as to be required for solving the center deviation problem in the conventional structure as described with reference to FIG. 32.

In this manner, the fixing method for the lock ring 738, the main housing 702 and the gear case 725 can be improved. The lock ring 738 constitutes a locking mechanism between the output shaft 731 and the third planetary carrier 717. With this arrangement, upon driving by the use of the motor, the rotation of the output shaft 731 is not intervened, and upon a manual fastening process, the lock ring 738 is smoothly operated so that a power tool that is superior in durability can be provided.

According to the present invention, the locking member that can be made in contact with the first engaging member and the second engaging member is installed on the periphery of the output shaft so as to finely move in the radial direction of the output shaft so that, when the housing is rotated with the output shaft being fixed, the locking member is made in contact with the first engaging member and the second engaging member to allow the first engaging member and the second engaging member to move to a locking position. Therefore, it becomes possible to effectively prevent erroneous rotation and erroneous operation due to an axial deviation between the locking member and the output shaft, and consequently to achieve a power tool having a locking mechanism that can be operated in a stable manner.

According to the present invention, the housing is formed by two structural members that are divided along a plane including the center line of the output shaft, and a second engaging portion is formed on each of the structural members so that, when the two structural members are combined with each other, a lock ring is supported. Therefore, it becomes possible to effectively prevent erroneous rotation and erroneous operation due to an axial deviation between the locking member and the output shaft, and consequently to achieve a power tool having a locking mechanism that can be operated in a stable manner.

According to the present invention, the housing is formed by two structural members that are divided along a plane including the center line of the output shaft, and a second meshing portion is formed on each of the structural members so that, when the two structural members are combined with each other, a lock ring is supported. Therefore, it becomes possible to easily support a locking member by combining the two structural members with each other in an assembling process.

According to the present invention, first meshing portions are formed at two positions separated from each other by 180 degrees in the circumferential direction of the locking member, and second meshing portions are formed on the respective structural members. Therefore, by combining the two structural members formed by resin-molding processes, the locking member can be easily fixed.

According to the present invention, among a plurality of screws, two screws are formed on the outside of the locking member in the radial direction, with the two screws being disposed at positions that overlap with the layout position of the locking member. Therefore, it is possible to save spaces used exclusively for disposing the two screws. Moreover, the locking member can be sandwiched with a predetermined force.

According to the present invention, since a bearing for use in pivotally supporting the output shaft is formed between the locking member and the shaft hole, it is possible to stabilize the rotation state of the output shaft.

According to the present invention, a gap is formed between the first meshing portion on the locking member and the second meshing portion on the housing. Therefore, it becomes possible to make an axial deviation hardly occur between the locking member and the output shaft, and consequently to achieve a locking mechanism with high reliability as well as stable operation.

According to the present invention, in the locking member, a convex portion having a square pillar shape is formed on an outer circumferential surface of a cylinder portion. For this reason, by using at least ether one of an integrally molding process and a precutting process of metal, the locking member can be easily produced. Moreover, a gap is formed between the convex portion of the locking member and the concave portion of the housing. Therefore, the required precision for the convex portion of the locking member is not necessarily so high, and the production costs can be reduced.

According to the present invention, the extending direction of the convex portion of the locking member is made in parallel with the tightening direction of a screw, and the extending direction of the convex portion of the locking member is made perpendicular to the dividing place of the housing. Therefore, the locking member can be formed into a desirable shape and layout so as to be supported by a housing formed by divided structural members so that it is possible to achieve a power tool that can be easily assembled and produced.

According to the present invention, the relief surface having a plane shape is formed on one portion of the outer circumferential surface of the anvil, and an engaging member for limiting the relative rotation between the anvil and the lock ring is formed on the cut-out portion of the carrier member. Therefore, the locking mechanism of the output shaft can be achieved by using a simple structure. The output shaft locking mechanism can be achieved without changing the basic structures of the conventional anvil and output shaft so much, and it is possible to efficiently transmit a torque to the top tool. Moreover, in the case when an additional manual tightening job is carried out after a tightening job of a member to be tightened by using power, the job can be carried out by using the power tool.

According to the present invention, in the case when the relative rotation angle between the carrier member and the anvil becomes greater than a predetermined angle to make the center position of the relief surface separated from the engaging member, a locked state is exerted. Therefore, when the worker simply rotates the housing, with the tip tool being pressed onto the material to be fastened, the output shaft is easily locked.

According to the present invention, a socket is formed on the connection portion between the carrier member and the output shaft, with the first engaging member and the second engaging member being disposed in the vicinity of the convex portion of the socket member. Both of the first engaging member and the second engaging member are allowed to revolve together with the socket member upon the rotation of the output shaft. In the case when the socket and the locking member are relatively rotated by a predetermined angle upon stoppage of the output shaft, the relative movement of the socket member and the locking member is limited. Therefore, upon the rotation of the output shaft, the first engaging member and the second engaging member can be set to a lock release position. Moreover, in the case when the output shaft is rotated relative to the housing upon stoppage of the output shaft, the output shaft can be easily locked.

According to the present invention, the reducer mechanism, the carrier member and the socket member are housed in a cylinder-shaped case. Moreover, the convex portion formed on the locking member and the concave portion formed in the case are fitted to each other. Therefore, even in the case of a power tool using a cylinder-shaped case made of a metal or made of a resin for use in housing the reducer mechanism, the clutch mechanism and the like, the holding structure of the locking member can be adopted.

As described above, the present invention has been described based upon the embodiments. However, the present invention is not limited by the embodiments, and various modifications may be made thereto without departing from the gist of the invention. For example, the fifth embodiment has been described exemplifying an electric tool of a bending type using an electric motor as a power source. However, the present invention can be applied to a power tool without the bending mechanism. Moreover, the fifth embodiment has been described exemplifying an impact tool and a driver drill having an impact mechanism of a mechanical system. However, the present invention can be applied to an impact tool of an oil pulse system, an impact tool of an electronic pulse system, or other tightening tools in the same manner. Furthermore, with respect to power tools, such as a grinder and a circular saw, by using the structure of the present invention as a locking mechanism for preventing the output shaft from rotating in the case of loosing a nut for fixing the tip tool, it becomes possible to lock the output shaft by simply holding the housing with the hands.

INDUSTRIAL APPLICABILITY

The present invention can be applied to a power tool that tightens a fastening member, such as a screw, a nut or the like, by driving to rotate the output shaft using a driving source such as an electric motor.

The invention claimed is:

1. A power tool comprising:

a housing that houses a driving source;

a hammer that is driven in a rotation direction by the driving source and has a first protruding portion that extends in the same direction as a center line about which the drive source rotates;

a shaft portion capable of rotating relative to the housing;

an anvil that has a second protruding portion that extends from the shaft portion outward in a radial direction so as to be engaged with the first protruding portion, the second protruding portion having a plane-shaped surface extending in the radial direction and contacting the first protruding portion; and a locking mechanism that switches modes as to whether or not to lock the rotation of the anvil relative to the housing, wherein a lock releasing member is rotatably attached to the anvil, when the hammer is rotated, prior to the engagement of the first protruding portion with the second protruding portion, the first protruding portion is engaged with the lock releasing member so that the locked state of the locking mechanism is released, and the first protruding portion has a first surface extending in a first direction crossing a circumferential direction of the hammer for contacting the plane-shaped surface of the second protruding portion, and a second surface extending in a second direction crossing the circumferential direction of the hammer for contacting a portion of the lock releasing member, the second surface being arranged on an inner circumferential side of the hammer from the first surface and being offset from the first surface in the circumferential direction of the hammer.

* * * * *